US006694639B2

(12) United States Patent
Hanaya

(10) Patent No.: US 6,694,639 B2
(45) Date of Patent: Feb. 24, 2004

(54) SHEET MATERIAL AND METHOD AND APPARATUS FOR DRYING THEREFOR

(75) Inventor: Morimasa Hanaya, Suntoh-gun (JP)

(73) Assignee: Tokushu Paper Mfg. Co., Ltd., Shizuoka-ken (JP)

( * ) Notice: Subject to any disclaimer, the term of this patent is extended or adjusted under 35 U.S.C. 154(b) by 0 days.

(21) Appl. No.: 10/163,933

(22) Filed: Jun. 6, 2002

(65) Prior Publication Data

US 2003/0019125 A1 Jan. 30, 2003

(30) Foreign Application Priority Data

Jul. 27, 2001 (JP) ..... 2001-228433

(51) Int. Cl.[7] ..... F26B 11/02

(52) U.S. Cl. ..... 34/115; 34/114; 34/122; 34/618

(58) Field of Search ..... 34/444–446, 448, 34/450, 452, 454, 459, 493, 495, 496, 498–500, 507, 510, 516, 517, 306, 94, 110, 111, 114–120, 122, 123, 614, 618, 623, 624, 629, 649; 162/202–207

(56) References Cited

U.S. PATENT DOCUMENTS 5,553,392 A * 9/1996 Hanaya ..... 34/115
5,600,898 A * 2/1997 Deshpande et al. ..... 34/116
5,643,417 A * 7/1997 Hanaya ..... 162/300
5,647,141 A * 7/1997 Hanaya ..... 34/115
5,720,853 A * 2/1998 Hanaya ..... 162/202
5,921,000 A * 7/1999 Wedel et al. ..... 34/117
5,933,977 A * 8/1999 Deshpande et al. ..... 34/116
5,933,980 A * 8/1999 Deshpande et al. ..... 34/446
6,039,838 A * 3/2000 Kaufman et al. ..... 162/109
6,138,380 A * 10/2000 Veijola et al. ..... 34/446
6,146,499 A * 11/2000 Lin et al. ..... 162/197
6,203,666 B1 * 3/2001 Hanaya ..... 162/217

FOREIGN PATENT DOCUMENTS

JP 08-114385 5/1996
JP 08-114386 5/1996
JP 08-120587 5/1996

OTHER PUBLICATIONS

Shikishima Canvas Co., "Dryer Canvas", *Paper and Pulp Association Society Journal*, vol. 49, No. 10, pp. 103–108 English Abstract Only.

* cited by examiner

*Primary Examiner*—Ira S. Lazarus
*Assistant Examiner*—Andrea M. Ragonese
(74) *Attorney, Agent, or Firm*—Frishauf, Holtz, Goodman & Chick, P.C.

(57) ABSTRACT

A sheet material, a production method therefor and a drying apparatus is provided wherein a heating gas comprising mainly superheated steam is blown directly to reach the sheet internal water content via a permeable belt for restricting free shrinkage of the sheet, to give instantaneous evaporation (pressure flow) and form a porous sheet. A wet sheet 35 is clamped between an externally heated rotor 1 having heated gas blowing ports 19 for blowing heated gas from an outer peripheral direction, and a permeable endless fabric belt 36 which moves in synchronous with the rotor under a tension capable of restraining dry shrinkage of the sheet material, to thereby give rapid direct moisture evaporation and form a porous sheet.

8 Claims, 31 Drawing Sheets

CONVENTIONAL CYLINDER DRYER DRYING

FRONT SURFACE

×50

×100

×200

SUPERHEATED STEAM DRYING (250℃)

FRONT SURFACE

×50

×100

×200

HOT AIR DRYING (244.2℃ χ=0.672kg/kg)

FRONT SURFACE

×50

PAPER THICKNESS
1.23 mm

200µm

×100

100µm

×200

50µm

SHEET MATERIAL AND METHOD AND APPARATUS FOR DRYING THEREFOR

BACKGROUND OF THE INVENTION

1. Field of the Invention

The present invention relates to a sheet material and a production method thereof, having a drying process for a sheet material in a wet condition such as paper or some types of wet process-nonwoven fabric, and an apparatus for drying sheet material.

2. Description of the Related Art

A typical method for drying a paper web on a paper-making machine generally involves transfer of heat from a dryer cylinder having a second-kind pressure vessel structure (Japanese Boiler and Pressure Vessel Code similar to ASME Code in USA, DIN Code in Germany, and ISO Standard) internally heated with medium to low pressure steam, or from a cylinder internally heated by direct combustion or electromagnetic induction heating. These cylinders are surrounded by an open hood having only a roof and a curtain-type wall, or a loosely sealed hood having an opening for many sheets and ropes, a drive shaft and a piping, a duct, and a door moving up and down, having many gaps for moving up and down.

A large volume of medium temperature, low humidity air heated by low pressure steam is blown into respective parts of the hood, mainly into a pocket portion between dryer cylinders. The steam evaporated from the wet sheet material and the air blown mainly into the pocket portion are removed together with leaking air into the hood from many hood openings and gaps, under medium temperature and low humidity conditions with the relative humidity being 30% or less, so that dew condensation does not occur in the hood.

The absolute humidity of the discharge gas is low and the dew-point temperature is also low. Since heat transfer in condensation is quite little, the only way to heat the fresh is to heat by a sensible heat. The heated moist air including a large amount of discharged steam is directly released to the atmosphere. Hence an enormous amount of heat and water are wasted. Moreover, the air supply and discharge blower supplies and discharge large amount of air, thereby wasting a large amount of power.

The dryer cylinder having the second-kind pressure vessel structure consumes a large amount of low pressure steam of about 2 to 4 kg/cm$^2$ via a rotary joint. The steam condensed inside is extracted and returned to a boiler water supply. During this time, the drain gradually decreases in internal pressure in the tube through each flush tank of the drainage system, and finally returns to the atmospheric pressure in the drain tank of the power station, and re-evaporates and radiates heat.

In Tappi Journal published in May 2000, there is proposed a method of drying a wet sheet material at a high temperature in excess of 100° C., while restraining expansion and contraction thereof, wherein the sheet material is held between two endless steel belts, high pressure cases opened towards the belt surface are provided above and below thereof facing each other, to perform high pressure steam heating and high pressure water cooling, to thereby immediately condense the evaporated steam on the cooling surface, and the condensate is drained onto an endless fabric belt and carried away.

This method requires precious high pressure steam. However, since this involves high temperature steam heating in a closed vessel, the temperature in the vessel is restricted by the saturated temperature of the steam. With the impingement drying method of the present invention, the sheet material can be heated using super-heated steam of 250° C. substantially at atmospheric pressure (needless to say, a direct combustion method is desired for the heating method using a heat exchanger). In the closed vessel, the steam temperature of 250° C. means the steam at a pressure of 40.6 kg/cm$^2$. Therefore, steam turbine power generation using the steam pressure difference, which is normally performed in the central power station is not possible. Moreover, this method requires a large quantity of cooling water, which can only be recycled as low temperature warm water.

Furthermore, the above method requires two pressure vessels facing each other and having a strong frame structure mechanically corresponding thereto, enormous investment in plant and equipment involving high pressure heat exchangers and high pressure pumps, and power and steam expenses. It has of course a large effect in improving some aspects of quality, such as paper strength, but on the other hand, the density becomes high due to the high compressive force by the upper and lower steel belts, thereby making the thickness of paper very thin.

The heating surface is smooth like a Yankee glazed surface, but on the other hand, the cooling surface is a corrugated surface with a fabric belt mark, and hence, there is a large difference between the front surface and the back surface. Therefore, there are problems in that it is not suitable except for liner board for parts of cold storage, and there is no heat saving effect.

For drying of thin sheet materials, such as thin paper and toilet and tissue papers, high temperature gas of 350° C. by natural gas or kerosene burner using fresh air or a part recycled moist air are impinging over the exposed sheet material without dryer fabric belt, under a high speed of 70–120 m/sec. from the outer surface of a single large-diameter dryer cylinder (generally called a Yankee dryer, with the sides and the entrance and exit for the sheet material thereof completely opened in the interior space) is heated by medium pressure steam of about 10 kg/cm$^2$, and installed so as to open to the outside, which has a canopy hood disposed in a central top half portion of the cylinder. The sheet material has a Yankee glazed surface on one side only, and the other side remains rough. The use of manufactured product is therefore limited somewhat to such uses as a wrapping paper with one glazed side, tissue paper, and crepe paper. Moreover, there are problems related to fire accident by high temperature combustion gas and a diameter of the dryer cylinder becomes a problem with respect to transportation thereof and the diameter cannot be further larger.

Actually, for the paper industry that essentially requires a large amount of pure river water, it is common worldwide for the consolidated area of the paper mills to be in an area blocked by steep ridges, with narrow roads. Therefore, the width of the paper-making machine is restricted by the dryer width capable of truck transportation.

Moreover, there has also been proposed a method of recycling the evaporated saturated steam as a part of the heat supplied to drier cylinders, which are pressurized vessels, without supplying air to the loosely sealed hood. However, in practice, it is difficult to eliminate air completely from the loosely sealed hood of a large volume having covered passageways on the opposite sides thereof.

Furthermore, volumes of air enter into the sealed hood together with the sheet material and the endless fabric belt supplied continuously through an opening from the wet part.

When the sheet material breaks due to internal shrinkage and forcible driving, and the low temperature wet paper is absorbed to the dryer cylinder and breaks over and over, it is necessary to stop the machine, open the loosely sealed hood, and after the interior of the hood has been cleared of the breakage, close the hood and re-start. Whenever this happens, the inside of the hood is replaced with the air. Under these circumstances, it is impossible to keep air entering into the hood below 4% as is generally recommended (oxygen: 0.84%, steam partial pressure: 729.6 mmHg) with the related art.

Further, the saturated steam inside the sealed hood enters into the wet zone, when cooled by the wet sheet material as well as external air entering the sealed hood from many openings. Then, moisture condensed on the metal surfaces of the hood and dryer frames may drip onto the sheet material, creating staining defects. Because of such inherent problems, this proposed technique has not been commercialized yet.

As is described in the introduction of "Theory of Drying", Article 6.2 in Pulp and Paper Manufacturing Technology, Volume 6, "Paper Making", edited by JAPAN TAPPI, published in December 1998, stating "The form most popular at present in drying methods in paper-making machines is a form in which dryer cylinders are heated by pressurized steam therethrough, and wet paper is pressed against this heated surface, . . . ", it has been a rigid rule to dry ordinary paper by dryer cylinders whose inside was heated by pressurized steam, with the exception of the case where the inside thereof is heated by direct combustion, in part of home paper mill in old days. The current dryer cylinder has a second-kind pressure vessel code (in Japan) structure, and an internal heating structure mainly consists of conduction heat transfer from a low temperature cylinder in which heating is performed from the inside with low pressure steam.

Since it has been heretofore believed even by those scientists in this field that the drying rate is increased by a difference in the steam partial pressure in the air, it has been considered to be advantageous that the evaporation surface of the sheet is heated to a high temperature to create high steam partial pressure, and dried air having low steam partial pressure (having low absolute humidity) is used as the heated air.

Generally, the drying of a wet paper web (sheet material) is generally based on letting both sides of the wet paper web alternately come into contact with the dryer cylinders heated by low pressure steam so as not to loose smoothness due to curling and cockling. Furthermore, dimensional stability is provided by sandwiching the wet paper web between the dryer cylinder and an endless fabric belt so as to restrict free shrinkage in the cross direction of the paper. However, the drying of paper is mainly performed in a free traveling section between drying cylinders, and the cross direction of the paper greatly shrinks in the free running section, such effort has had minimal effect.

Furthermore, with increasing production speed of paper making, the number of dryer cylinders has also been increased from a dozens to nearly one hundred cylinders, so that the constitution of the apparatus becomes complicated. Therefore, in the drying section, complicated control is performed by a individual electric drive by pulling the paper with a uniform tension to cope with shrinkage in the cross direction and the travelling direction. Furthermore, the fabric belt and the fabric belt suction roll as well as an air boxes are employed to prevent paper break and achieve uniform drying in both longitudinal and transverse directions. Nevertheless, breakage of paper does occur frequently between the dryers or the dryer sections, and when the paper web is broken, the paper machine must be stopped. In this case, the loosely sealed hood must be opened to remove the breakage before the machine can be re-started. The existing process therefore requires much time and manpower, causing a drop of productivity, and maintenance problems can present problems to personal safety in some cases.

The multi-cylinder type dryer cylinders have a diameter reaching up to 2 m from 1.2 m to 1.5 m, and the maximum cylinder width has also been increased to a size in excess of 10 m. Therefore, extra attention must be paid to the transport problem from the cylinder foundry to the mechanical assembly plant and to the final paper mill. The dryer cylinders made of cast steel as the second-kind pressure vessel having a steam pressure as high as 2 to 4 kg/cm$^2$ have a possibility of explosion due to casting nest or deterioration with lapse of time, which presents a problem of accidents resulting in injury or death. Moreover, in the casting industry, location of plants in Japan becomes more and more difficult due to their very bad working environment and dust pollution. Therefore, the dryer cylinders made by casting have to rely on imported products from overseas, and this is becoming a vulnerable point in the paper industry in Japan, including shipping costs.

Moreover, with an increase in the speed of the drying section, for example, 1800 m/min. in the case of newsprint, there is a case where the drain condensed inside moves around in the internal circumference of the dryer cylinder, causing problems in that draining of the condensates does not take place smoothly, causing uneven drain film it thickness across the cylinder width.

Another serious problem is associated with a huge volume of steam required for the dryer section From 1.5 to 3 tons of steam is required for every ton of dried paper produced (depending on the raw material or paper grade). Hence the paper industry becomes an industry consuming lots of energy.

As the loosely sealed hood, a hood has been developed in recent years by improving the insulation performance of the hood so as to obtain a dew point of around 60° C. (though differing in each section of the hood, in an actual example, as the average air condition at the exit of the discharge fan, wet-bulb temperature: 63° C. at a dry-bulb temperature of 110° C., dew-point temperature: 60.5° C., absolute humidity: 0.1553 kg steam/kg dry air, steam partial pressure 151.8 mmHg, relative humidity: 14.1%). However, the oxygen concentration is still 16.8%, and the risk of fire or dust explosion due to broken paper or paper dust has not yet been solved. The volume of air required has also been lowered significantly, but most of the important steam vapor evaporated is still discharged to the atmosphere, and a problem remains of generation of enormous amounts of white smoke (produced by condensation of moisture in the discharged moist air), particularly during winter and early spring seasons. In some locations, this presents a serious hazard to residents and traffic.

In the Kyoto convention for arresting global warming held in Dec. 11th, 1997, the Kyoto Protocol having legal obligation was adopted for the first time in the world, requiring that greenhouse effect gas such as carbon dioxide ($CO_2$) is to be reduced by 5.2% (6% in Japan) compared with 1990 over five years before and after year 2010. In addition, an international joint research group including the National Environment Laboratory in Japan published in May 8th, 2001 that steam content in the air was increasing in the last 50 years, and human activity was one reason for that. The steam content in the atmosphere has a greenhouse effect exceeding that of carbon dioxide, and an increase in concentration in the stratosphere has an action of destroying the ozonosphere due to freon or the like. However, a comprehensive study related to concentration fluctuation has been performed for the first time, and it is expected that the conventional global warming research will be reconsidered. It has been found that the steam concentration in the stratosphere is about 4 to 6 ppm, which has increased by about 2 ppm in about 45 years from the mid 1950s. About half of the increase of steam is generated by methane gas, whose concentration is increasing in the air, which is oxidized in the upper atmosphere and turned into water. The cause of the remaining half is uncertain. Japanese pulp and paper industry got over the thermal energy crisis, which caused a sharp rise in the oil price due to two oil shocks in 1973 and 1979, after pathetic efforts, involving steps from the chemical recovery of spent cooking liquor, the chip cooking, and pulp washing, up to stock preparation and paper making. As a result, the energy-saving level is at the top of the world, and further energy saving of 6% reduction over the level of 11 years ago will be nearly impossible. We thus have no alternative but to proceed with afforestation in developing countries to increase the $CO_2$ absorbing effect of the forests.

Moreover, so long as the moist air is used as the transfer gas for the vaporized steam in the loosely sealed hood, the upper limit of dew point temperature is around 60° C. When the quantity of dry air is less is compared with the quantity of the evaporated steam, saturation of the air can occur easily, and air is easily condensed in the sealed hood. In this case, the surface of the paper is contaminated due to drip of condensation and papermaking becomes difficult. Furthermore, the temperature of the sheet material on the side in contact with the dryer cylinder reaches about near 100° C., but the temperature thereof on the contact side with fabric belt is restricted to about 90° C., due to the latent heat loss of the removed moisture from the paper cylinder contact surface.

Furthermore, voids in the fabric belt are filled with vaporized steam and condensed moisture, and there is a temperature gradient between the outside layer and the inside layer, the former is in equilibrium with the dew-point temperature of the moist air (65 to 70° C.) and the latter is in contact with the sheet material (about 85° C.), thus water evaporation from the sheet material is greatly restricted. For this reason, there is little drying of the sheet material taking place in the zone of the dryer where the sheet material is in contact with the fabric belt, and most of the drying actually takes place in the free running zone between the plurality of dryer cylinders, where the moisture is evaporated directly from the surface of the sheet material.

From this reason, an effort has been made to improve the dimensional stability of the sheet material by holding the sheet between the dryer cylinders and the endless fabric belt for drying the sheet and restricting free shrinkage of the sheet material. However, only about 20% of drying takes place in the fabric belt-restrained zone, and about 80% of the moisture is evaporated in the free running zone of the sheet material where free shrinkage is possible.

Recently, an attempt has been made to solve the above described problems by arranging multi-cylinder type dryer cylinders in a single row and providing a large-diameter suction fabric belt roll close to the dryer cylinders as much as possible, to thereby reduce the free running zone between the adjacent dryer cylinders. However, there is a large difference between the thickness of the endless fabric belt and the thickness of the sheet material, and these reverse the inside and outside alternately, and hence the radius differs largely between the dryer cylinder and the suction fabric belt roll portion. Hence, a difference in the surface velocity appears, frequently causing a problem in that the wet sheet material is broken.

Initially, the arrangement of the suction fabric belt roll was changed to give an upward directed arrangement and a downward directed arrangement for each section, but there is a problem in paper delivery at the time of paper break, and only the downward directed arrangement could be adopted. In this case, a large problem occurred in that drying only from one side of the dryer cylinder caused dry curling of the paper. As a measure against this problem, an attempt has been recently made in which air caps are provided in key points of the downward directed single-row dryer cylinders in the terminal stage of the drying part, to blow heated air of about 150° C. at a rate of 100 m/sec., which is similar to the heated air impingement drying method registered by the present applicant. However, this has an assisted drying capacity correcting only curling, and uses low-pressure steam for the circulated heating source of the blown heated air. As a result, it has to be used in a range of low dew-point temperature which does not infringe the registered patent of the present applicant (Japanese Patent No. 3007542, U.S. Pat. No. 5,553,392, U.S. Pat. No. 5,647,141, EC Pat. Registration decided). Therefore, this has an enormous heating requirement as described later in detail, and has to be limited for correcting curling.

SUMMARY OF THE INVENTION

It is an object of the present invention to provide a sheet material and a production method therefor, and an apparatus for drying sheet material, wherein the above described many technical problems are overcome, high-speed drying several times higher than before is achieved by means of impingement energy, without causing breakage of the paper, thereby succeeding in the reduction of heating requirements to about one eighth, as well as increasing physical strength by decreasing a glass-transition temperature of the paper, and the paper is made porous by instantaneous evaporation to decrease the bulk density thereof by 31%.

In order to solve the above described problems, the sheet material and the production method thereof is characterized in a process for drying a sheet material in a wet condition, wherein the inner periphery of the sheet material is supported by a rotor having a rotatable arc-shaped smooth surface, within a sealed hood interior set to a predetermined pressure and temperature, the outer periphery thereof is clamped by an endless heat-resistant belt movable in synchronous with the rotation of the rotor and having gas permeability of at least 7,500 $cm^3/cm^2/min.$, under a tension capable of restraining dry shrinkage of the sheet material applied by means of a belt roll, and heated gas is blown from the outer peripheral direction of the rotor towards the belt in a drying zone selected according to the intended use, to thereby dry the sheet material mainly by external heating.

The apparatus for drying sheet material of the present invention is characterized by a drying apparatus for a wet sheet material, wherein there are provided, in optional sections according to intended use, a plurality of rotors having a smooth outer peripheral surface, for propelling the sheet material on the convex curved surface, while supporting an inner peripheral surface of the sheet material; an endless gas-permeable heat-resistant belt coming in contact with an outer peripheral surface of the sheet material and movable in synchronous with the rotation of the rotor, while holding the sheet material between the rotor and the belt; a multiplicity of belt rolls for applying a tension capable of restraining dry shrinkage of the sheet material to the heat-resistant belt; and a heated gas supply section for blowing heated gas from an outer peripheral direction of the rotor towards the heat-resistant belt, and the rotor is heated from the outer peripheral direction by the heated gas having passed through the belt-like body, which is supplied from the heated gas supply section.

The present inventor has found in the process of development, that excluding the passing section from of the entry and exit portions for the hood where the sheet material passes through, if a rotatable rotor internally heated by low pressure steam is impingement-heated from the outer periphery of the rotor, by heated gas (super-heated steam, heated moist air having a dew-point temperature of at least 65° C., nitrogen gas containing a small amount of solvent or steam) higher than the saturation temperature corresponding to the supplied steam pressure, with the rotor including the sides thereof being completely sealed by a heat insulating material, then the surface temperature of the rotor is heated up to about 25° C. less than the heated gas temperature, and the low pressure steam supplied as the heat source for the rotor is not condensed, but is overheated and discharged as super-heated steam, and hence the drying rate can be increased rather than by stopping the low pressure steam supplied to the rotor.

Accordingly, a sheet material and the production method thereof, and a drying apparatus for the sheet material can be provided by blowing the heated gas from the outer peripheral direction of the rotor supporting the sheet material towards the belt, as in the present invention, wherein high-speed drying several times higher than before can be achieved by the impingement energy mainly by external heating. As a result, the required heat can be reduced to about one eighth, the physical strength of paper can be significantly improved by a fall of the glass-transition temperature of paper, and the paper is made porous by instantaneous evaporation to decrease the bulk density by 31%. Moreover, by blowing the heated gas while holding the sheet material between the gas-permeable belt and the rotor to thereby dry the sheet material while restricting the expansion and the contraction thereof, dimensional stability such as extensibility in water can be increased. Also, by selecting the front or back surface of the paper to adjust the drying conditions, curling degree in the CD and MD directions can be adjusted to prevent the occurrence of curling beforehand. Furthermore, by propelling the sheet material, while holding it between the gas-permeable belt and the rotor, breakage of paper can be eliminated. Meanwhile, microorganisms can be sterilized substantially by 100%, by directly heating the moisture in the sheet to at least 100° C. in the wet zone by heating with high-temperature super-heated steam, and by the water evaporation from the inside of the sheet by means of a pressure flow. As a result, there is a possibility to produce sterilized paper for food and medical applications, such as cup base paper and milk carton base paper. In "New Technology in Food Processing" published by CMC Co., Sumio Kawai, it is described in "Drying and sterilizing effects of bread crumbs in super-heated steam fluidized bed" that in an atmosphere of super-heated steam of 150° C., the viable count of about 700 millions was reduced such that the remaining viable count was only one after one minute later. On the other hand, in heated air of 150° C., the remaining viable count was still 36,000 after five minutes later. In the drying of wet strength paper or dry strength paper, the moisture in the sheet is directly heated to at least 100° C. in the wet zone by heating with high-temperature super-heated steam, and by the evaporating the moisture from the inside of the sheet by means of pressure flow, the super-heated steam in excess of 100° C. impinges upon the wet strength agent or the dry strength agent, to advance the paper strength manifestation mechanism in the steam atmosphere. As a result, it becomes possible to manifest the paper strength even if the aging time normally required after paper finishing.

In development tests for a new drying method extending over a long period of time, since heat-resistant lubricating oil was expensive, at first an attempt was made to expose the bearing of the rotor to the air by disposing the sides of the rotor outside of the hood and seal the outer peripheral surface and the side portions of the end plate. However, complete sealing was difficult, and the air easily entered. As a result, it was found that it was necessary to maintain the internal pressure of the hood relatively high, such that the leaking steam is condensed on the sealed surface to thereby effect sealing, in order to maintain the 100% super-heated steam atmosphere.

Moreover, heat loss from the cylinder sides was also large, and as described above, it was confirmed that internal heating in the cylinder should not be stopped. Thereafter, the entire surface of each cylinder was tightly closed, and remodeled with a brush seal method. As a result, the leaked amount of steam has decreased sharply, so that not only high dew-point moist air but also a 100% super-heated steam can be sufficiently ensured.

In tests after completion, when the wet sheet material is held between the rotating cylinders and the endless gas-permeable belt tensioned with a high tension having a width of 1.5 kg/cm, preferably, at least 2 kg/cm, and quickly dried (dried by impingement) in a super-heated gas atmosphere of at least 130° C., it was confirmed that the occurrence of breakage in the travelling direction resulting from shrinkage within the fiber caused by interfiber bonding or shrinkage in the cross direction can be restrained by nearly 100%. Thus, according to the present invention, it becomes possible to produce sheets having high dimensional stability and a small aspect ratio, without causing dry curling.

The softening point temperature of lignin and hemicellulose, drops in an atmosphere of super-heated steam (steam 100%) and in an atmosphere of heated moist air having high absolute humidity (at least 1 kg/kg' DA), respectively (although the softening point of dried lignin is 134 to 250° C., the water saturated lignin falls to 72° C.). The above phenomenon is caused by a drop of the glass-transition temperature. Therefore, flexibility of fibers is increased, and wet sheet strength is substantially increased due to the covalent bonding (ether bond, ester bond) of the hydroxyl group in cellulose with other substances contained in the wood. By impingement drying with super-heated steam in excess of 150° C. (or high temperature, high humidity heated moist air having a dry-bulb temperature of at least 150° C. and a dew-point temperature of at least 65° C.) to thereby decrease the softening temperature, physical properties such as DRY tensile strength, WET tensile strength, water immersion elongation and bursting strength can be considerably improved, compared to the conventional drying by dryer cylinders in which the inside thereof is heated by steam. It has been found that of the various physical properties of paper described above, the improvement in strength of various kinds of paper is notable not only in the wet paper mainly composed of UKP (Unbleached Kraft Pulp) and BKP (Bleached Kraft Pulp) using conifers and broad-leaved trees, but also GW (Ground Wood), RGP (Refiner Ground wood), PGW (Pressurized Stone Ground wood), CGP (Chemical Ground Pulp), SCP (Semi Chemical Pulp), TMP (Thermo Mechanical Pulp), CTMP (Chemical Thermo Mechanical Pulp) containing more lignin and hemicellulose, and wet paper mainly composed of pulp such as DIP (De-Inked Pulp) essential for recycling of waste paper. Therefore, this effect is further remarkable in not only printing paper such as paper of fine quality, but also newsprint and cardboard base paper (liner and corrugating medium) having a large ratio of DIP and mechanical-type pulp, and white board.

Furthermore, in cylinder drying and heated air drying using the conventional second-kind pressure vessel, moisture diffuses in the sheet material (paper) by a capillary flow and evaporates on the surface of the paper, whereas in super-heated steam drying, moisture evaporates instantaneously in the sheet material and becomes steam, and reaches the surface of the sheet material by a pressure flow. Thus, the moisture evaporation mechanism is quite different between the cylinder drying or heated air drying and super-heated steam drying, and diffusion resistance in the super-heated steam drying is small. As a result, the inner portion of the sheet material becomes porous by several times to several hundred times as measured by means of a pore tester using the mercury press-in method, apparent density of paper decreases by 31%, and moisture absorbing and releasing performance of the sheet material is significantly improved, and thereby the ink absorption property of printing paper and ink jet paper are improved extensively, and the moisture absorbing and releasing properties of stabilized paper and impregnated paper are a also extensively improved.

In a heated gas atmosphere above 130° C., the sheet material and the gas-permeable belt having a heat resistant property are brought as close as possible to the blowing ports of the external heating type rotor, putting a walk way outside the hood in view of safety, the internal capacity within the sealed hood can be reduced to one tenth or less compared to the conventional hood, the canvas dryers are eliminated, and a basement area, being a broken paper recovery space, becomes no more unnecessary because the problem of paper break has been settled. As a result, rapid drying is realized, and the plant construction cost can be dramatically reduced.

Moreover, since sealing portions having a short endless heat-resistant sealing belt and a sealing roll, and a sealing pinch roll and a heat-resistant brush seal are respectively provided at the entry portion and the exit portion of the sheet material with respect to the hood interior, outside air can be completely prevented from entering into the hood, the drying efficiency thereby can be remarkably improved. At first, tests were started by making for trial purposes a rotor capable of restraining a wet sheet together with a gas-permeable belt and a wind tunnel provided with caps for blowing super-heated steam and heated air around the rotor. In order to set the internal gas condition to a predetermined values, a gas obtained by heating a circulating gas by an electric heater was blown into the wind tunnel for pre-heating. In the drying test using super-heated steam, in order to introduce the wet sheet into the wind tunnel by means of the fabric belt, various kind of air intercepting apparatus were made for trial purposes and mounted at the entry slit portion to thereby perform the tests. However, a small amount of air entered from narrow slit-like gaps into the inside accompanied by the surface of the sheet and the fabric belt. Hence, it was difficult to realize the oxygen content less than 1% by the oxygen analyzer. Although the oxygen content was considered to be an instrument error, but it was found that the reason was the inflow of a small amount of air. Finally, the air interception method of the present invention makes it possible to reduce the oxygen concentration to 0.0%, and a ortho-test can be started. A zirconia type oxygen analyzer and moisture analyzer applicable to high-temperature super-heated steam were used for measurement of the gas conditions in the wind tunnel, and calibration was always performed using a standard gas before and after the test.

Furthermore, since a gas composed mainly of steam evaporated from the sheet material was reheated to at least 150° C., preferably to at least 250° C. by a gas circulation unit so as to fill the evaporation chamber with substantially 100% super-heated gas, while controlling the supply and discharge amount of the gas with respect to the hood to thereby set the pressure inside the hood higher than the external pressure (atmospheric pressure), entry of the external air from the outside of the hood through the inlet and outlet of the hood can be completely prevented, which results in improving the drying efficiency.

As a gas permeable fabric belt having a gas permeability of 7500 CCM or higher, (normally, the temperature of the belt becomes considerably lower than the gas temperature), the use of various fabric belts made of PEEK (polyether ether ketone) or PPS (polyphenylene sulfide) or a wire made of metal (made of stainless steel or made of bronze) made it possible to dry the wet sheet material very quickly in a region where the dry shrinkage was restrained. For a type of paper in which the surface smoothness is important, it is desired to sew a thin belt having a good surface quality onto the sheet contacting surface.

Regarding the sealing apparatus proposed in the already registered patent by the present applicant, it was found that the contact portions of the seal pipe and the sealing bracket roll, and the sealing pinch roll became a problem in achieving high speed drying. Therefore, a brush roll method has been developed, to thereby eliminate mechanical contact portions, using a water seal by means of condensed water from the leaking super-heated steam.

Moreover, since the sheet material in a wet and low temperature state has a low surface temperature at the entry portion of the drying apparatus, in order to prevent the paper from sticking to the cylinder and causing frequent breakage of paper, a steam curtain method has been developed by use of a steam box and a suction box. By installing these boxes at the entry portion, problems such as paper break and air leakage were eliminated.

In the present invention, as described above, evaporation and drying in a heated gas atmosphere is made possible by eliminating external air in a specially sealed hood. Therefore, most of the drying process can be completed in a zone where free shrinkage is restrained by the endless gas-permeable fabric belt. That is, the side of the sheet material supported by the rotor has a higher temperature of about 110° C. due to high tension by the belt, compared to the conventional temperature of about 100° C., and furthermore, this temperature quickly increases with evaporation of moisture, up to a temperature about 25° C. less than the heated gas temperature. Then, the moisture contained in the sheet material rapidly moves towards the belt side, and in this state, by blowing heated gas of above 150° C. to the surface of the belt at a high speed of more than 50 m/sec., the moisture in the sheet material evaporates directly from the contact surface with the belt, passes through the voids in the belt, and is sucked by a blower through a nozzle-shaped or slit-shaped gas discharge port installed close to the belt. Therefore, unlike to the conventional case, wherein the moist steam in the belt is cooled by the surface of the sheet material at 100° C. or lower, and condensed in the belt to become a wet condition, and then returns again to the surface of the sheet material, to re-humidify the surface the sheet material does not occur.

In addition, differing from the conventional construction in which heating is performed from the cylinder side, the present invention has a construction in which heating is performed from the belt side (surface side). Hence, the problem does not occur as before, where moist steam evaporated from the sheet material is accumulated in the belt thereby interrupting evaporation from the surface of the sheet material.

As described above, inside of the belt does not become a wet condition due to the condensed moisture, as before, and hence a fabric belt dryer (a dryer for drying the belt), which has heretofore been required for drying the wet belt, becomes unnecessary. As a result, since a space for installing the dryer for the belt is no more unnecessary, the building cost can be considerably reducted.

In the present invention, since a large amount of heated gas is circulated to maintain the temperature inside the hood always at least 130° C., and at the hood entry portion where the sheet material in the wet and low temperature state is introduced into the hood, super-heated steam is made to pass through the cross-section of the sheet by means of the steam box and the suction box, the sheet temperature is thereby raised abruptly by the condensation heat transfer. Accordingly, the dew condensation problem in the hood can be eliminated.

Moreover, a lot of problems associated with the cylinder of the conventional second-kind pressure vessel which has had to be heated with steam from the inside can be solved by the impingement heating of the present invention in that the cylinder is heated by external impingement of a high-temperature gaseous body. The present invention thereby makes it possible to form the cylinder not as a pressure vessel but it is possible to form into a cylindrical shape by combining a plurality of thin metal plates or heat-resistant plastic plates, which enables to divide the cylinder into pieces for transportation and assemble these pieces into a cylinder at a construction site.

The present invention is an external heating method mainly involving heat transfer by means of impingement injection of high temperature heated gas of at least 150° C. from the outer periphery of the rotor, and partly a gas heat radiation, and hence, the drying mechanism is fundamentally different from the conventional method. Of course, in the initial stage of drying, the rotor temperature increases by high temperature gas heating, and the sheet material is also indirectly heated from the inside, but in and after the medium period of drying, the sheet temperature increases to higher than the rotor temperature, and heating is effected only by external heating. The rotor (dryer cylinder) which is not heated internally as described above, has until now never known anywhere in the world.

As described above, in the drying process of the present invention, in which different from woven fabric, paper and wet process-nonwoven fabric which are easily broken in wet conditions, and shrink largely in the cross direction due to the continuous tension loaded in the traveling direction through many rolls, and in which interfiber bonding occurs with the evaporation of moisture in the drying process, to thereby cause shrinkage within fibers, a sheet material such as paper or nonwoven fabric having such properties is rapidly dried, while restraining expansion and contraction of the wet sheet material, with one side thereof being brought into contact with a rotatable rotor heated mainly by external heating, and the other side being clamped by an endless gas-permeable belt under high tension, in a sealed hood shut off from the external air, in a pressurized condition slightly higher than the atmospheric pressure, in an atmosphere of heated gas of not lower than 130° C., that is, super-heated steam of not lower than 130° C., or heated moist air of a dry-bulb temperature of not lower than 130° C. and an dew-point temperature of not lower than 65° C., or a mixed gas of nitrogen gas of at least 80% containing a small-amount of solvent gas of not lower than 130° C. and steam of about 10%. A high-temperature gas in the hood and a gas mainly composed of steam evaporated from the sheet material through the gas-permeable belt are sucked from the gas discharge portion, and circulated and reheated by a gas circulation heating apparatus having a heat source, to be blown at not lower than 150° C. from the outer periphery of the rotor, while the remainder is sucked by the gas discharge section and utilized as another heat source. As a result, the sheet material can be dried at high speed of about six times as high as that of the prior art, and by a required heat of about one eighth of the conventional case in a energy saving manner.

In the conventional drying method, the drying rate is slow in the zone where dry shrinkage of the sheet material is restricted by the internal heated cylinder and the fabric belt due to the above-described reasons. On the other hand, in the present invention, drying in an absence of oxygen can be realized by high speed impinging drying at a high temperature, in an atmosphere mainly composed of super-heated steam. At this time, since it is necessary to avoid the risk of burning due to the high temperature, or an oxygen deficiency due to the decrease in oxygen concentration, the walkway, which was conventionally installed inside of the hood, is provided outside the hood in the present invention, to thereby considerably reduce the required space.

DESCRIPTION OF THE PREFERRED EMBODIMENTS

First Embodiment

Figure 1:
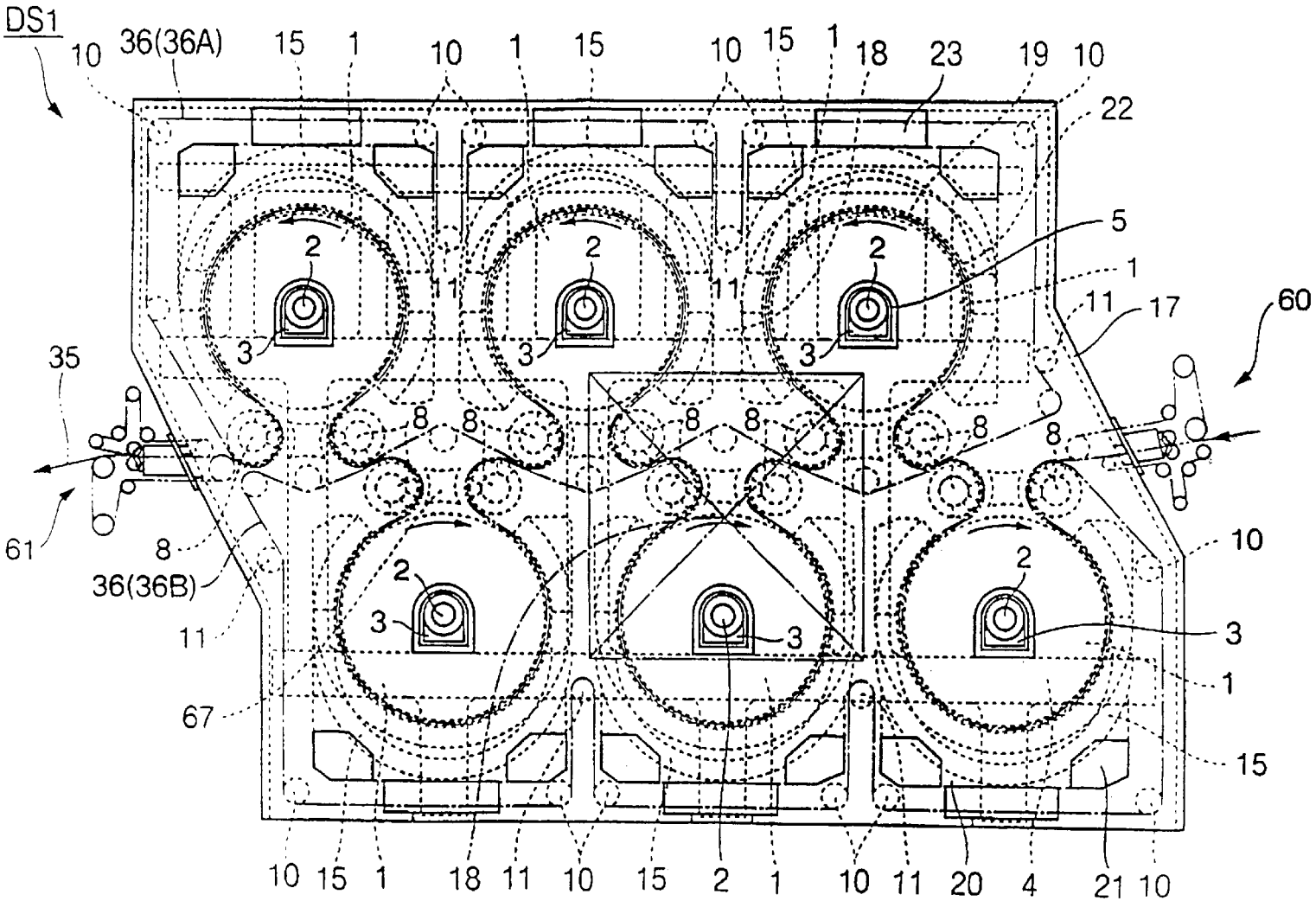
FIG. 1 is a side view showing a first embodiment of a drying apparatus of the present invention.
Figure 4:
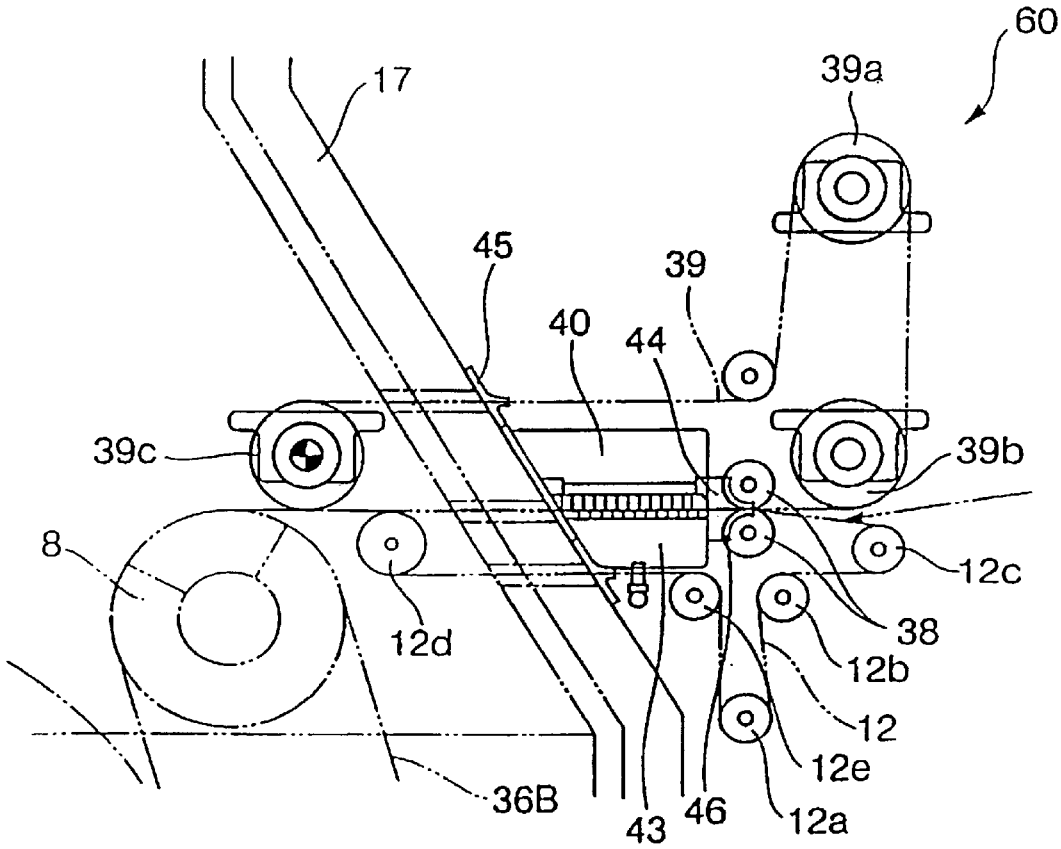
FIG. 4 is a diagram showing a sheet material entry section for a hood.
Figure 5:
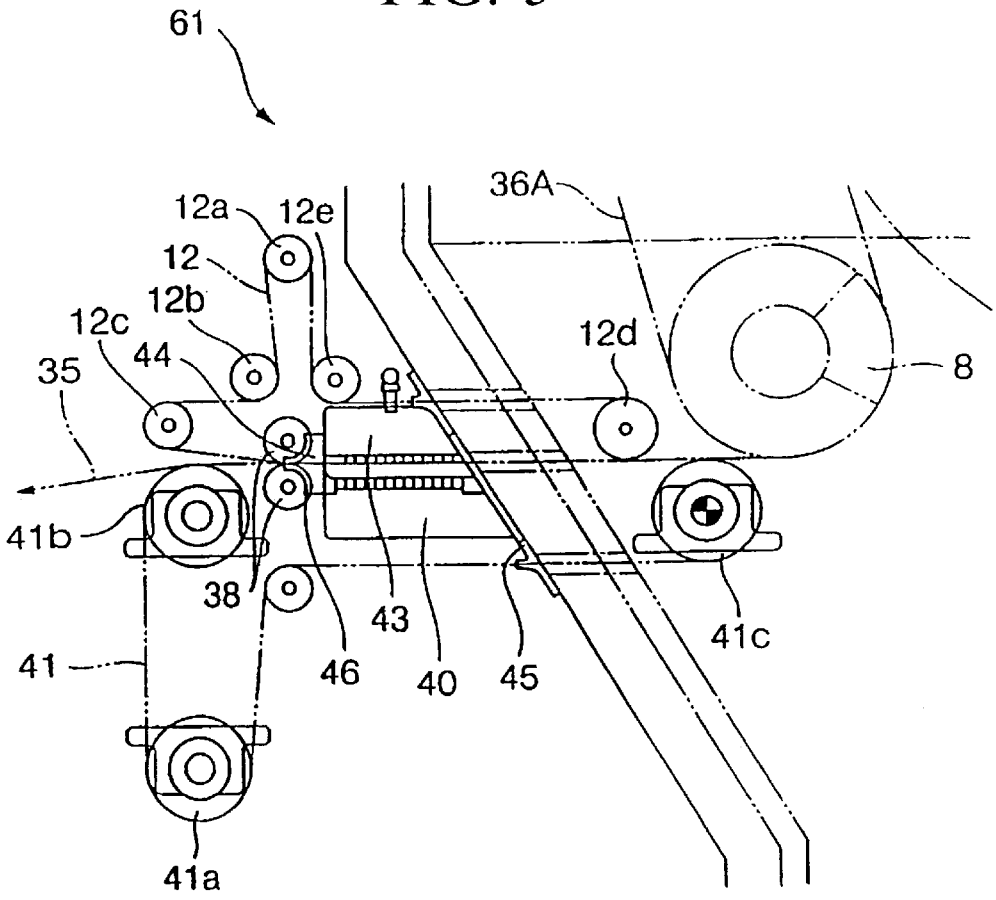
FIG. 5 is a diagram showing a sheet material exit section for the hood.
Figure 6:
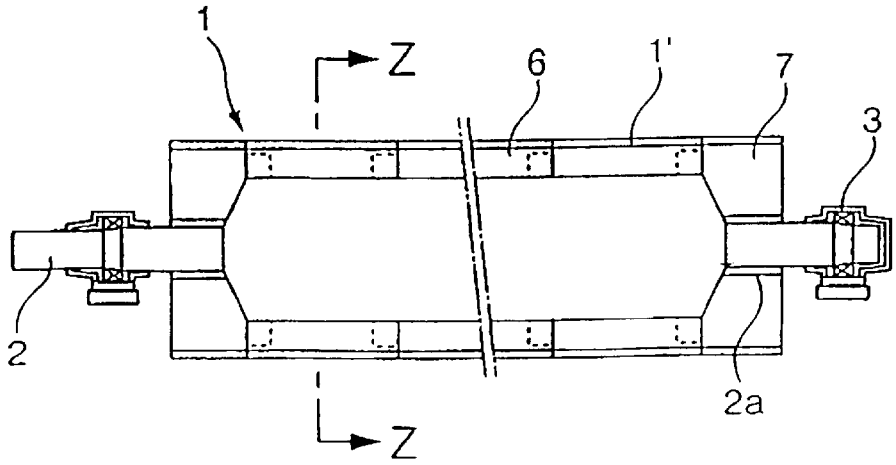
FIG. 6 is a longitudinal cross-sectional view showing one example of a structure of a rotor cylinder.
Figure 7:
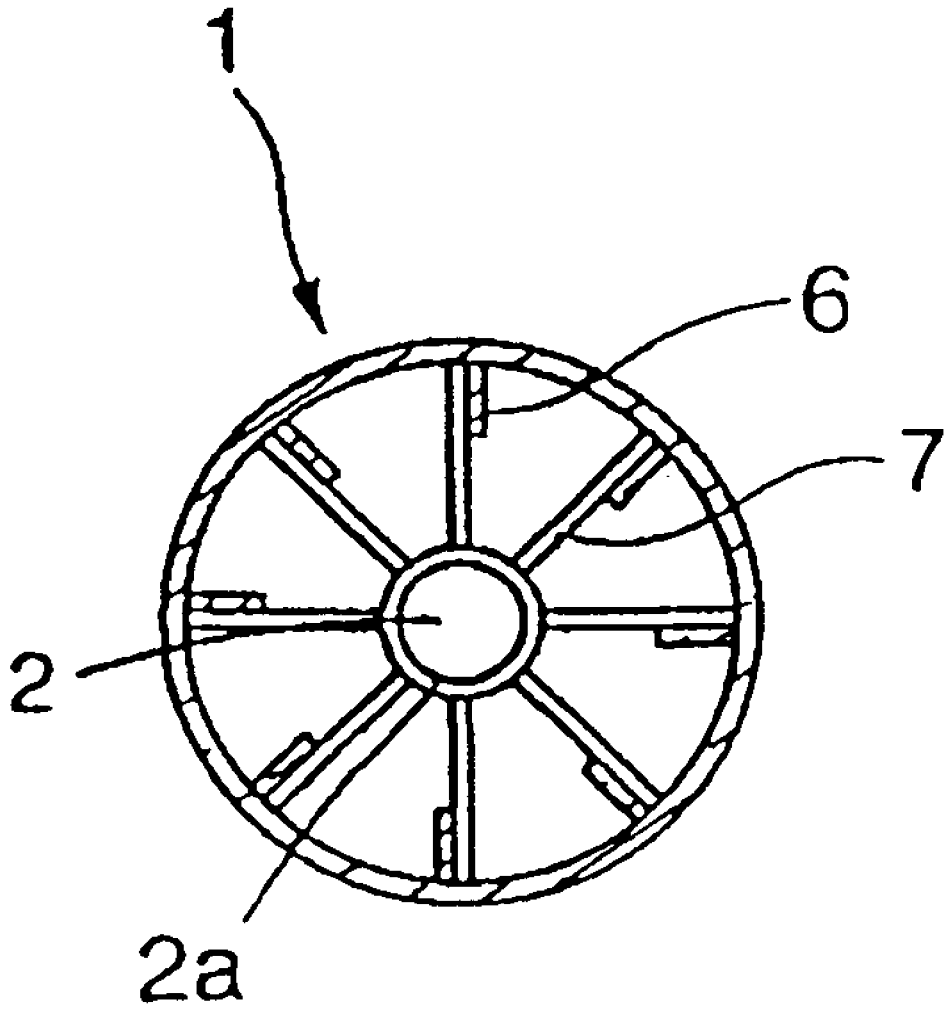
FIG. 7 is a view in the direction of arrow Z—Z of FIG. 6.

Hereunder is a description of a drying apparatus for sheet materials of the present invention. FIG. 1 is a side view showing a first embodiment of a drying apparatus for sheet materials of the present invention, FIG. 2 is a cross-sectional side view of FIG. 1, FIG. 3 is a circulation system diagram for heating gas, FIG. 4 is a diagram showing a sheet material entry section for a hood, FIG. 5 is a diagram showing a sheet material exit section for the hood, FIG. 6 is a longitudinal section view showing a rotor, and FIG. 7 is a view on Z—Z of FIG. 6.

Figure 2:
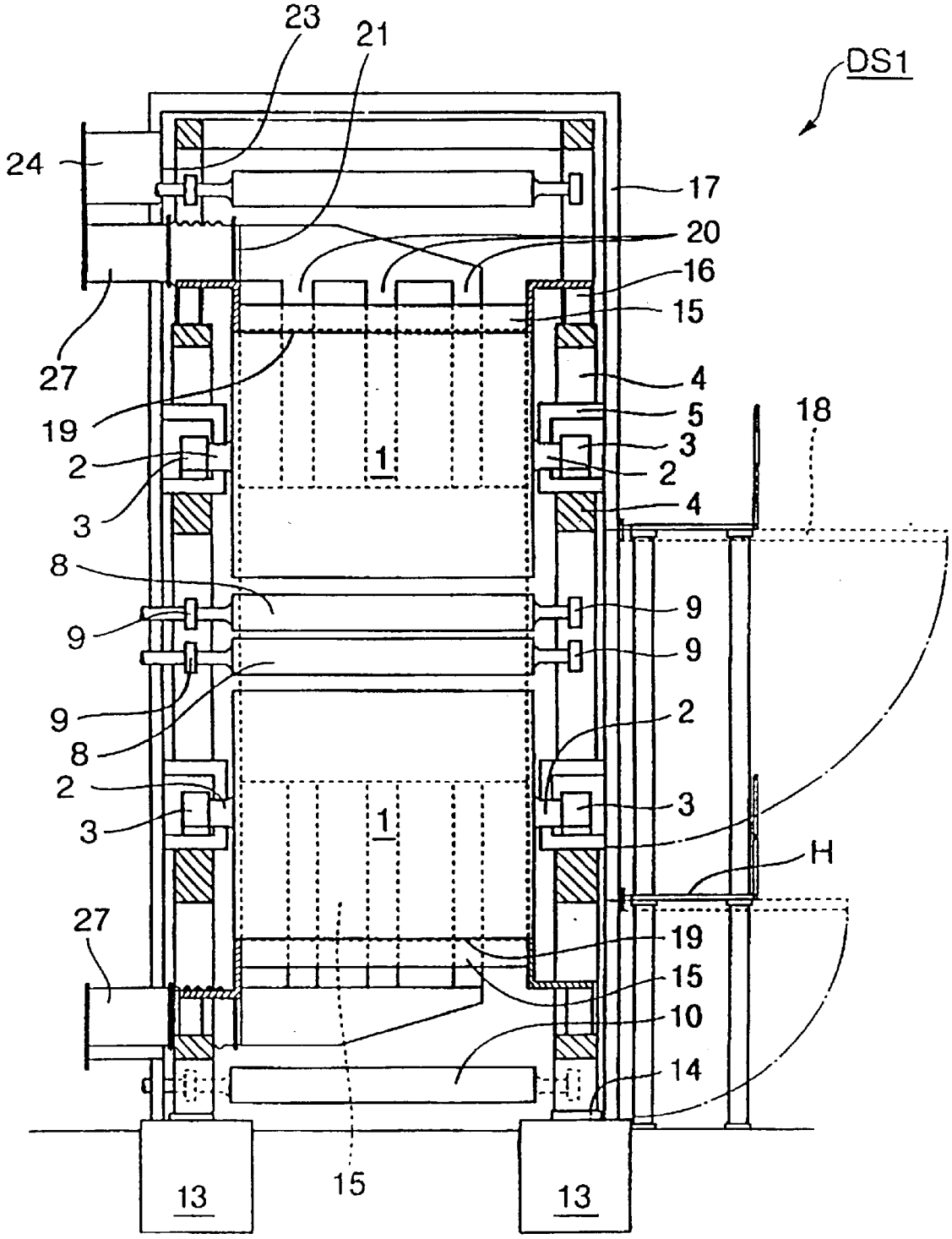
FIG. 2 is a cross-sectional side elevation of FIG. 1.
Figure 3:
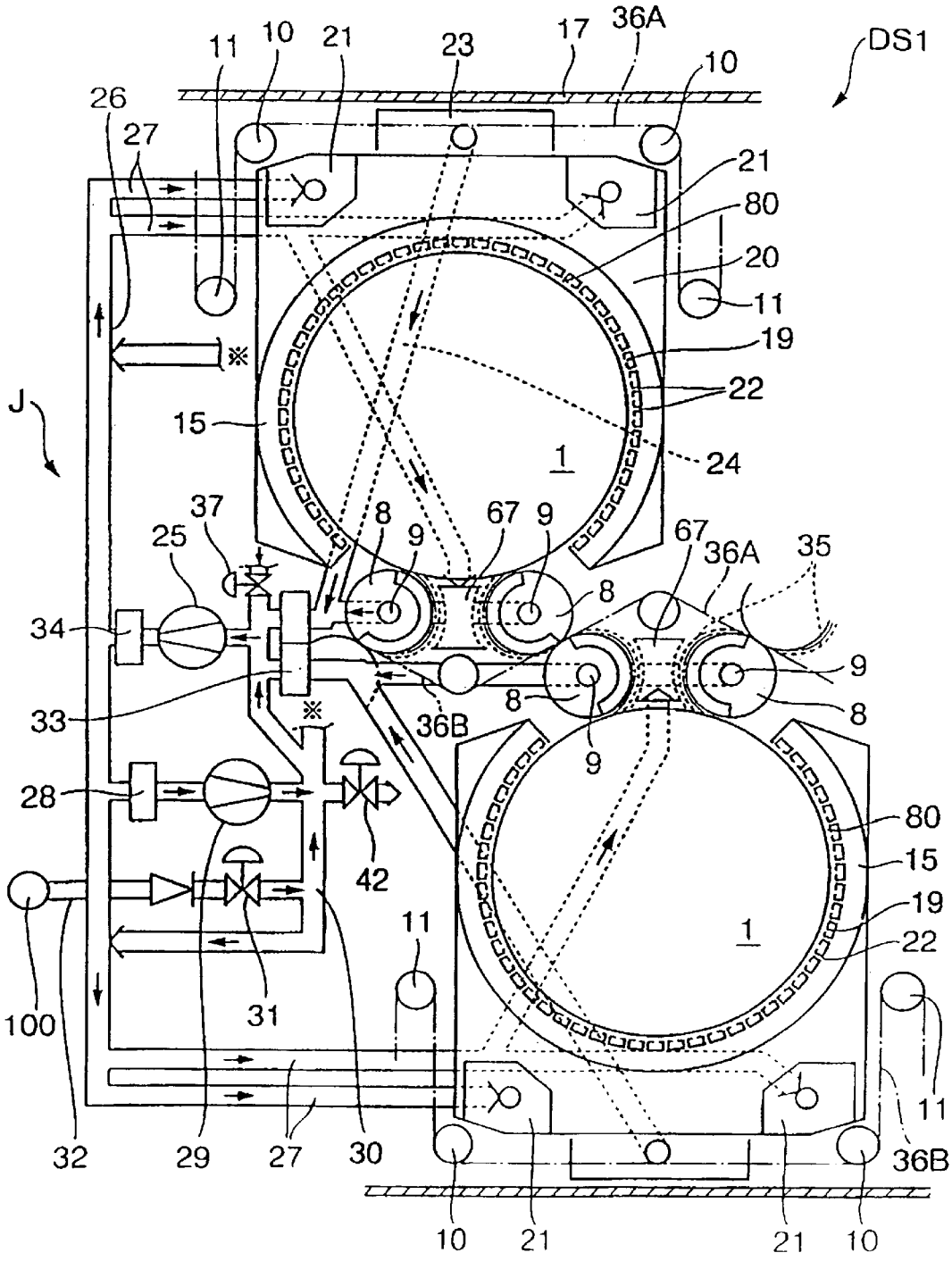
FIG. 3 is a flow diagram showing a circulation system for heated gas in the first embodiment of the drying apparatus of the present invention.

According to the drying apparatus DS1 shown in FIG. 1, FIG. 2 and FIG. 3, a drying apparatus for drying the sheet material (paper) in a wet condition comprises; a plurality of multi-cylinder type rotors (rotation cylinders) 1 for supporting one face of the sheet material 35 while rotating, a fabric belt 36 which is contacted with the other face of the sheet material 35 and clamps the sheet material 35 against the rotor 1 and moves in synchronous with the rotation of the rotor 1, gas blowing ports (heating gas supply section) 19 for blowing out heating gas towards the fabric belt 36 which clamps the sheet material 35, from an outer peripheral direction of the rotor 1, and suction ports 22. The rotor 1 and the fabric belt 32 which clamp the sheet material 35, are provided inside the sealed hood 17. The fabric belt 36 is of an endless construction formed in a loop. In the first embodiment, a pocket section space between the rotors 1 is used to the maximum, and performs vertical delivery of the fabric belt 36 and the sheet material 35 between each of the pairs of suction fabric belt rolls 8.

The drying apparatus DS1 comprises individual machine foundations 13 in the paper machine building, sole plates 14 secured to the machine foundations 13 with anchor bolts, and a dryer frame 4 assembled on the sole plates 14. The rotor 1 is provided on the inside of the dryer frame 4. The rotor 1 supports the sheet material 35 on the surface (cylinder face) thereof. A rotation shaft (cylinder shaft) 2 is provided on the rotor 1, and is rotatably supported by rotor bearings (cylinder bearings) 3. The cylinder bearings 3 are installed on the dryer frame 4. In this embodiment, the rotors 1 are provided in a plurality of numbers as shown in FIG. 1, being arranged in staggered form in upper and lower two rows. Arranging the plurality of rotors 1 in upper and lower two row staggered form is advantageous in enabling effective use of the factory space. Moreover, the arrangement construction for the rotors 1 may be a single row type with each separate group arranged so that the sheet material 35 is directed upward and downward alternately so as not to curl, or these may be exclusively arranged in a downward directed arrangement so as to consider the discharge of paper at the time of paper break, or these may be arranged vertically and dividing some rows of rotors 1 rotating left and some other rows of rotors rotating right respectively, or these arrangements can also be mixed.

Among a plurality of rotors 1 provided in upper and lower two rows, the upper row rotors 1 are provide with canopy hoods 15 arranged on the upper side from the center of the rotation shaft 2 connected to the upper row rotor 1 are respectively provided. The canopy hoods 15 are supported on the dryer frame 4 so as to be moveable up and down by a lifting device 16 (refer to FIG. 2). Similarly, rotors 1 arranged in the lower row are provide with canopy hoods 15 on the lower side from the center of the rotation shaft 2 connected to the lower row rotor 1 are respectively provided. The lower side canopy hoods 15 are each supported on the dryer frame 4 so as to be moveable up and down by the lifting device 16. The canopy hoods 15 are made from heat insulating panels.

As mentioned above, the rotors 1 are provided in a plurality of numbers, and the plurality of rotors 1 are respectively arranged in upper and lower two rows. Furthermore, the sheet material 35 is supported on the plurality of rotors 1 while being propelled from an entry section 60 side to an exit section 61 side as shown in FIG. 1. Moreover, as shown in FIG. 1, the fabric belt 36 comprises an upper row side fabric belt 36A provided so as to clamp the sheet material 35 which is supported on the upper row side rotor 1, and a lower row side fabric belt 36B provided so as to clamp the sheet material 35 which is supported on the lower row side rotor 1. These upper row side and lower row side fabric belts 36A and 36B each have an endless construction in the form of a loop.

A suction fabric belt rolls 8 are provided at a position close to the rotor 1. These suction fabric belt rolls 8 are rotatably supported by fabric belt roll bearings 9. The fabric belt roll bearings 9 are installed on the dryer frame 4. Here, two suction fabric belt rolls 8 are arranged for one rotor 1. The suction fabric belt roll 8 supports the fabric belt 36.

The respective upper row side and lower row side fabric belts 36A and 36B transfer the sheet material 35 on the upper row side to the lower row side with the suction fabric belt rolls 8 provided between the upper row side and lower row side rotors 1 as a detour point. The sheet material 35 moves along while being alternately clamped between the upper and lower row rotors 1 and the upper and lower row fabric belt 36.

Fabric belt rolls 10 are respectively provided at the corner portions inside the hood 17, and at predetermined positions with respect to the fabric belt rolls 10 there are provided fabric belt tension rolls 11. Furthermore, by means of these fabric belt rolls 10, fabric belt tension rolls 11, and suction fabric belt rolls 8, the fabric belt 36 having an endless construction in the shape of a loop is supported so as to be able to go around the perimeter inside the completely sealed hood 17. The fabric belt 36 has permeability and is supported so as to clamp the sheet material 35 against the rotors 1.

The fabric belt 36 is made from a heat resistant material having permeability of 7, 500 CCM ($cm^3/cm^2/min$), that is 12, 500 $m^3/m^2/hr$ or above. For example, the fabric belt 36 is made from PEEK (polyether ether ketone) or PPS (polyphenylene sulfide) or the like.

The overall drying part containing the upper row and lower row canopy hoods 15, rotors 1, fabric belt 36, suction fabric belt roll 8, and dryer rolls 4, is contained within the hood 17 comprising heat resistant heat insulation panels of a thickness of 100 mm or more. The interior of the hood 17 is provided with a gas environment of 130° C. or more. Here, between the blower ports 19, the suction ports 22 and the surface of the rotor 1 inside the canopy hood 15 constitutes an evaporation space 80 (refer to FIG. 3) separated by a distance of around 10 to 25 mm. The construction is such that the outer peripheral portion of the rotor 1 and the fabric belt 36 which clamp the sheet material 35 are positioned on the inside of the evaporation space 80. Since a part of the hood 17 is opened or closed for performing inspection/cleaning and the like, an electrically or pneumatically operated hood opening device 18 is provided which can clamp the hood 17 via seal packings against mutually stepped contact faces, to effect complete sealing of the hood 17.

The rotor 1 smoothly contacts with the sheet material 35 at the rotation surface, whose the surface has been smoothly finished. At the position inside the evaporation space 80 of the hood 17 facing the sheet material 35, there is provided gas blower ports (heating gas supply section) 19 for blowing heating gas from the outer peripheral direction to the rotor 1 towards the fabric belt 36 which clamps the sheet material 35 against the rotor 1. These blower ports 19 are multiply provided at predetermined spacing around the outer circumference of the rotor 1, parallel with the axis of the rotor 1 separated by a space of approximately 10–25 mm to the surface of the rotor 1, and in the axial direction of the rotor 1, and are preferably round holes or angled holes in the bell-mouth shape by cross-section or made by slits. The blower ports 19 are set to an overall numerical aperture of 1–3% from economics of blower power consumption and drying rate, with respect to the length of the approximate overall width of the rotor. Furthermore, regarding the hole form, since linear marks are easily formed on the sheet material 36 at the time of impingement, through the fabric belt 36, these holes are provided in a staggered arrangement such that the jet points do not overlap while the sheet is travelling.

The blower ports 19 are formed by a plurality of slender box shape members in cross-section provided in a radial manner with respect to the rotation shaft 2, and provided at a position facing the rotor 1 and parallel to the rotation shaft 2. Furthermore, gas suction ports (gas discharge ports, gas discharge sections) 22 are provided between respective slender box shape members for drawing the gas inside the evaporation space 80 (hood 17) and discharging to outside of the hood 17. The gas suction ports 22 are arranged with a predetermined gap in the outer peripheral direction of the rotor 1, and are preferably formed in a slit with a bell-mouth shape cross-section. Moreover, the blower ports 19 can be formed into a irregularly shaped pipe having round holes when the blower ports are formed into a semi-arc shaped slit without forming suction holes. That is, the blower ports 19 for blowing gas to the rotor 1, and the suction ports 22 for drawing out the gas, are alternately arranged in a radial and parallel manner to the rotation shaft 2. Here, the suction ports 22 are set with an aperture of around 5% with respect to the overall length of the approximate cylinder overall width.

To the blower ports 19 are connected air supply boxes (heating gas supply section) 20 which are connected to a plurality of annular box shape air supply box connection ducts 21. The air supply boxes 20, as shown in FIG. 2 are provided as an array in an annular form at right angles with respect to the cylinder shaft 2, leaving a space for maintaining a sufficient suction space. In addition, the canopy hood 15 is connected as a reinforcing structure for the air supply boxes 20. When the paper machine is small for making narrow width paper, the blower ports 19 may be omitted, and may be formed integrally with the canopy hood 15, which is provided with a plurality of round holes or slit openings provided on the inner peripheral face facing the rotor 1. In that case the gas suction ports 22 may be provided for example as pipes which pierce the inner and outer peripheral surface of the canopy hood 15.

Air supply ducts 27 which pass through the hood 17 via a flexible joint are connected to the supply box connecting ducts 21. Furthermore, a pocket air supply box (pocket section) 67 (refer to FIG. 1 and FIG. 3), which is connected to the air supply duct 27 via a flexible joint, is arranged in a space between each two suction fabric belt rolls 8 at the position facing the canopy hoods 15 intervening the rotors 1. Furthermore, a suction duct 24, which passes through the hood 17, is connected to the suction box (gas discharge section) 23, which is connected to the suction ports 22.

Brush seals made of a heat resistance material such as carbon fiber are detacheably provided in the inner wall of the hood 17, in which the various rotors (cylinders) including the rotor 1 and the suction fabric belt roll 8 pass through and contact, for restricting movement of gas between the inside and outside of the hood 17. These brush seals are preferably provided with a brush seal structure which has a length corresponding to a water height of the condensation drain corresponding to the internal pressure of the hood 17. If the length is insufficient, the gas may gradually leak out to the outside under the differential pressure. The brush seals have a function such that the water vapor inside the hood 17, when leaks, condenses to drain and the drain fills the inside the brush seals, so that it is possible to prevent external air from entering inside of the hood 17, and to prevent a large quantities of internal steam from going out from the hood 17.

As shown in FIG. 1, the entry section 60 for introducing the wet sheet material 35 to inside of the hood 17 from outside, is provided in one portion (the right side in FIG. 1) of the hood 17. On the other hand, the exit section 61 for leading out the sheet material 35 to outside from inside the hood 17 is provided on the opposite side of the hood 17 to the entry section 60. The hood 17 is completely sealed except for the entry section 60 and the exit section 61.

As shown in FIG. 4 and FIG. 5, at least two and preferably four sealing pinch rolls 38 which are made slightly wider than the sheet material 35, are provided at the outside of the entry section 60 and the exit section 61 so as to clamp both side of the sheet material. The sealing pinch rolls 38 provided on the outside of the hood 17 are able to apply a linear load of more than 5 kg/cm width. Furthermore, at the respective hood 17 sides of the sealing pinch rolls 38 of the entry section 60 and the sealing pinch rolls 38 of the exit section 61, two pairs of pinch roll sealing devices (seal sections) 44 are provided having a cross-sectional shape of two approximately symmetrical arcs.

One end of the pinch roll seal device 44 is secured to a sealing frame 45 connected to the outside wall face of the hood 17. On the other hand, the other end of the pinch roll seal device 44 is in contact with the sealing pinch roll 38 via a brush seal 46. The brush seal 46 is constructed by a heat resistance base, which is implanted with heat resistance fiber brushes of 1 mm diameter or less, and can be easily replaced when worn out. Examples of the brush material includes heat resistant nylon, tetron, carbon and the like.

As shown in FIG. 4, a steam box 43 is provided at the entry section 60 of the hood 17, and a paper feeding heat resistant sealing blanket (inlet belt) 39 having a suction box 40 is provided at a position facing the steam box 43. The paper feed sealing blanket 39 is constituted as an endless structure in the form of a loop, and is supported by a plurality of rolls 39*a* to 39*c*, and is able to be driven at an appropriate tension by a tension device, a guide device and a drive device (not shown). Among these devices, the tension roll 39*a* and the guide roll 39*b* are provided on the outside of the hood 17, while the roll 39*c* is provided on the inside of the hood 17. Furthermore, the sealing blanket 39 is driven so as to span between the inside and the outside of the hood 17 via an opening section provided in one part of the sealing frame 45 and the hood 17.

On the other hand, as shown in FIG. 5, a steam box 43 is also provided at the exit section 61 of the hood 17, and a paper delivery sealing blanket (outlet belt) 41 having a suction box 40 is provided at a position corresponding to this steam box 43. The paper delivery sealing blanket 41 is also in the endless structure in the form of a loop, and is supported by a plurality of rolls 41*a* to 41*c*, and is able to be driven at an appropriate tension by a tension device, a guide device and a drive device (not shown in the figure). Among these devices, the tension roll 41*a* and the guide roll 41*b* are provided on the outside of the hood 17, while the roll 41*c* is provided on the inside of the hood 17. Furthermore, the sealing blanket 41 is driven so as to span between the inside and the outside of the hood 17 via an opening section provided in one part of the sealing frame 45 and the hood 17.

As shown in FIG. 4, at the entry section 60 of the hood 17 there is provided a heat resistant inlet fabric belt (inlet belt) 12 provided so as to face the paper feeding sealing blanket 39, and so as to clamp the sheet material 35 against the paper feeding sealing blanket (inlet belt) 39. The inlet fabric belt 12 is of an endless construction formed in a loop, and is supported by a plurality of rolls 12*a* to 12*e* and is able to be driven at an appropriate tension by a drive unit (not shown). Among these devices, the roll 12*d* is provided inside the hood 17, while the others are provided outside of the hood 17. Furthermore, the inlet fabric belt 12 is driven so as to span between the inside and the outside of the hood 17 via an opening section provided in one part of the sealing frame 45 and the hood 17.

On the other hand, as shown in FIG. 5, at the exit section 61 of the hood 17 there is provided an outlet fabric belt (outlet belt) 12 provided so as to face the paper delivery sealing blanket 41, and so as to clamp the sheet material 35 against the paper delivery sealing blankets 41 (outlet belt). The outlet fabric belt 12 is constructed as an endless structure formed in a loop, and is supported by a plurality of tension rolls 12*a*, guide rolls 12*b*, and rolls 12*c*, 12*d*, and 12*e*, and is able to be driven at an appropriate tension by a tension device, a guide device and a drive device (not shown). Among these devices, the roll 12*d* is provided inside the hood 17, while the others are provided outside of the hood 17. Furthermore, the outlet fabric belt 12 is driven so as to span between the inside and the outside of the hood 17 via an opening section provided in one part of the sealing frame 45 and the hood 17.

Furthermore, the sealing blankets 39 and 41 arranged so as to span between the inside and the outside of the hood 17, and the outlet and inlet fabric belt 12 arranged so as to span between the inside and the outside of the hood 17, are driven while clamping the sheet material 35 therebetween, so that paper feeding with respect to the hood 17 is easily performed. Furthermore, the sealing blankets 39 and 41, the fabric belt 12, the pinch roll seal devices 44, the brush seals 46, the sealing pinch rolls 38 and so forth, constitute a seal section (seal mechanism, air intercepting device) for restricting the movement of gas between the inside and the outside of the hood 17 in the entry section 60 and the exit section 61.

Materials having voids (net, slits, round holes or the like) enabling suction are used for forming these belts. Since, when the outlet and inlet fabric belt 12 and the sealing blanket 39 go in and go out of the super-heated steam environment of the hood 17, bring air from the outside, it is preferable to make these fabric belt 12 and the sealing blanket by a solid material except for small voids such that the pressure can be applied at the time of steam injection, in order to ensure good sheet separation. In the examples shown in FIG. 4 and FIG. 5, two upper and lower pairs of sealing blanket 39 and the heat resistant outlet and inlet fabric belt 12 are used as a measure to prevent the paper sheet from being sheared. Sealing frames 45 having respective spaces at the center thereof for passing the sheet and also having brush sealing structures are provided at external positions of the inlet and outlet portions of the hood 17 for returning the fabric belts while sealing the sealing blanket 39 and the outlet and inlet fabric belt 12. In the case when using high strength sheet material (excluding thin material) and when permitting a small amount of air ingress, it is possible to remove the sealing blanket for feeding and delivery the paper may be excluded, and it is possible to provide a drying endless fabric belt 36 which drives so as to span around the outside and inside of the hood 17, which results in simplifying the structure of the inlet and outlet sections.

Here, the operation of introducing the sheet material 35 into the hood 17 will be described with reference to FIGS. 4 and 5. At first, moistened sheet material 35 is laid on the outlet and inlet fabric belt 12 while preventing the ingress of air by the paper roll or the like. Then, the sheet material 35 is introduced into the hood 17 through the communicating section of the insulating panel, being the outer wall of the sealed hood 17 which is completely shut off from the outside by means of the sealing pinch rollers 38. When passing through the inside of hood 17, while the residual air of the sheet material 35 is removed by injecting steam onto the sheet material from the steam box 43, the sheet material 35 is absorbed by the sealing blanket 39 by the suction box 40. However due to contact with the low temperature sheet 35, the injection steam is rapidly, condensed and loses latent heat to thereby quickly raise the sheet temperature, and the sheet material is sucked out by the suction fabric belt roll 8 through the endless fabric belt 36 made from a high permeability heat resistant material and the sheet material 35 is dried while in contact with the rotor 1.

Figure 16:
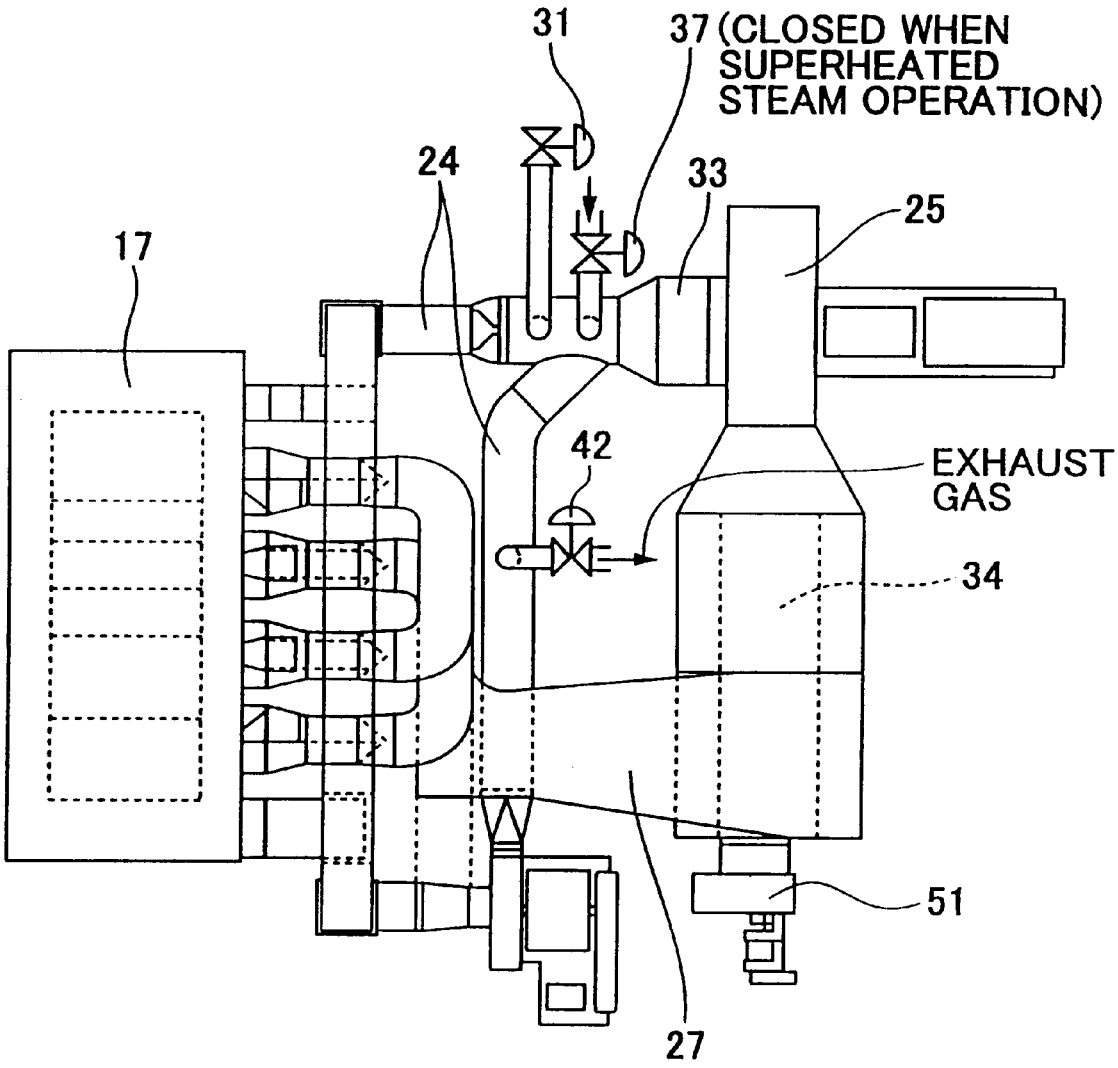
FIG. 16 is an overall plan view, including an external combustion type circulating gas heat exchanger of the drying apparatus of the present invention.
Figure 17:
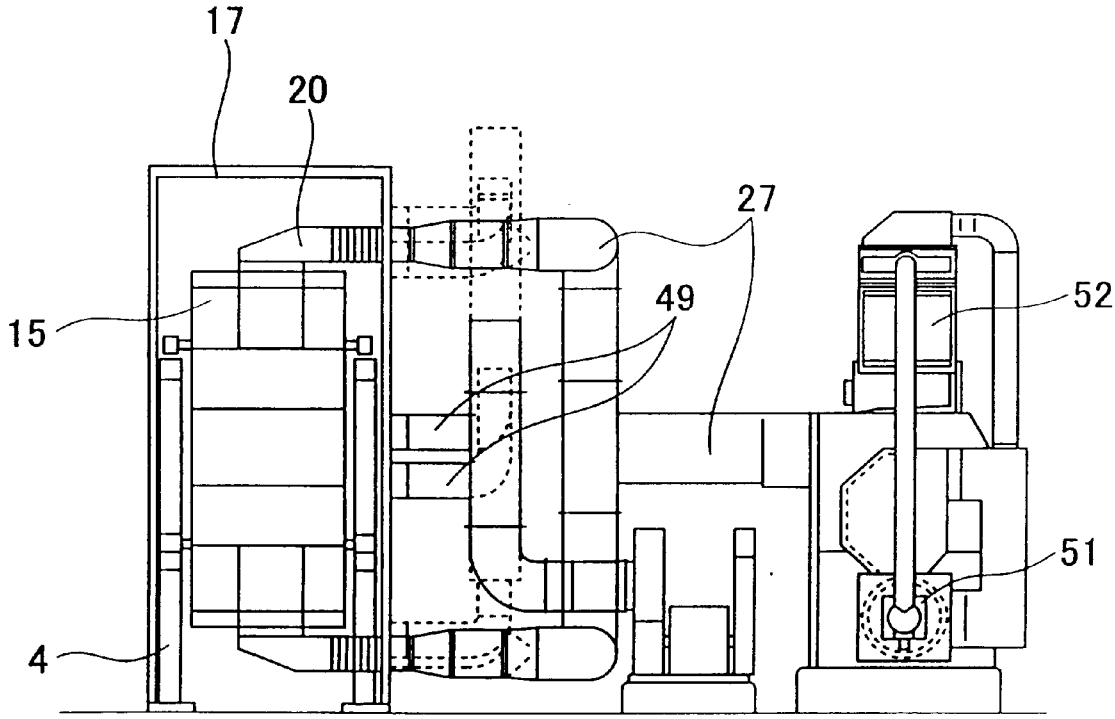
FIG. 17 is an overall plan view, including an external combustion type circulating gas heat exchanger of the drying apparatus of the present invention.

As shown in FIG. 3, the drying apparatus DS1 incorporates a gas circulation heating system (gas circulating heating device) J, provided at the outside of the hood 17. The gas circulation heating system treats the discharge gas from the hood 17 through the gas discharge sections 22 and 23, and supplies the treated gas again into the hood 17. The gas circulation heating system J, as shown in FIGS. 3, 16, and 17 is provided preferably on the driving side of the rotors 1, and provided with an discharge screen 33 for removing foreign matter such as mist, paper dust and the like in the discharge gas, an discharge heater 34 using a combustion gas or a high temperature discharge gas from a hydrogen gas turbine which uses heating medium, for example, hydrogen gas fuel and oxygen, a gas circulation fan 25, an adiabatic expansion nozzle 26, a gas supply ducts 27, a gas scrubber (steam scrubber) 28, a gas compressor (steam compressor) 29, a pressurized steam pipe 30, a steam governor valve 31, a make-up steam pipe 32, an air supply damper or valve 37, and an discharge control damper or valve 42. These are respectively connected to the suction duct 24, the air supply box communicating ducts 21 and a steam header 100, so that heating gas comprising mainly super-heated steam is circulated.

Next, a description of the rotor 1 is provided which is the characteristic part of the present invention, with reference to FIGS. 6 and 7. FIG. 6 is a longitudinal cross-sectional view of the rotor 1, and FIG. 7 is a view along the arrow Z—Z in FIG. 6. The rotor (rotating cylinder) 1 has a rotation shaft 2 having rotor bearings 3, rotor segments 7 attached in approximately even spacing to the outer periphery of the rotor shaft 2, a rotor shell 1' connected to the outside of the rotor segments 7, and which can be divided in the cross direction of the rotor 1, and rotor reinforcing ribs 6 connected at approximately even spacing to the inner peripheral face of the rotor shell 1'. Furthermore, a reinforcing socket 2*a* is provided around the rotor shaft 2. The rotor 1 is made of remarkably light materials such as metals consisting of SS and SUS or the heat resisting synthetic resin, when compared to the conventional cylinder made of a strong cast steel for second-kind pressure vessels for heating the inside by a medium or low pressure steam. The rotor 1 is is formed into a smooth surface rotor by covering, for example, with a heat resistant plastic film or a tefron (a trade name) film the same heat resistant plastic rotor body, or a rotor body made of fiber reinforced plastics incorporating glass fiber, aramid fiber or carbon fiber to the heat resistant plastic body. As a result, it becomes possible to prevent the wet sheet material 35 from adhering to the rotor due to a rapid temperature increase of the wet sheet 35 by the condensation heat transfer from the steam shower at the entry section 60 of the hood. In addition, since the occurrence of paper break due to the adherence of the wet sheet to the rotor can be eliminated, it becomes possible to increase the drying speed in the paper machines far higher in the future. Furthermore, since the rotor 1 is formed to be able to divided into segments, it is possible to cope with limitations and problems of transporting large rotors when constructing a paper machine for broadened paper.

When the rotor 1 is assembled, at first the rotor reinforcing ribs 6 and the rotor segments 7 are connected to each other to give an integrated construction, and secured for example by reamer bolts. The assembly is then subjected to necessary pre-processing such as dynamic balancing at the manufacturing factory of the rotors. After then, the parts are disassembled and transported to the construction site, and on arrival at the construction site after completing assembly, the rotor shells 1' are attached to the surface and smoothly finished. If there are no problems for the transportation, the rotors may be completed at the manufacturing factory without disassembly and assembly. Furthermore, end plates may be fitted to the two shaft side faces of the rotor 1.

In this manner, differing from the drying the wet sheet material by use of the wet sheet material using the conventional second-kind pressure vessel where the interior of the pressure vessels are heated by low to medium pressure steam to heat the drying cylinder to a high temperature, since the present invention adopt a method of drying the sheet material by heating from the outside thereof using the heat transfer and thermal radiation from the recycled and reheated gas of above 150° C., the rotor 1 can be made of a light construction as mentioned above, rather than being made strong by for example cast steel as in the conventional case.

Moreover, when the present method is applied to an internal heating type cylinder dryer using an existing or used second-kind pressure vessel, it becomes very dangerous because the temperature of the steam supplied to the inside of the pressure vessel is adversely raised by the external heating gas and the inside pressure of the vessel rises. Moreover, since a trouble may be caused due to steam hammer because high temperature super-heated steam flows in the drain recovery system, or since a large amount of energy is consumed, it is necessary to stop supply of steam. If wear and tear of, for example, the rotary joint or the siphon etc is considered, then these components must be removed. However, in the case where the drying cylinder side surface is exposed to the outside and is only enclosed by the canopy hood, these matters are irrelevant since the outside heating is only partial and thus insufficient to cause problems.

Next, a description of a method for drying the wet sheet material 35 is provided using the drying apparatus DS1 having the above described construction. Wet sheet material 35 which has been formed into a sheet at a wire part and dehydrated to a water content of 60 to 50% with a press part is led by the inlet fabric belt 12 at the entry section 60 of the hood 17 which is completely sealed by heat insulating panels, and is propelled while clamped against the paper feed sealing blanket 39 by means of upper and lower sealing pinch rolls 38, and is rapidly heated by condensation heat transfer between the steam box 43 and the suction box 40 and the temperature rapidly raised, and is then placed from the suction box 40 on the paper feed sealing blanket 39 side, and introduced into inside of the hood 17.

Here, by means of the gas circulation heating system J, the interior of the hood 17 is maintained at a gas atmosphere of above 130° C. Furthermore, the balance of the supply and discharge amount of gas with respect to the inside of the hood 17 is controlled so that the pressure of the interior of the hood 17 is set at a slightly higher pressure than the hood 17 surroundings.

The sheet material 35 which has been introduced to inside of the hood 17 is attracted and placed by the suction device of the suction fabric belt roll 8, on the lower row side fabric belt 36B which goes around the interior of the hood 17, and is introduced to the entrance of the rotor (rotation cylinder) 1 arranged on the lower row side of the entry section 60. Furthermore, the upper face of the sheet material 35 is closely contacted with the rotor 1, and the lower face of the sheet material 35 is clamped by the lower row side fabric belt 36B and is moved around and propelled in accordance with the rotation of the rotor 1. At this time, the sheet material 35 is pressed by a tension which can restrain dry shrinkage of the sheet material 35, on the rotor 1 by the fabric belt 36 through the fabric belt tension roll 11, so that this can proceed while restraining free shrinkage particularly in the cross direction.

With respect to the sheet material 35 which travels around inside the canopy 15 (that is the evaporation space 80) while being clamped by the rotor 1 and the fabric belt 36, heated gas above 150° C. is blown thereto at a speed of above 50 m/second from the blower ports 19 provided around the outer periphery of the rotor 1. The heated gas from the blower ports 19 is blown to the heat resistant fabric belt 36 of a gas permeability of 7, 500 CCM or more (12500 $m^3/m^2/hr$ or more) and passes through the voids to directly impinge on the sheet material 35 and heat this, so that the water content in the sheet is instantly evaporated (pressure flow) and the paper thus dried.

In this manner, since the sheet material 35 is dried by directly heating water content within the sheet material and by water evaporation due to pressure flow under the restriction by the fabric belt 36, the paper after dried by this drying process becomes porous and bulky and thereby it becomes possible to manufacture sheets with various excellent properties for printing and so on, because the softening point temperature for the lignin or hemicellulose is reduced in the steam atmosphere, so that the physical strength becomes high and dimensional stability becomes good, and the bacillus count is decreased in a large extent by high temperature heat sterilization in the steam atmosphere, and because a paper strength promoting mechanism of a wet paper strength agent and a dry paper strength agent is significantly increased.

On the other hand, the water vapor inside the evaporation space 80 (hood 17) evaporated from the sheet material 35 which travels around in the heated gas atmosphere above 130° C., and which is blown with the super-heated gas at above 150° C., is sucked by the suction ports 22 and the suction fabric belt roll 8 as discharge gas. The absorbed discharge gas is sent to the gas circulation heating system J. The discharge gas is passed through the suction box 23 and the suction duct 24 and foreign matter such as mist, paper dust and the like is removed by the discharge screen 33, and the pressure of the discharge gas is then boosted by the water vapor circulation fan 25. Together with this, the discharge gas is heated by super-heated steam from the adiabatic expansion nozzle 26 at the outlet thereof, and the majority of the boosted discharge gas is passed through the air supply ducts 27 and after passing through the air supply box connection ducts 21 and the air supply boxes 20, is blown onto the sheet material 35 from the blower ports 19 after penetrating through the fabric belt 36. Since there is a limit for heating the circulating gas temperature through the adiabatic expansion nozzle 26, when the circulating gas is further heated to increase the drying speed, the discharge gas may be heated by the discharge gas heater 34 using combustion gas or a heating medium as the heat source. In this case, the adiabatic expansion nozzle 26 is closed.

After heating again by the gas circulation heating system J, the discharge gas from the hood 17 is blown to the sheet material (fabric belt 36) from the blower ports 19. Moreover, when the pocket air supply box 67 is installed, the heated gas at above 150° C. is blown to the fabric belt 36 at a speed higher than 50 m/sec, and the heated gas passes through the voids and directly impinges on and heats the sheet material 35. The discharge gas after impinging the sheet material 35 is absorbed in by the suction fabric belt roll 8 and reheated by the gas circulation heating system J.

The sheet material 35 which has passed through the first rotor 1 (that is, the rotor 1 at the lower row close to the entry section 60) is sucked at the exit by the suction fabric belt roll 8 and detached from this first rotor 1. The sheet material 35 which has been detached from the first rotor 1 is again clamped by the upper row fabric belt 36A and the lower row fabric belt 36B, and sucked to the upper side by the upper row suction fabric belt roll 8 and taken over the upper row fabric belt 36A, and guided to enter onto the second rotor 1 (that is the rotor 1 of the upper row on the entry section 60) arranged in the upper row. The sheet material 35 which has been guided to enter the rotor 1 arranged on the upper row of the entry section 60 is supported with one face of the sheet material 35 in close contact with the rotor 1 (in this case the lower face), and the other face of the sheet material 35 (in this case the upper face) is closely contacted with the upper row fabric belt 36A. The sheet material 35 is moved around and propelled with the rotation of the rotor 1 and the moving around of the fabric belt 36. The sheet material 35 is strongly pressed to the rotor 1 by the fabric belt 36 via the fabric belt tension rolls 11, and is propelled while being restrained. At this time, when the sheet material 35 is pressed and restrained, the fabric belt tension rolls 11 ensure clamping with a tension by which the extension or contraction of the sheet material 35 can be restrained.

The heating gas at above 150° C. is blown from the blower ports 19 at a speed of above 50 m/sec. onto the sheet material 35 which travels around inside the canopy hood 15 (that is, the evaporation space 80) while being clamped by the rotor 1 and the fabric belt 36. On the other hand, the gas inside the evaporation space 80 (hood 17) is sucked from the suction ports 22, and the sucked gas is sent to the gas circulation heating system J as discharge gas.

Hereinafter, drying similar to the aforementioned is repeatedly performed for each of the plurality of rotors 1. The sheet material 35 which has traveled between the plurality of rotors 1 and passed through the last rotor 1 is guided to the exit section 61, the heated gas from the suction zone of the suction fabric belt roll 8 is reverse flow injected, and the sheet 35 is passed to the paper delivery sealing blanket 41 and clamped between the outlet fabric belt 12 and thereby propelled. Furthermore, the sheet material is clamped by the sealing pinch rolls 38 and carried out to the outside from the exit section 61 of the hood 17.

As described above, by blowing the heating gas towards the fabric belt 36 in the radial direction from the outside of the rotor 1 (rotation cylinder) which supports the sheet material 35, the present invention can efficiently dry the wet sheet material 35 primarily by external heating. At this time, by blowing the heating gas while clamping the sheet material 35 between the rotor 1 and the permeable fabric belt 36, extension and contraction of the sheet material 35 is suppressed and paper breaks can be eliminated, and due to the rapid direct moisture evaporation with the impingement drying by the heating gas of above 150° C. comprising mainly super-heated steam, excellent sheets can be manufactured provided with an excellent printing property high strength, and bulky and porous properties.

A part of the water vapor which has been boosted by the gas circulation fan 25, after removing the mist or foreign matter or non condensing gas by the gas scrubber 28, is adiabatically compressed by the gas compressor 29 and thus pressurized and heated, and then passed through the pressurized steam pipe 30 and the discharge control damper or valve 42.

This surplus pressurized water vapor can be supplied to the other process and can be used therein described below when superheated steam is used the equivalent volume weight with the water vapor brought from the wet part of the paper machine, and when heated moist air is used, the equivalent volume weight with the sum of the water vapor brought from the wet sheet and from the wet part of the replenished fresh air, which is supplied to keep the condition of a dried air weight the same as before and after gas circulation.

At the time of starting, the aforementioned steam, after passing through the adiabatic expansion nozzle 26, can be used for heating the gas of the recirculation system. Furthermore, in order to shorten the paper making machine start up time, although it is possible to use low pressure water vapor from the make-up steam pipe 32, the flow rates of each steam lines may be adjusted by the steam control valve 31 for automatically controlling the oxygen concentration. Moreover, in order to control the non-uniformity of the water content in the cross direction of the sheet material 35, the blower ports 19 in the canopy hoods 15 may be divided into segments in the cross direction such that the amount of blown gas can also be controlled.

In addition, the degree of the curl or the difference of the smoothness in the front and back surfaces of the sheet material 35 can be appropriately adjusted by providing control valves in respective suction zones of the suction fabric belt roll 8 and by selectively opening and closing the control valves and also by selecting the upper or lower rotors 1 for passing through the sheet material.

Among various discharge gasses, the excess gas at above 130° C. which contains the water vapor evaporated from the sheet material 35 can be reused as a heat source for another apparatus. In that application, the discharge gas is compressed by the gas compressor 29, stored as saturated water in a steam accumulator, and supplied as low pressure steam to meet peak demand from another process.

As the heated gas which is blown from the blower ports 19, super-heated steam of above 150° C. which has been reheated by circulating in the gas circulation heating system J is used. Since the super-heated steam of above 130° C. contains approximately the same amount as the water vapor content, which is brought into the hood 17 by the wet sheet material 35, so that the water vapor in the hood 17 becomes excess. The excess water content is discharged to outside of the hood 17 by the discharge gas control damper or valve 42 of the gas discharge section of the gas circulation heating system J, and is effectively used as a super-heated steam source in another process. Moreover, depending on usage, the excess water vapor may be supplied after re-heating by the discharge gas heater 34 together with the other circulating gas. That is, as shown in detail in a later described paragraph, the sensible heat of the excessive steam corresponds to 83.9% of the generation heat of the fuel for boiler, and the actual generated heat of the boiler fuel corresponds to the energy of $66.3\times10^3$ KJ/BD ton of paper. When compared to a consumed heat of $5{,}236.8\times10^3$ KJ/BD ton of paper of the conventional high pressure drying cylinder drying method, the heat of this new drying method requires only about 12.7% of the conventional method, which results in achieving remarkable energy saving. That is, when the conventional pressurized vessel method using a plurality of drying cylinders is used, a total of 81.5%, in which 73.6% corresponds to the sensible heat for discharge gas from the hood and 7.9% corresponds to the sensible heat for drain was wasted, and the waste heat can be effectively utilized when the new method of the present invention is adopted.

Furthermore, as the heated gas which is blown from the blower ports 19, heated moist air having a dry-bulb temperature of at least 150° C. and a dew point temperature of at least 65° C., obtained by re-heating the circulating gas in the gas circulating and heating system J can be used. Since the high temperature high humidity air with a dry bulb temperature of above 130° C. which contains steam approximately corresponding to the sum of the water vapor mass brought into the hood 17 by the wet sheet material 35 and the water vapor mass brought in by the other routes becomes excess, this excess gas is discharged to outside the hood 17 by the discharge control damper or valve 42 of the gas discharge section of the gas circulation heating system J, and low humidity outside air of approximately the same amount as the dried air for compensating the reduced mass is supplied into the hood 17 by the air supply damper or valve 37. Furthermore, while it is not possible to utilize the discharged gas by 100%, if the absolute humidity of the discharged gas can be raised to above 1 kg/kg' DA, the discharge gas can be used to the other purpose, for recovering energy of the discharge gas.

Moreover, as the heated gas which is blown from the blower ports 19, a mixed gas mixed of a nitrogen gas of not less than 80%, steam of about 5%, a solvent gas and oxygen at a dry bulb temperature of at least 150° C., which has been reheated by the circulating gas in the gas circulating and heating system J can be used. Since the mixed gas at a dry bulb temperature of at least 130° C. corresponding approximately to the steam and solvent gas brought into the hood 17 by the wet sheet material 35 becomes a excess, this is discharged to outside the hood 17 by the discharge gas control damper or valve 42 of the gas discharge section of the gas circulation heating system J, and by condensation separating from the steam the solvent, which has recently become a problem as a source of pollution, can be very efficiently removed, and drying can be safely performed without a fear to experience explosions due to the solvent.

Selection of the canopy hood 15 at which section in the drying sections of the paper machine and at which location, is multifarious depending on the kind of paper to be formed, and objects of the drying method of the present invention are determined by the following features; (1) space reduction of the drying parts due to the affect of speeding up the drying speed, (2) formation of the porous sheet material at the early stage of drying, (3) reducing the live bacillus count by having a high temperature in the initial drying, (4) increasing the physical strength by having a high temperature at the beginning and intermediate drying; (5) increasing the effect of sizing agent or the paper strength promoter or the like by having a high temperature at the end of drying, (6) producing paper of an even better aspect ratio by reducing the shrinkage amount in the cross direction of the paper machine by considerably shortening the drying time, (7) adjusting the curl amount in the final drying, and (8) adjusting the stratification dryness in a combination paper machine.

Second Embodiment

Figure 8:
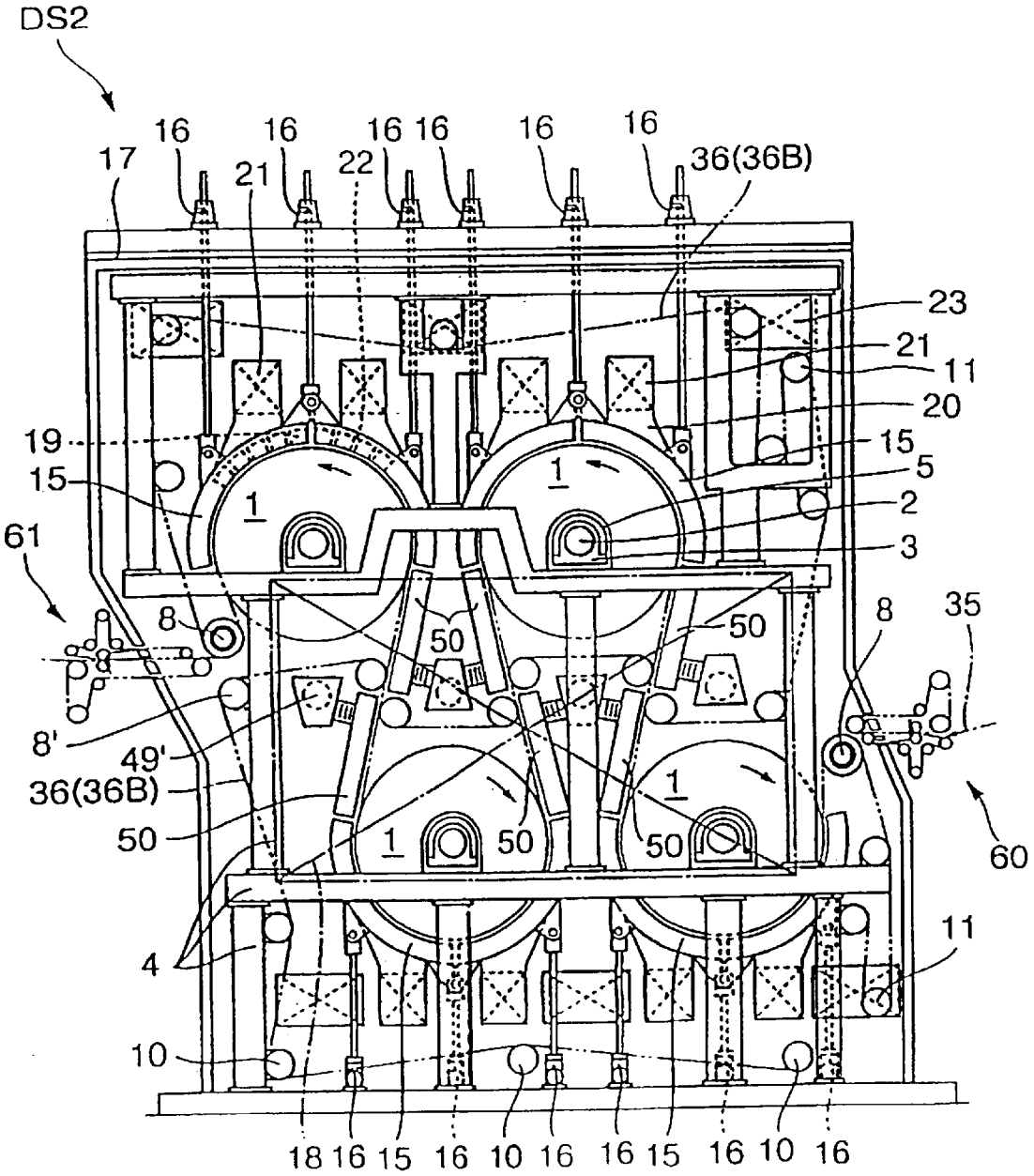
FIG. 8 is a side cross-sectional view showing a second embodiment of the drying apparatus of the present invention.
Figure 9:
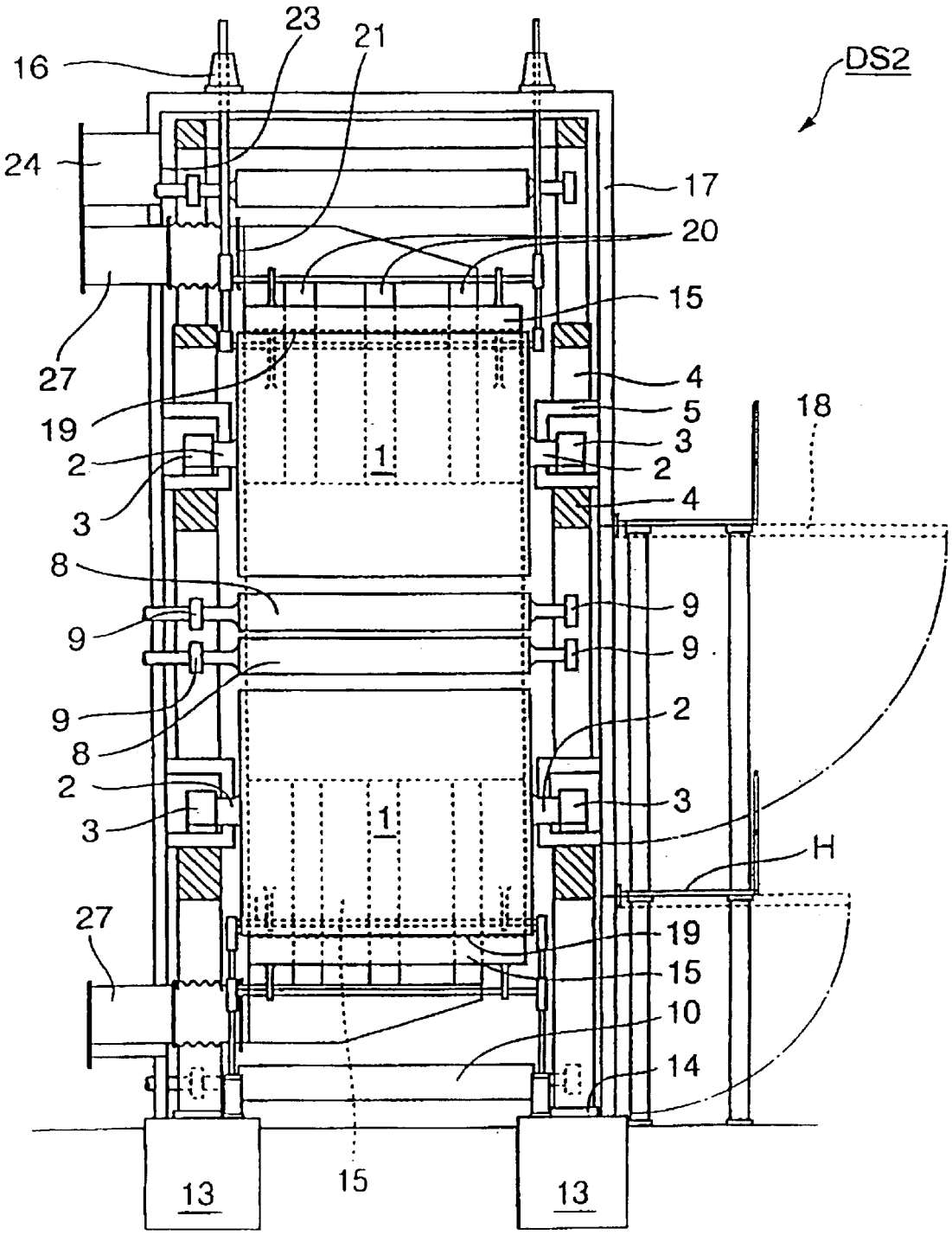
FIG. 9 is a cross-sectional side view of FIG. 8.
Figure 10:
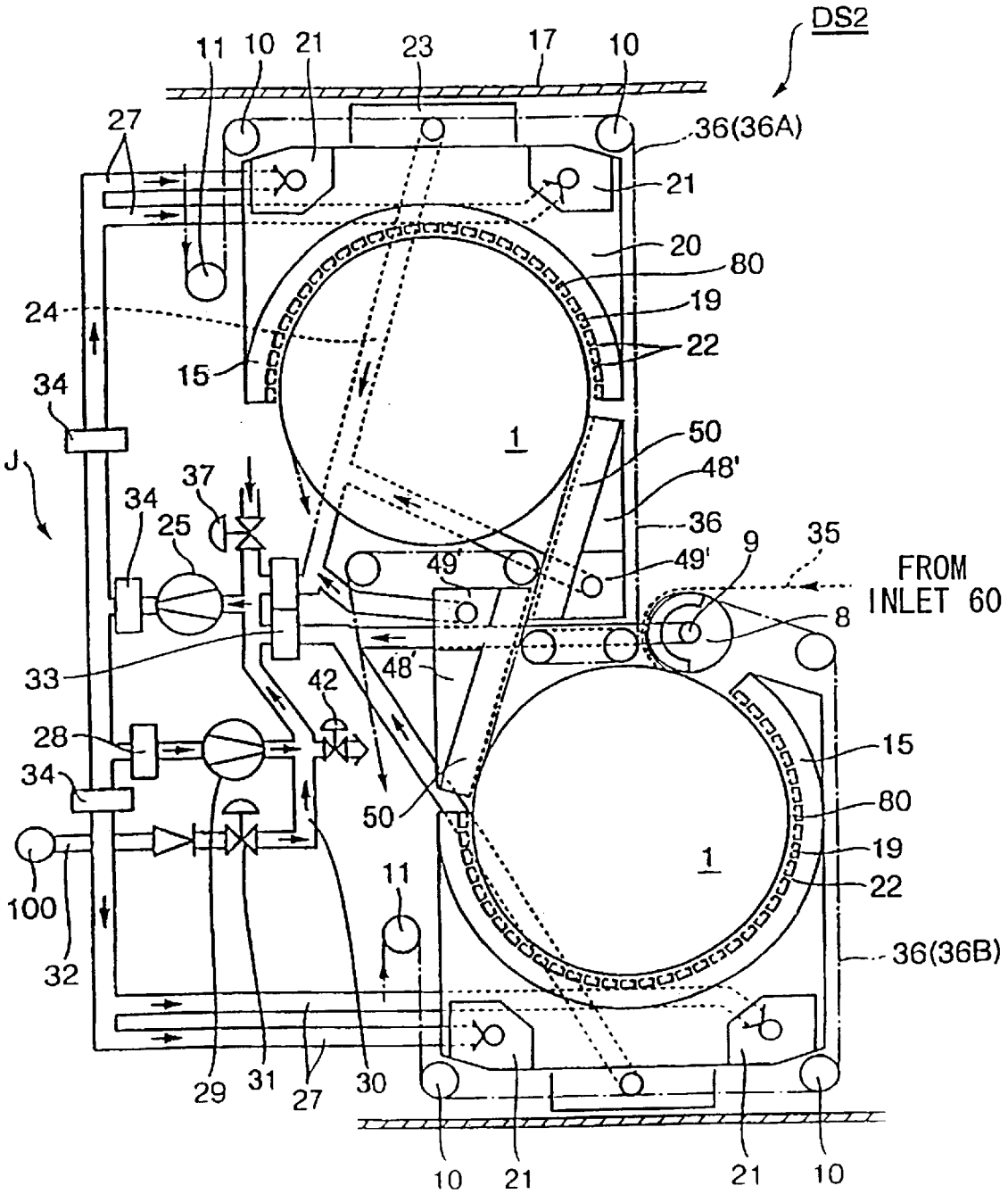
FIG. 10 is a flow diagram showing a circulation system for heated gas in the second embodiment of the drying apparatus of the present invention.

Next, a description of a second embodiment of a drying apparatus for sheet material of the present invention is provided below with reference to FIGS. 8, 9, and 10. FIG. 8 is a view of a drying apparatus DS2 according to the second embodiment as seen from the side face. FIG. 9 is a side cross-sectional view of FIG. 8. FIG. 10 is a diagram showing a circulation system for heating gas of the drying apparatus. In the following description, same reference numbers are denoted for the identical or similar components as those of the aforementioned first embodiment, the description thereof is abbreviated or omitted.

The drying apparatus DS2 comprises; rotors (rotation cylinders) 1 for supporting one face of the sheet material 35 while rotating, a permeable fabric belt 36 which is contacted with the other face of the sheet material 35 so as to clamp the sheet material 35 with the rotors 1 and moves in synchronous with the rotation of the rotors 1, blowing ports 19 for blowing heated gas towards the fabric belt 36 in the radial direction from the outside of the rotors 1, and suction ports 22. A plurality of rotors 1 are arranged in the upper and lower two rows. The fabric belt 36 includes an upper row side fabric belt 36A of an endless construction which travels around inside the hood 17 so as to clamp the sheet material 35 which is supported on the upper row side rotors 1, and a lower row side fabric belt 36B of an endless construction which travels around inside the hood 17 so as to clamp the sheet material 35 which is supported on the lower row side rotors 1.

The upper row rotors 1 respectively comprise canopy hoods 15 arranged on the upper side from the center of the rotation shaft 2 connected to the upper row rotors 1, for forming an evaporation space 80 with the rotor 1. Similarly, the lower row rotors respectively comprise canopy hoods 15 arranged on the lower side from the center of the rotation shaft 2 connected to the lower row rotors 1, for forming an evaporation space 80 with the rotor 1. The canopy hoods 15 are made from heat insulating panels.

In order to improve an adjustability of a distance between the canopy hoods and rotors for widening the impingement space and impinging angle in the narrow hood 17, the canopy hoods 15 are divided into sections in the left and right hand (in the current example, two segments) such that each section at the left and right hand and at the center can be independently change the positions up and down by lifting devices 16.

As described above, each of the canopy hoods 15 is formed so as to be divided into optional sections, and each section of the canopy hoods 15 can be individually raised and lowered by each lifting device 16. Since the size of the space of the evaporation space 80 formed between the canopy hoods 15 and the rotor 1 can be optionally set, it is possible to easily change the drying conditions for the sheet material 35, to thereby change or to improve the quality of the sheet material 35, and to save energy for drying.

As described above, a plurality of rotors 1 are provided, and each of the plurality of rotors 1 are respectively arranged in upper and lower two rows. Fabric belt rolls 8' are provided between the upper and lower rotors 1. These fabric belt rolls 8' are rotatably supported by fabric belt roll bearings 9. Here two suction fabric belt roll 8 are provided respectively at each of the inlet and outlet ports of the hood 17.

An entry section 60 and an exit section 61 for the sheet material 35 are respectively provided on the opposite sides of the hood 17, facing the interior of the hood 17. On each of the entry section 60 and the exit section 61, a seal section (seal mechanisms) are provided for preventing movement of gas between the outside and inside of the hood 17 described using FIGS. 4 and 5.

Between the upper row rotors 1 and the lower row rotors 1, suction fabric belt boxes 50 are provided. Two respective suction fabric belt boxes 50 are provided so as to face the front and back sides of the sheet material 35, at positions where the travelling sheet material 35 is delivered between the upper row side rotors 1 and the lower row side rotors 1.

Near the suction fabric belt boxes 50, there are provided triangular box shape suction boxes 48' and discharge communicating ducts 49' connected to these suction boxes 48'. The discharge communicating ducts 49' are connected to the suction duct 24 via a flexible joint.

As shown in FIGS. 10, 16, and 17, the gas circulation heating system J of the drying apparatus DS2 is provided on the drive side of the rotors 1, and the gas circulation heating system J comprises an discharge screen 33 for removing foreign matter such as mist, paper dust and the like in the discharge gas, a plurality of discharge heaters 34 with a heat source of combustion gas or a heating medium, for example, high temperature discharge gas from a hydrogen gas turbine which uses hydrogen gas fuel and oxygen; a gas circulation fan 25, an adiabatic expansion nozzle 26, supply ducts 27, a gas scrubber (steam scrubber) 28, a gas compressor (steam compressor) 29, a pressurized steam pipe 30, a steam control valve 31, a make-up steam pipe 32, an air supply damper or valve 37, and an discharge control damper or valve 42. These elements are respectively connected to the suction duct 24, the air supply box connection ducts 21 and a steam header 100, so that the water vapor is circulated.

As shown in FIG. 9, a seal mechanism provided with a labyrinth structure, a felt surface, or a brush surface is mounted on the faces where the rotors 1 or the suction fabric belt rolls 8 contact with the canopy hood 15 or the hood 17, so that external air does not enter into the hood 17 and so that internal vaporized steam does not leak from the hood 17.

Wet sheet material 35, which has been formed into a sheet at a wire part and dehydrated to a water content of 50 to 60% with a press part, is introduced to inside the hood 17 from the entry section 60, and is then sucked by the suction fabric belt roll 8. The sheet material 35, as shown in FIG. 8 is at first sucked to the lower row side fabric belt 36B which travels around inside the hood 17, and is guided to the lower row side rotor 1. The sheet material 35 which has been guided to the lower row side rotor 1 is blown with heated gas from the blower ports 19 while being clamped between the outer peripheral face of the rotor 1 and the lower row side fabric belt 36B.

The sheet material 35 which is propelled while being supported by the lower row side rotor 1 is eventually separated from the lower row side rotor 1. Then, this is passed between the two suction fabric belt boxes 50, and delivered to the upper row side rotor 1. The sheet material 35 which has been delivered to the upper row side rotor 1 is subjected to a drying process similar to that described above while being clamped between the upper row side rotor 1 and the upper row side fabric belt 36A.

Here, gas of around 130° C. containing water vapor which has been evaporated from the sheet material 35 by the heated gas blown from the blower ports 19 is sucked by the suction ports 22 in the canopy hood 15 (in the evaporation space 80) and by the suction fabric belt boxes 50. The sucked discharge gas is circulation reheated by the gas circulation heating system J and then again supplied to the hood 17 from the blower ports 19.

As described above, between the rotors (rotation cylinders) 1 arranged in the upper row, and the rotors (rotation cylinders) 1 arranged in the lower row, at the outer peripheral sides of the rotors 1 on the upper row and lower row where the sheet material 35 freely travels, are provided suction fabric belt boxes 50 on either side of the fabric belt 36A and 36B, which contact the fabric belt 36 with sliding frames. By means of these suction fabric belt boxes 50, the discharge gas from the travelling sheet material 35 can be absorbed.

Third Embodiment

Figure 11:
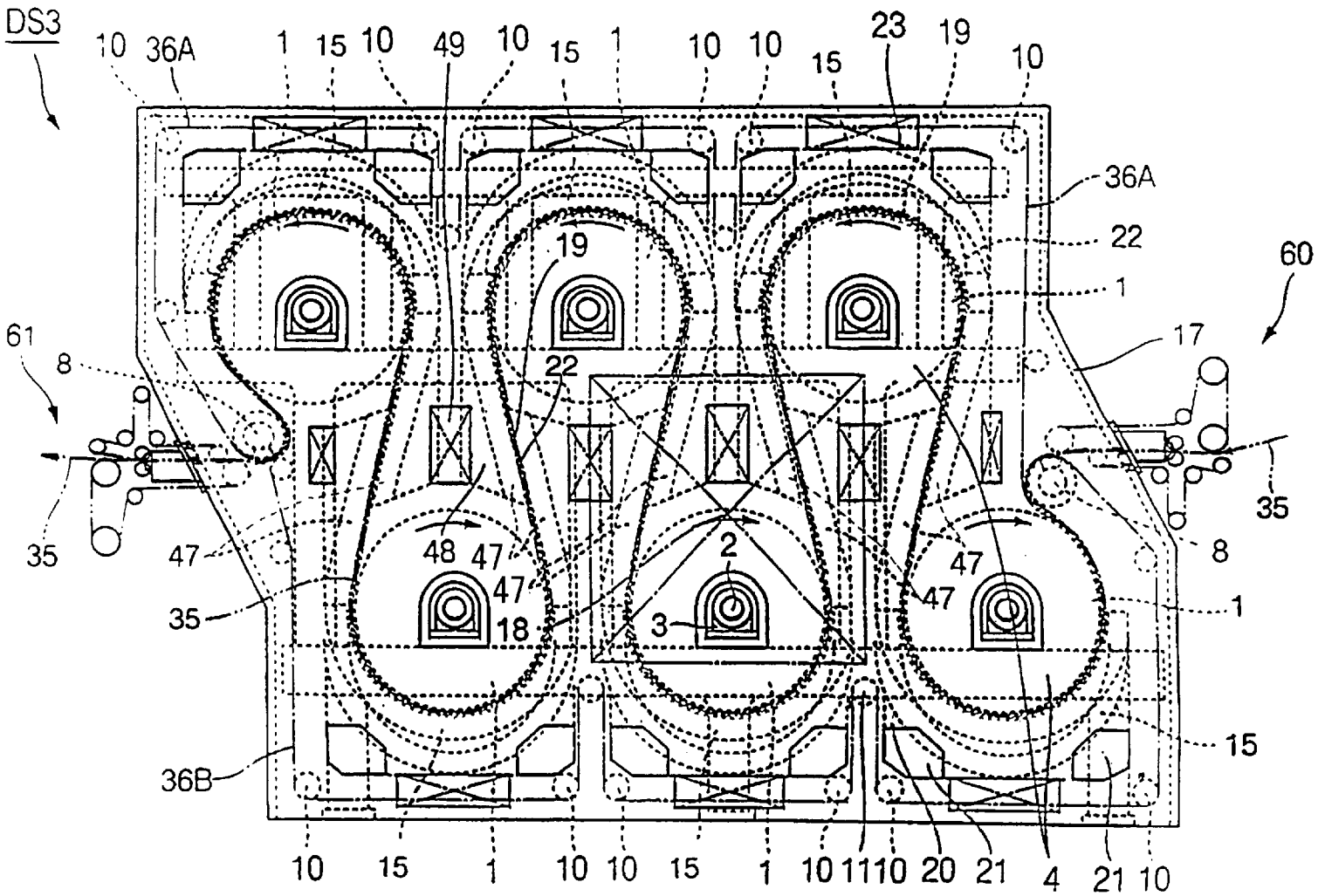
FIG. 11 is a side view showing a third embodiment of the drying apparatus of the present invention.
Figure 12:
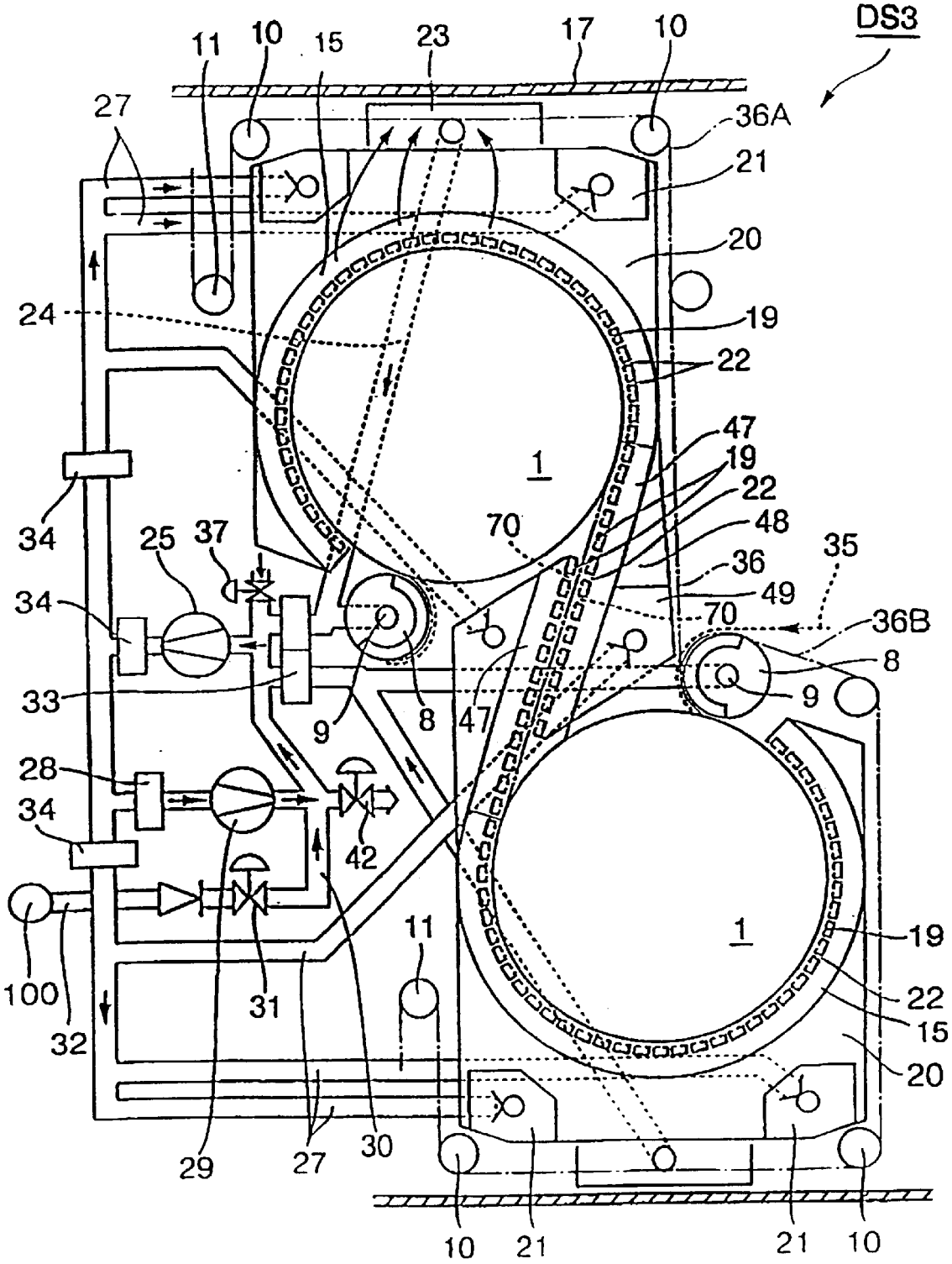
FIG. 12 is a flow diagram showing a circulation system for heated gas in the third embodiment of the drying apparatus of the present invention.

Next, a description of a third embodiment of a drying apparatus for sheet material of the present invention is provided with reference to FIGS. 11 and 12. FIG. 11 is a side view showing an embodiment in the case where the rotor (rotation cylinder) 1 is installed in two rows, while FIG. 12 is a diagram showing the circulation system for heated gas. In the following description, the same reference numbers are used for identical or similar components shown in the aforementioned various embodiments and the description thereof is abbreviated or omitted.

As shown in FIGS. 11 and 12, the drying apparatus DS3 comprises a plurality of rotors 1 arranged in the upper and lower two rows. The dryer frame 4 is assembled on a sole plate 14 which is secured by anchor bolts to individual machine foundations 13 in the paper machine building, and the necessary number of rotors 1 are respectively set up on rotor shafts 2 and rotor shaft bearings 3. At the time of arranging the multi-cylinder type rotors, these rotors are arranged in staggered form in upper and lower two rows. As shown in the present embodiment, the arrangement of rotors into two rows is advantageous in the effective use of factory space.

Canopy hoods 15, each made from heat insulating panels and which can be moved up and down by respective lifting devices, are arranged on the dryer frame 4 at an upper portion from the center of the rotation shaft 2 for the upper row rotor 1, and at a lower portion from the center of the rotor shaft 2 for the lower row rotor 1. A flat evaporation chamber is constructed by providing a square hood 47 between the upper and lower rotors 1 on the extension of the canopy hood 15 by sandwiching the fabric belt 36 with an endless construction therebetween. Furthermore, at the inlet and the exit of the hood 17, dryer frames 4 are provided respectively by arranging respective pairs of a fabric belt roll 8 and a fabric belt roll bearing 9.

Covering the outer periphery of all the drying parts including the upper row and lower row canopy hoods 15 and the dryer frame 4, a hood 17 made from heat insulating panels, and a hood opening and closing device 18 for inspection or cleaning are provided, and excluding an inlet and outlet of the sheet material 35, the hood entirely closes and seal the outer periphery of the dryer portion. In the hood, there is provided blowing ports 19 and suction ports 22 (each being round holes or slits) in an approximately flat evaporation surface over the rotor surface and the extension thereof, reaching to the pocket section of the adjacent rotor 1, and with a gap of approximately 10 to 25 mm to the surface of the sheet material 35. Box type square hoods 47 with side faces capable of opening and closing for entering and extracting and inserting of the endless fabric belt 36 are respectively arranged in the form of a horseshoe. Furthermore, in the canopy hoods 15, air supply boxes 20 connected to respective air supply box communication ducts 21, and with a plurality of annular shaped boxes directly connected to the blower ports 19, are installed leaving a space for sufficiently maintaining a suction space, and at the drive side, air supply ducts 27 are connected to the air supply box communication ducts 21 through a flexible joint.

A plurality of triangular box like air supply boxes 48 respectively connected to air supply communication ducts 49, and which are directly connected to the blowing ports 19, are installed at a spacing to the approximately flat evaporation surface of the pocket section to maintain a sufficient suction space, and on the drive side, the air supply ducts 27 are connected to the air supply connection ducts 49 via a flexible joint. A seal mechanism such as a labyrinth construction or a felt surface or a brush surface as described in detail in the former section is provided on the face where the rotor 1 or the suction fabric belt roll 8 contacts with the canopy hood 15 or the hood 17, such that external air does not enter into the hood 17 and a large amount of internal vaporized steam does not leak.

Wet sheet material 35 which has been formed into a sheet at a wire part and dehydrated to a water content of 60 to 50% with a press part, is led by the inlet fabric belt 12 at the inlet of the hood 17 which is completely sealed by the heat insulating panels, and is propelled while clamped against the paper feed sealing blanket 39 by means of upper and lower sealing pinch rolls 38, and is rapidly condensation heated between the steam box 43 and the suction box 40. Then the wet sheet material is separated from suction zone of the suction fabric belt roll 8, to the lower row side fabric belt 36B which travels around inside the sealed hood and at first comes up via the lower row fabric belt rolls 10, and arrives at the rotor 1 entrance arranged on the lower row inlet side. The sheet material 35 is then clamped by the fabric belt 36A which comes down via the upper row fabric belt rolls 10, and travels around with the rotor 1 inside the first canopy hood 15 having the respective blowing ports 19 and suction portions 22, and while the upper and lower faces of the sheet are being clamped by the upper and lower fabric belt 36, this is strongly clamped against the rotor 1 surface by the tension applied from fabric belt to the tension rolls 11, and is dried under restraint.

The sheet material 35 which has passed through the first rotor 1, while continuing to be clamped by the two fabric belt 36, is sandwiched by the two upper and lower endless fabric belt 36 and clamped with a strong force and further dried under restraint by the impingement force of the high speed high temperature gas at the evaporation face of the square hood 47 having the respective blower ports 19 and the suction ports 22 in an approximate plane. Then at the square hood 47 in the horseshoe shape arrangement connected to the second canopy hood 15 and having the blower ports 19 and the suction ports 22, the sheet material 35 again arrives at entrance to the second rotor 1 provided on the upper row, and drying is repeated in a similar manner to the above.

The sheet material 35 which has left the last rotor 1 is transferred on the fabric belt 36A disposed on the upper row side by the suction zone of the suction fabric belt roll 8, separated from the rotor 1, directed to the exit of the hood 17 by a paper delivery sealing blanket 41, and propelled while being clamped to the outlet fabric belt 12, and the sheet material 35 is transferred from the upper row fabric belt 36A by the suction box 40 and, while being nipped by the upper and lower ceiling pinch rolls 38 to prevent the air leakage, the sheet material is delivered to the outside from the outlet of the drying hood. When the sheet material 35 is separated from the last rotor 1, the upper and lower row endless fabric belts 36 also separate from the sheet material and travel around the fabric belt rolls 10 at the upper and lower rows and again return to the inlet of the hood 17, and the above-mentioned drying cycle is repeated.

At the evaporation surface in the horseshoe shape in cross-section which is formed by combining a roughly semicircular shape cylindrical surface on the rotor 1 and flat surfaces extending on both side of the semicircular surface, the sheet material 35 which is sandwiched by the two upper and lower fabric belt 36 (the inner and outer surfaces of the sheet material alternately changes as it moves from the lower row side rotor to the upper row side rotor), is blown by high speed hot gas of at least 150° C. from the outside surface of the semicircular cylindrical surface and from both sides of the flat surfaces, and the discharge gas at around 130° C. containing the water vapor evaporated from the sheet material 35 is sucked through the suction ports 22 inside the canopy hood 15 and inside the square hood 47 and through the suction fabric belt rolls 8. The discharge gas then passes through the suction box 23 and the suction duct 24 inside the hood 17, and after foreign matter such as paper dust and mist is removed by the discharge screen 33, the pressure of the discharge gas is raised by the gas circulating fan 25. After then, at the outlet, the pressurized discharge gas is heated by the discharge heater 34 to preferably at least 150° C., and the majority of the heated and pressurized gas is, after passing through the air supply ducts 27 and the air supply box communication ducts 21 and 49 and the air supply boxes 20 and 48, impinged as an impingement flow from the blower ports 19 onto the sheet material 35 which is sandwiched by the two upper and lower endless fabric belt 36, so that the vaporized steam remaining in the voids in the fabric belt 36 is expelled, and the sheet material 35 is directly heated. Moreover, the boundary layer formed by the saturated steam on the sheet material 35 is disturbed by the impingement flow to thereby promote evaporation. It is desirable that the atmosphere in the hood is raised to more than 130° C. by the evaporated water vapor.

Fourth Embodiment

Figure 13:
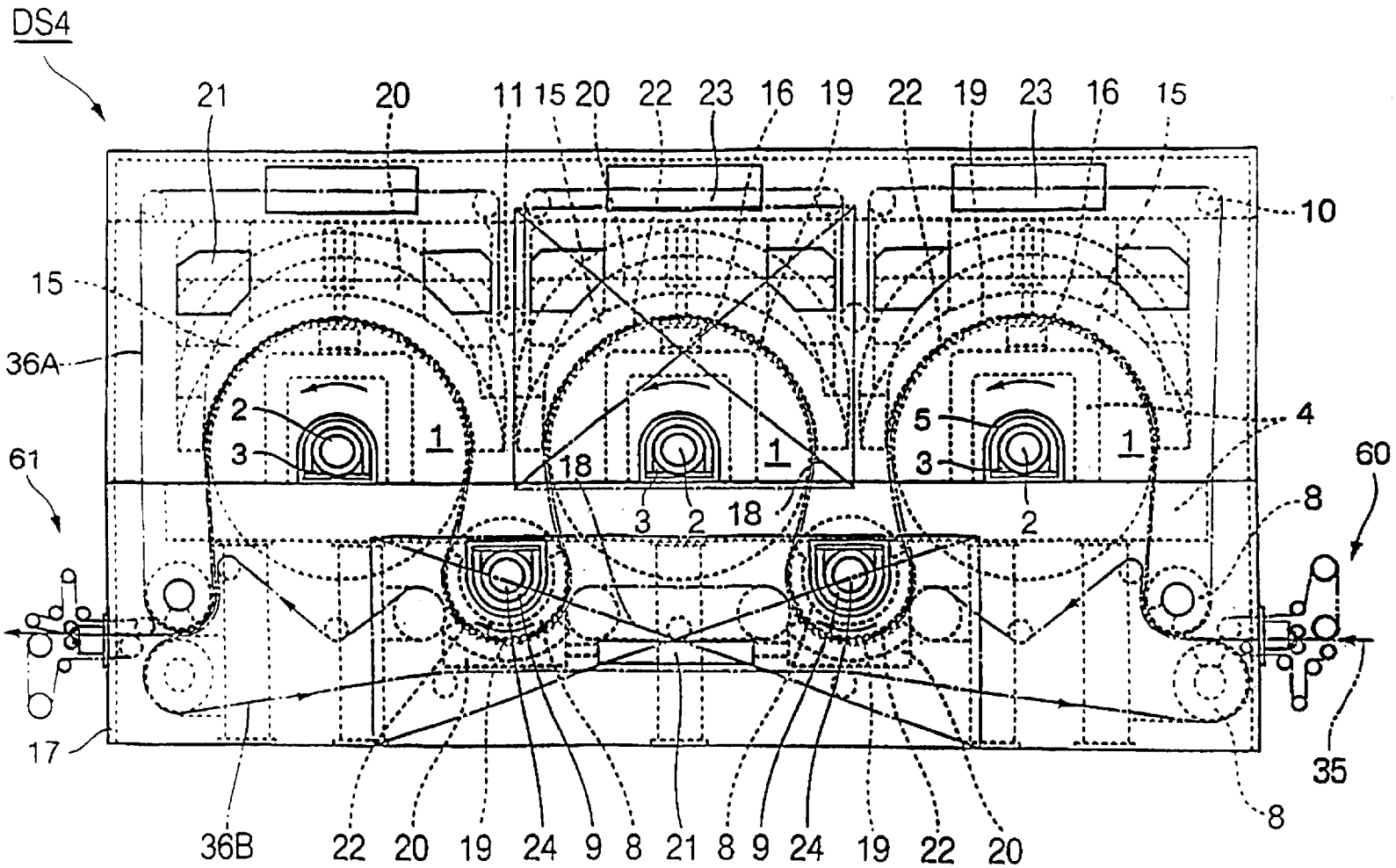
FIG. 13 is a side elevation showing a fourth embodiment of the drying apparatus of the present invention.

Next is a description of a fourth embodiment of a drying apparatus for sheet material of the present invention, with reference to FIG. 13. FIG. 13 is a side view showing an embodiment of a downward directed arrangement for the case where a plurality of cylindrical type rotors 1 are disposed in one row. Here in the following description, identical or similar components to the above mentioned various embodiments are denoted by the same reference numbers and the description thereof is abbreviated or omitted.

The drying apparatus DS4 in FIG. 13 is constructed by a plurality of large diameter rotors 1, arranged horizontally into one row. In this drying apparatus DS4, these rotors are divided into some groups, and rotors belonging to one of groups are arranged such that the sheet material enters from the upward direction and the sheet material exits the rotor toward the downward direction, and the sheet material enters from the downward direction and exits toward the upward direction for the rotors belonging to one of another groups, and the group of upward rotors and the group of downward rotors are disposed alternately in a horizontal direction. Each of the rotors (rotation cylinders) 1 is mounted on a dryer frame 4 by means of a rotor shaft 2 and rotor shaft bearings 3. For the upward rotors, canopy hoods 15 formed by heat insulating panels are provided pointing upward, and for the downward rotors, canopy hoods formed by heat insulating panels are provided pointing downward. The canopy hoods 15 are arranged on the dryer frame 4 through respective lifting devices 16, and can be raised and lowered by means of the lifting devices 16.

At a position adjacent to the upward rotor 1, a suction fabric belt rolls 8 connected to suction ducts 24 is provided on the dryer frame 4, and at a position adjacent to the downward rotor, a suction fabric belt 8 is provided below the dryer frame 4.

Furthermore, it is preferable to provide air supply boxes 20 having high temperature gas blowing ports 9 and discharge gas suction ports 22 on the face facing the suction fabric belt rolls 8. In FIG. 13, only a group of downward rotors are shown, in which the sheet material can be ejected downwards easily even when it is broken.

Covering the outside of the canopy hoods 15 at the upper row and at the lower row, and the dryer frame 4, a tight sealing hood 17 formed by heat insulating panels and a hood opening and closing device 18 for inspecting or cleaning the hood 17 are provided for tightly sealing the interior of the hood excluding the entry section 60 and the exit section 61 of the sheet material 35. The point of this embodiment which differs from the other embodiments is that, since this embodiment has a single row arrangement having no rotors 1 at the lower part, it is possible to provide only one paper feed/delivery endless fabric belt 36B for the sheet, which is made travelling around by the fabric belt rolls 10. When manufacturing a thick paper such as a cardboard wherein there is no concern to break the sheet material, it is possible to omit the feed/delivery endless fabric belt 36B disposed at the lower row.

Wet sheet material 35, after being formed into a sheet at a wire part and dehydrated to a water content of 60 to 50% by a press part, is directed by the inlet fabric belt 12 to inlet section 60 of the hood 17 which is completely sealed by the heat insulating panels, is propelled while clamped to the paper feed sealing blanket 39 by means of upper and lower sealing pinch rolls 38, and is rapidly condensation heated between the steam box 43 and the suction box 40. The sheet material is then transferred from the suction fabric belt roll 8 to the fabric belt 36B, coming up from the lower row while traveling around the inside of the sealed hood, and is guided to the entry portion of the rotor 1. The other side of the sheet material 35 is clamped by the fabric tension belt roll 11 onto the rotor 1 and dried under restraint.

The sheet material 35 which has passed through the first rotor 1 is separated from the rotor 1 and is again transferred by the second suction fabric belt rolls 8 to the fabric belt 36A, and is clamped preferably between the lower row paper feed/delivery fabric belt 36B, and drying is promoted under restraint by high temperature gas supplied from the air supply boxes 20 having the blower ports 19 and the suction ports 22. The sheet material is then reaches the entry portion of the second rotor 1, and separates from the paper feed/delivery fabric belt 36B, and thereafter similar drying is repeated. The sheet material 35 going out from the final rotor 1 is then transferred by the suction fabric belt roll 8, and at the hood exit, rides on the paper delivery sealing blanket 41 and is clamped by the outlet fabric belt 12, and while being sealed by the upper and lower sealing pinch rolls 38 and delivered to the outside from the exit of the drying hood 17. Other operations are the same as those in the other embodiments and hence explanations are omitted.

FIG. 16 is a plan view showing a gas circulation heating system J using an outside heat source such as steam or a heating medium or combustion gas, used in the aforementioned embodiments, that is, a circulating gas reheater in the indirect heat exchange system, while FIG. 17 is a side view of FIG. 16. As shown in FIGS. 16 and 17, gas which has passed through the suction ducts 24 and the discharge screen 33, is supplied as circulating heated gas at around 130° C. from the gas circulating fan 25 to the outside of the low temperature side where thermal expansion joints are secured sufficiently using rollers of the discharge heater 34. Then, the discharge heater 34, which is fixed at the high temperature side of the combustion chamber heated by a gas or a fuel oil combustor 51 having an economizer 52, makes the gas passing to the outer peripheral section thereof by alternate flow or cross-flow and reheats the gas to more than 150° C., and supplies the gas to the air supply boxes 20 through the air supply duct 27. Since the temperature of the combustion chamber is high, the indirect heat exchanger is provided equipped with sufficient thermal expansion joints and equipped with a construction wherein the circulating gas and the combustion gas can be isolated, so that the combustion gas and the circulating gas do not leak and mix.

Fifth Embodiment

Figure 14:
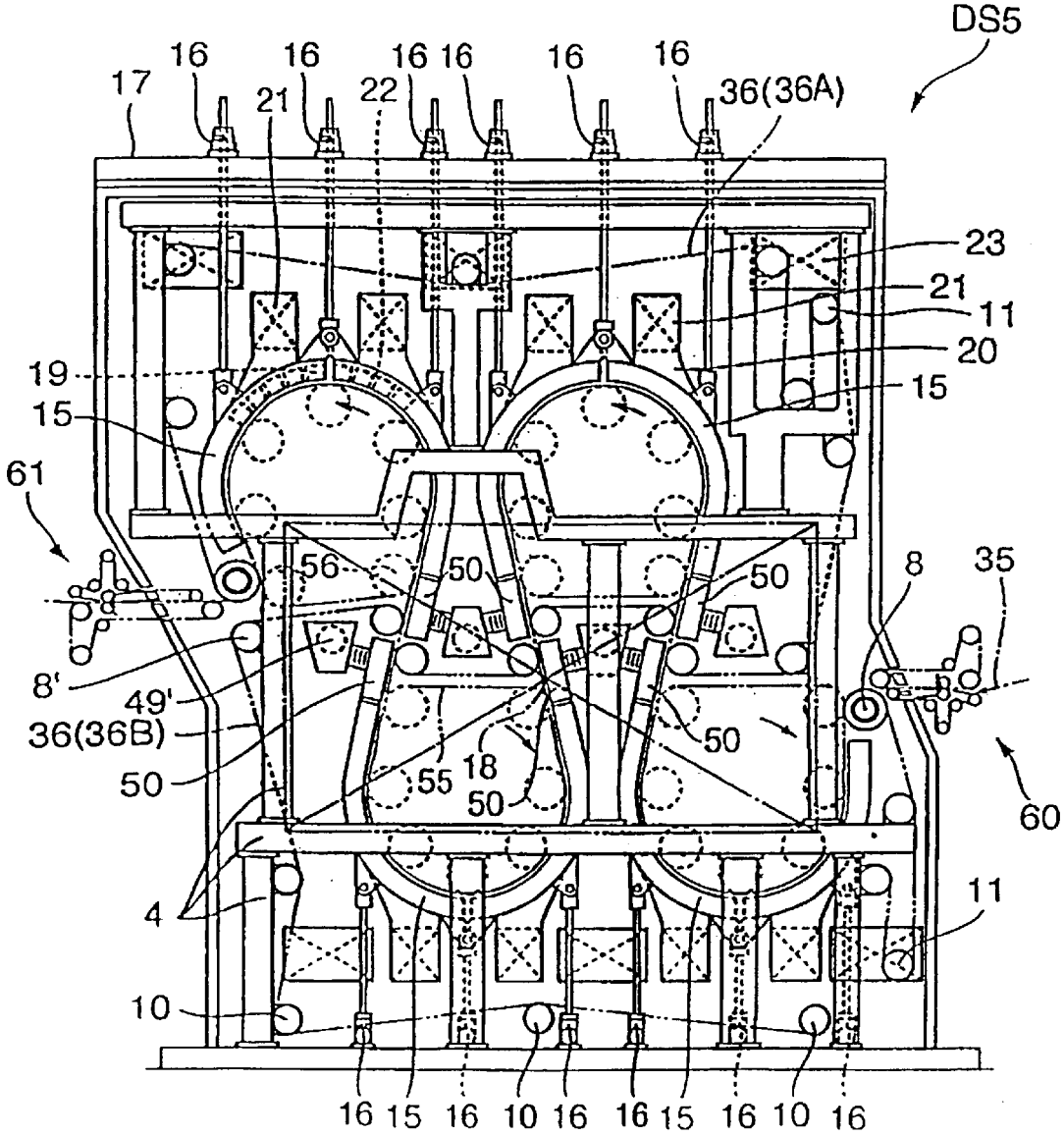
FIG. 14 is a side view showing a fifth embodiment of the drying apparatus of the present invention.

Next, a description of a fifth embodiment of a drying apparatus for sheet material of the present invention is provided with reference to FIG. 14. FIG. 14 is a side view showing a drying apparatus DS5 according to the fifth embodiment. In the following description, for identical or similar components to those of the other embodiments, the description thereof is abbreviated or omitted.

The drying apparatus DS5 comprises rotation plates (rotation bodies) 55 for supporting one face of the sheet material 35 while rotating, a permeable fabric belt 36 which contacts with the other face of the sheet material 35 and clamps the sheet material 35 against the rotation plates 55 and moves in synchronous with the rotation of the rotation plates 55, and canopy hoods 15 provided with built-in blower ports 19 for blowing hot gas from the outer peripheral direction of the rotation plates 55 towards the fabric belt 36, and provided with built-in suction ports 22. The fabric belt 36 comprises an upper row side fabric belt 36A having an endless construction which travels inside the hood 17 so as to clamp the sheet material 35, supported on the upper row side rotation plates 55, and a lower row side fabric belt 36B having an endless construction which travels inside the hood 17 so as to clamp the sheet material 35, supported on the lower row side rotation plates 55.

The endless rotation plates (belt) 55 are supported by a plurality of rotation plate rolls 56 and are arranged in arcuate shape in upper and lower two rows. The rotation plate rolls 56 are preferably fitted with guards to prevent the rotation plates 55 from coming off, and are arranged on the dryer frame 4 by rotation plate roll shafts and rotation plate roll bearings. In order to prevent meandering of the rotation plates 55, the rotation plate roll shafts at the end of the arcuate shape travelling section of the rotation plates 55 (at the straight line travelling section) are secured by a rotation plate meander adjustment devices and rotation plate tension adjustment devices. The rotation plates 55 is driven by the rotation plate rolls 56, and/or is driven by the fabric belt 36 which travels around in synchronous with the outsides of the rotation plate by driving the fabric belt 10.

Canopy hoods 15 are disposed at the upper side of the rotation plates 55 for the rotation plates arranged upper than the center of the upper row rotation plates 55 for forming the evaporation spaces 80 with the rotation plates 55. Similarly, canopy hoods 15 are disposed at the lower side of the rotation plates arranged lower than the center of the lower row rotation plates 55 for forming evaporation spaces 80 with the rotation plates 55. The canopy hoods 15 are formed by integrating heat insulating panels and canopy hoods is provided with blower ports 19 and suction ports 22.

In order to improve the lifting ability for widening the impingement angle in the narrow hood 17 as well as for facilitating adjustment of the distance to the rotation plates 55, the canopy hoods 15 are divided into several portions such as to the left, right, and center portions (in the current example, two portions), and the distance of each portion to the rotation belt can be independently adjusted by each lifting device 16. In the second embodiment, since the rotor is in a cylindrical shape, the shape of the canopy hood is also restricted to an arcuate shape. However in the fifth embodiment, since rotation plates are used, the distance from the canopy hood to the rotation plate can be easily adjusted, and by making the bearings for the left and right rotation plate rolls movable, it becomes remarkably easy to adjust the height of the hood.

Moreover, in order to prevent dry shrinkage of the sheet material 35, it is necessary to apply a contact pressure to the rotation plate 55 by means of the endless fabric belt 36. The contact force p between the fabric belt and the cylindrical rotor has the relationship $p=2T/r$ where T=the fabric belt tension and r=the rotation body curvature radius. It is not possible to prevent the dry shrinkage of the sheet material by use of a horizontal flat plate. Consequently, as shown in this embodiment of the this invention, a tension must be applied by the fabric belt on a curved body. Since the actual fabric belt tension $mv^2/r$ differs depending on the speed and basis weight, it is possible to adjust the tension by changing the position of the rotation plate rolls 56.

As described above, the respective canopy hoods 15 are divided into a plurality of portions optionally, and the divided canopy hoods 15 can be individually raised and lowered by the lifting device 16. Hence the size of the space of the evaporation space 80 formed between the canopy hoods 15 and the rotation plate 55 can be optionally set. Furthermore, by being able to optionally set the size of the space of the evaporation space 80, the drying conditions for the sheet material 35 can be easily changed, and hence improvements in the quality of the sheet material 35 and in energy saving can be achieved.

As described above, a plurality of the rotation plates 55 are provided, and each of the plurality of rotation plates 55 are respectively arranged in upper and lower two rows. Fabric belt rolls 8' are provided between the upper and lower rotation plates 55. These fabric belt rolls 8' are rotatably supported by fabric belt roll bearings 9. Here, one suction fabric belt roll 8 is provided at each of the inlet and outlet ports of the hood 17.

Covering the outside of the upper row or lower row canopy hoods 15 and the dryer frame 4, a tight sealing hood 17 made from heat insulating panels is provided for tightly sealing the outer periphery excluding the entry section 60 and the exit section 61 for the sheet material 35. Each of the entry section 60 and the exit section 61 is provided with seal sections (seal mechanisms) for preventing movement of gas between the outside and inside of the hood 17 as described in FIGS. 4 and 5. For inspection/cleaning purposes, an electrically or pneumatically operated hood opening device 18 is provided which can seal the inside thereof completely by a surface contact by providing stepped contact portions for mutual engagement.

Suction fabric belt boxes 50 are provided between the upper row rotation plates 55 and the lower row rotation plates 55. Two pairs of the suction fabric belt boxes 50 are provided on either side of positions where the travelling sheet material 35 is transferred between the upper row side rotation plates 55 and the lower row side rotation plates 55, so as to face the front and back surfaces of the sheet material 35.

Near the suction fabric belt boxes 50, there are provided triangular box shape suction boxes 48' with discharge communicating ducts 49' connected to these suction boxes 48'. The discharge communicating ducts 49' are connected to the suction duct 24 by use of a flexible joint.

The gas circulation heating system J of the drying apparatus DS5, as shown in FIGS. 10, 16, and 17, is provided on the driving side of the rotation plates 55, and comprises an discharge screen 33 for removing foreign matter such as mist, paper dust and the like in the discharge gas; a plurality of discharge heaters 34 having a heat source of combustion gas or a heating medium for example high temperature discharge gas of at least 350° C. from a hydrogen gas turbine which uses hydrogen gas fuel and oxygen; a gas circulation fan 25; an adiabatic expansion nozzle 26; supply ducts 27; a gas scrubber (steam scrubber) 28; a gas compressor (steam compressor) 29; a pressurized steam pipe 30; a steam control valve 31; a make-up steam pipe 32; an air supply damper or valve 37; and an discharge control damper or valve 42. These are respectively connected to the suction duct 24, the air supply box connection ducts 21 and a steam header 100, so that the water vapor is circulated.

A seal mechanism such as a labyrinth construction or a felt surface or a brush surface as described in detail in the former section is provided at the faces where the rotation plates 55 or the suction fabric belt rolls 8 contact with the hood 17, so that external air does not enter into inside the hood 17 and so that a large amount of internal vaporized steam does not leak.

Wet sheet material 35 which has been formed into a sheet at a wire part and preliminarily dehydrated to a water content of 50 to 60% with a press part, is introduced to inside the hood 17 from the entry section 60 as shown in FIG. 14, and then is at first suction attached by the suction fabric belt roll 8 onto the lower row side fabric belt 36B which travels inside the hood 17, and is guided to the lower row side rotation plates 55. The sheet material 35 which has been guided to the lower row side rotation plates 55 is blown with heated gas from the blower ports 19 while being clamped between the outer peripheral face of the rotation plates 55 and the lower row side fabric belt 36B.

The sheet material 35, which is propelled while being supported by the lower row side rotation plates 55 is attracted onto the lower row side fabric belt 36B by the lower row side suction fabric belt box 50 at the exit of the lower row side rotation plates 55 and thus separated. Then, the sheet material is attracted onto the upper row side fabric belt 36B by the upper row side suction fabric belt box 50, and transferred to the upper row side rotation plates 55. The sheet material 35 which has been delivered to the upper row side rotation plates 55 is subjected to a drying process similar to that described above while being clamped and travelling between the upper row side rotation plates 55 and the upper row side fabric belt 36A.

Here, gas of around 130° C. containing water vapor, which has been evaporated from the sheet material 35 by the heated gas blown from the blower ports 19, is sucked through the suction ports 22 in the canopy hood 15 (in the evaporation space 80) and the suction fabric belt boxes 50. The sucked discharge gas is reheated by the gas circulation heating system J and then again supplied to the hood 17 through the blower ports 19.

In the fifth embodiment, compared to the second embodiment, since the position of the rotation plates 55 can be freely set, it is possible to extend the restraining period for restraining the free shrinkage/contraction depending on the fabric belt longer than the case of using the cylindrical rotor. Consequently, the suction fabric belt boxes 50 become shorter, and the distance of the evaporation space 80 to the canopy hoods 15 can be set longer. While also depending on the gas flow rate, if air supply from the air supply box communication ducts 21 connected to the canopy hood becomes difficult, an exclusive air supply connection duct 49 can be provided in the pocket section.

As described above, between the rotation plates 55 arranged in the upper row and the rotation plates 55 arranged in the lower row, at the outer peripheral sides of the rotation plates 55 on the upper row and lower row where the sheet material 35 freely travels, suction fabric belt boxes 50 are provided either side of the fabric belt 36A and 36B, which contact the fabric belt 36 with sliding frames. By means of these suction fabric belt boxes 50, the sheet material 35 is transferred between the upper and lower rotation plates, and the discharge gas from the travelling sheet material 35 is sucked and sent to the circulating heating system J and reheated and used in a circulating manner.

Sixth Embodiment

Figure 15:
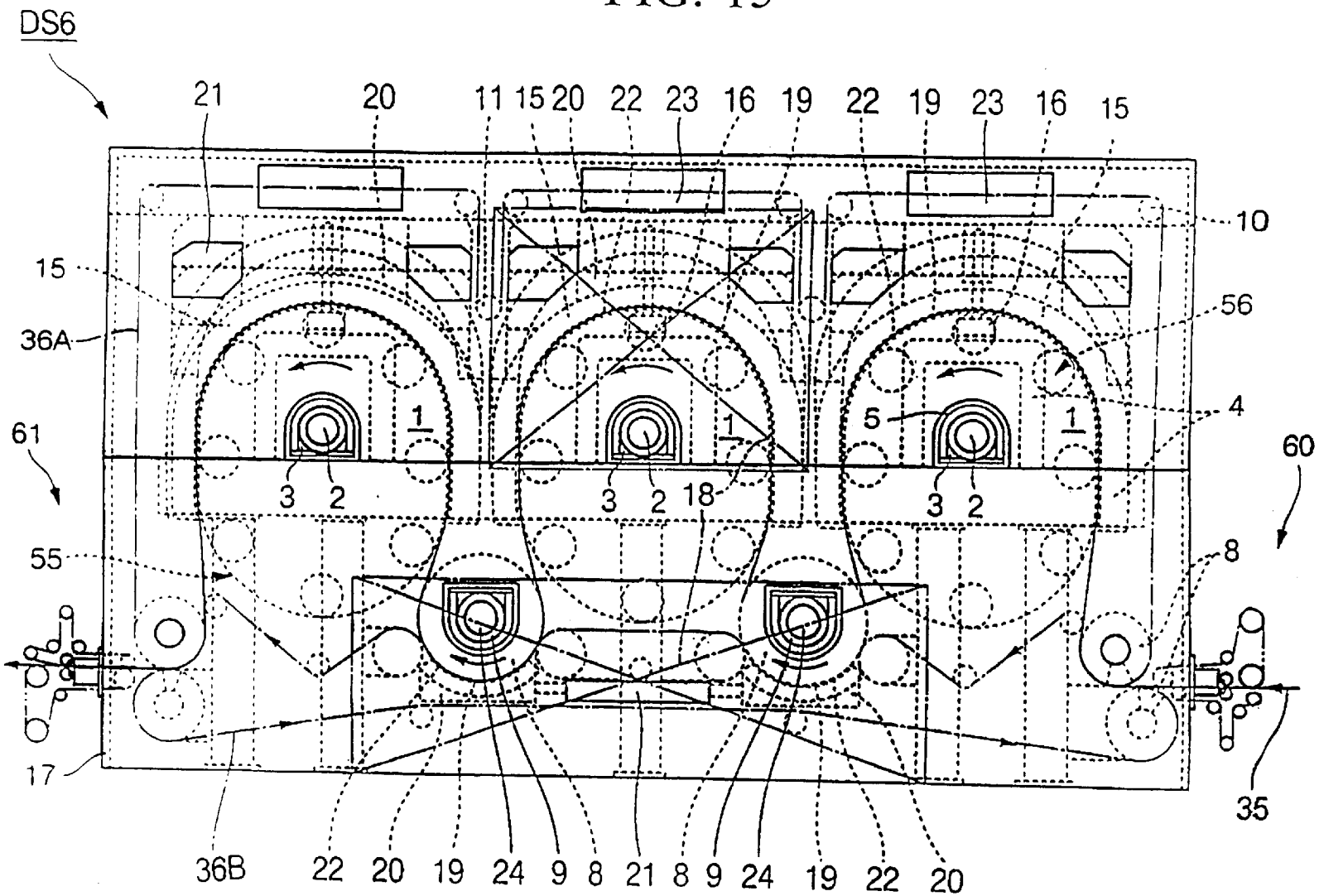
FIG. 15 is a side view showing a sixth embodiment of the drying apparatus of the present invention.

Next, a sixth embodiment of a drying apparatus for sheet material of the present invention is described with reference to FIG. 15. FIG. 15 is a side view showing an embodiment of a drying apparatus in which a plurality of cylindrical-type rotation plates 55 are arranged in one row in the downward direction. In the following description, for identical or similar components to the other respective embodiments, the description thereof is abbreviated or omitted.

The drying apparatus DS6 shown in FIG. 15 is a one row construction provided with a plurality of large diameter rotation plates 55 are arranged in one row and these rotation plates are divided into two groups, in which one group is consisted of upward cylindrical rotation plates, in which the sheet material enters from the upward direction and exits in the downward direction, and another group is consisted of downward cylindrical rotation plates, in which the sheet material enters from the downward direction and exits in the upward direction. The endless rotation plates 55 are supported by a plurality of rotation plate rolls 56 and a plurality of rolls are arranged so as to form an arcuate shape in one rows. The rotation plate rolls 56 are preferably fitted with guards, and are arranged on the dryer frame 4 by rotation plate roll shafts and rotation plate roll bearings. In order to prevent meandering of the rotation plates 55, the rotation plate roll shafts 58 located at the end of the arcuate shape travelling section of the rotation plates 55 are secured by rotation plate meander adjustment devices and tension adjustment devices.

For each of the rotation plates 55, a canopy hood 15 which forms an evaporation space 80 with the rotation plates 55 is arranged above or below the dryer frame 4 so as to be movable up and down by a lifting device 16 at an upper portion from the center of the rotation plate roll bearing for the downward directed arrangement, and at a lower portion from the center for the upward directed arrangement.

For one set of rotation plates 55, at positions adjacent to between the rotation plates 55 there are provided two suction fabric belt rolls 8 connected to suction ducts 24, below the frame 4 for a downward rotation plates and above the frame 4 for an upward rotation plate.

Furthermore, it is preferable to instal air supply boxes 20 having high temperature gas blowing ports 9 and discharge gas suction ports 22 on the face facing the suction fabric belt rolls 8. In FIG. 15, only the group of downward directed cylindrical rotation plates is shown, in which the sheet can be ejected downwards easily when it is broken.

A tightly sealed hood 17 made from heat insulating panels is provided so as to tightly seal the outside of the upper row or lower row canopy hoods 15 and the dryer frame 4, excluding spaces for the entry section 60 and the exit section 61 of the sheet material 35. For the purposes of inspection and cleaning, an electrically or pneumatically operated hood opening device 18 is provided which can ensure complete sealing by contacting mutually formed stepped contact face. The point where this embodiment differs from the other embodiments is that, since cylindrical rotation plates 55 are arranged in a single row, and no rotation plates 55 is located at the lower part, there is only one paper feed/delivery endless fabric belt 36A, which travels by the fabric belt rolls 10. It is possible to omit the lower row paper feed/delivery endless fabric belt 36B when the thick paper or the like is produced in which no concern should be paid for paper from cutting.

Wet sheet material 35 which has been formed into a sheet at a wire part and dehydrated to a water content of 60 to 50% with a press part, is led by the inlet fabric belt 12 at entrance section 60 of the hood 17 which is completely sealed by the heat insulating panels, and is propelled while being sandwiched by the paper feed sealing blankets 39 by means of upper and lower sealing pinch rolls 38, and is rapidly condensation heated between the steam box 43 and the suction box 40. Then, the sheet material 35 is transferred from the suction fabric belt roll 8 to the paper feed/delivery fabric belt 36B, coming up from the lower row and which travels around inside the sealed hood, is guided into the entry section of the rotation plates 55. The sheet material 35 which has been guided into the entry section of the rotation plates 55 is clamped by the fabric belt 36A which comes down from the upper row and is sucked by the suction fabric belt rolls 8 and one face of the sheet material is closely contacted with the rotation plates 55. The other face of the sheet material 35 is clamped by the rotation plates 55 by the tension from fabric belt tension rolls 11, and is dried under restraint.

The sheet material 35 which has passed through the first rotation plates 55 is separated from the rotation plates 55 and is received by the fabric belt 36A, and is clamped between the lower row paper feed/delivery fabric belt 36B, and drying is promoted under restraint by high temperature gas from the air supply boxes 20 having the blower ports 19 and the suction ports 22. Then, when the sheet material reaches the entry section of the second rotation plate 55, the sheet material separates from the paper feed/delivery fabric belt 36B, and thereafter similar drying process is repeated. The sheet material 35 output by the final rotation plates 55 is then received by the suction fabric belt roll 8, and near the exit of the hood 17, the sheet material is transferred on the paper delivery sealing blanket 41 and is clamped by the outlet fabric belt 12, and is sealed by the upper and lower sealing pinch rolls 38 and delivered to the outside from the exit of the drying hood 17. Other operations are the same as for the other embodiments and are hence omitted.

Next, experimental results based on a production method for sheet materials, which is provided with the drying process of the present invention, is described in detail below.

EXAMPLE 1

In a manufacturing method for a sheet material according to the present invention, an example using super-heated steam of at least 150° C. is described showing a result at an test plant, and thermal engineering calculations for heat balance of the restraining drying apparatus using impinging super-heated steam (at a sheet production tonnage of 507.384 BDkg/hr, with the sizing press and after dryer excluded for simplicity, and with 56% inlet water content, 5% outlet water content, and 619.057 kg/hr evaporation water). The steam conditions at the impinging nozzle (blower port) are:

t=250° C., $v$=2.454 $m^3$/kg, i=710/4 kcal/k g=2974.3 kJ/kg, and the gas flow rate between the impinging nozzles and the suction fabric belt is;

in total 2130.393 $m^3$/min, 52087.848 kg/hr, 37003.207×$10^3$ kcal/hr=154925.0×$10^3$ kJ/hr.

It is assumed that the sensible heat difference for the sheet inlet and outlet (inlet temperature 27° C.) for a bone dry paper stock is;

10073 kal/hr=42173.6 kJ/hr, the latent heat of vaporization of the evaporated water content from the sheet is;

378553 kcal/hr=1584925.7 kJ/hr, the required heat for heating the evaporated water steam from the sheet to the discharge gas temperature is, 38945 kcal/hr=163054.9 kJ/hr, the heat loss at the hood and the duct are;

25382 kcal/hr=106269.4 kJ/hr, and other losses is;

15265 (at $_{\chi}$=1, 15427, at $_{\chi}$=0.25, 24052, at $_{\chi}$=0.5$_{\Psi}$, 33740) kcal/hr=63911.5 kJ/hr.

The steam conditions after discharging the evaporated water at the suction port of the impinging hood (the water content of the excess amount brought into the wet part) are;

i=[(52087.848×710.4)−(10073+25382+15265)−619.057×(i−27)]÷52087.848 i=701.411 kcal/kg=2936.7 kJ/hr, t=230.87° C., $v$=2.363 $m^3$/kg, (Note)

As another calculation method, it is possible to apply the latent heat of vaporization of the sheet evaporated water content and the required heat for heating thereof to the abovementioned entropy calculation formula.

i=[(52087.848×710.4)−(10073+378553+38945+25382+15265)]÷52087.848=701.411 kcal/kg=2936.7 kJ/hr.

The required heat for heating the circulating water vapor when the leakage water vapor content is excluded and the excess part is sent as is at 230.87° C. to another process, and approximately the same amount of super-heated steam is reheated is;

52087.848×(710.4−701.411)=468.218×$10^3$ kcal/hr=1960.3×$10^3$ kJ/hr.

The required heat for heating per bone dry paper (BD) kg is; 922.808 kcal/kg=3863.6 kJ/kg.

Moreover, the required heat per evaporated water content kg is; 756.341 kcal/kg=3166.6 kJ/kg.

If the above computation results are expressed as thermal efficiency, these are expressed as follows:

(1) Heat input

If a calorific value of a boiler fuel is 13A gas combustion, the boiler depends on indirect heat exchange between the gas burner and the steam heating and the air pre-heat discharge gas heat exchange. If the heat input is fresh air standard with only the fuel calorific value, and for the heat output the heat loss in the boiler itself is added to the endothermic amount of the circulating gas, then the output heat is obtained as;

468.218+23.725+5.917+0.039=497.899×$10^3$ kcal/hr=2084.6×$10^3$ kJ/hr.

The heat per bone paper BD ton is; 497.899÷0.507384=981.3×$10^3$ kcal, 2084. 6÷0.507384=4108.5×$10^3$ kJ (2) Heat output (1) In the sensible heat (based on an entrance sheet temperature 27° C.) of the excess super-heated steam, 619.057 kg/hr evaporated water content becomes excessive, and hence this is discharged to outside the system to control the balance.

619.057×(701.411−27)=417.499×$10^3$ kcal/hr=1747.98×$10^3$ kJ/hr

The heat per paper BD ton is: 822.8×$10^3$ kcal, 3445.1×$10^3$ kJ

If in the super-heated steam drying method the excess super-heated steam is effectively utilized, it becomes clear that the required heat per paper BD ton is significantly reduced. That is, regarding the actual consumption fuel evaporation amount which is subtracted, the heat per paper BD ton is; 981.3−822.8=158.5×$10^3$ kcal, 4108.5−3445.1=663.4×$10^3$ kJ, being approximately ⅙ at 16.1%.

That is, at the time of applying a drying method using the aforementioned conventional pressure vessel drying cylinders, it is apparent that the discharge losses of the hood are 73.6%, the sensible heat taken away from the drain is 7.9%, giving a total of 81.5%.

(2) losses at the hood and duct of the paper machine are;

25.382×$10^3$ kcal/hr=106.3×$10^3$ kJ/hr (3). sensible heat of the boiler discharge gas is;

23.725×$10^3$ kcal/hr=99.3×$10^3$ kJ/hr (4). radiant heat loss of the boiler itself and other losses are;

5.917×$10^3$ kcal/hr=24.77×$10^3$ kJ/hr (5) losses dependent on incomplete combustion in the boiler are;

0.039×$10^3$ kcal/hr=0.163×$10^3$ kJ/hr (6). losses from other leaks and the like are;

15.265×$10^3$ kcal/hr=63.9×$10^3$ kJ/hr (7). sensible heat of the bone dry paper stock is;

8.631×$10^3$ kcal/hr=36.1×$10^3$ kJ/hr and (8). sensible heat of the moisture content in the paper stock is;

1.442×$10^3$ kcal/hr=6.04×$10^3$ kJ/hr (3) Thermal efficiency (1) Assuming that the excess steam is not used, when calculating the thermal efficiency from the amount of heat necessary to evaporate the water content, gives;

(378.553÷497.898)×100=76.03%

(2) When the excess steam is used as effective heat in another process, the paper machine drying process is evaluated as a excess steam producing boiler, and calculating the thermal efficiency gives;

(417.499÷497.899)×100=83.85%.

(3) When the excess steam can be effectively used, it is necessary to discuss this from a different view point for thermal efficiency to that defined up until now. For example, if the amount of heat necessary for evaporating the water content is considered the basis, then the amount of heat actually consumed is the difference;

497.899−417.499=80.400×$10^3$ kcal/h kcal/hr, giving a tentative excess thermal efficiency of;

378.553÷(497.899−417.499)×100=470.84%.

As a reference, the thermal efficiency of the drying apparatus using the conventional pressure vessel drying cylinders (high dew point sealed hood fitted to heat recovery device) is calculated. Although the heating efficiency of the conventional method is around 50 to 55%, the thermal adjustment values under ideal conditions are obtained as shown below.

(1) Heat input (1) Sensible heat of the dryer supply steam (based on an outside temperature of 32° C.)

Assuming that the high dew point sealed hood apparatus is used, and that steam is supplied by the discharge gas heat exchange, drain heat exchange, and flash heat exchange, so that heating of the supply steam is unnecessary. Assuming that these heat exchange amounts are compensated and are calculated at the respective source temperatures, and the dryer direct heat exchange efficiency is more than 96.5%, then the required heat for heating the dryer is calculated as follows for the heating under atmospheric pressure.

Saturated steam at 2.4 atmospheres (Japan Society of Mechanical Engineers-revised steam tables and charts—page 10—1950):

i'=125.84, i"=648.0, r=i"−i'=522.2 kcal/kg, and the sensible heat removed by the later mentioned discharge gas is,

[467233.971+8631+1,442]÷0.965=484190.719 kcal/hr=2027209.7×$10^3$ kJ/hr.

Consequently, the necessary supply steam amount and the required heat, ignoring flow-through vapor content, is as follows when a dryer internal vapor pressure is assumed as 1.4 kg/$cm^{2;}$ 484190.719÷522.2=927.213 kg/hr, 927.213×(648−32)=571.168×$10^3$ kcal/hr=2391.4×$10^3$ kJ/hr.

(2) Sensible heat held by the supply air

Taking the supply air conditions in summer as;

DBT=32° C., $\chi$=0.0245, $\nu$=0.898, i=22.6.

and the discharge air conditions in summer as;

DBT=84° C.,

DP=58° C., $\chi$=0.135, $\nu$=1.23, i=106.

gives the following values (when 0° C. is used as a reference, and the sir conditions are ignored when the outside air is used as a reference), $[619.057\div(0.135-0.0245)]\times22.6=126.612\times10^3$ kcal/hr= $530.1\times10^3$ kJ/hr.

Incidentally, the discharge amount is as follows;

$[619.057\div(0.135-0.0245)]\times1.23\div60=114.848$ $m^3$/min (2) Heat output (1) The sensible heat taken away by the hood discharge gas (based on an outside temperature of 32° C.) is;

$[619.057\div(0.135-0.0245)]\times(106-22.6)=467.233971\times10^3$ kcal/hr=$1956.2\times10^3$ kJ/hr.

(2) The sensible heat taken away by the drain, when the discharge drain temperature is 86° C. assuming drain heat exchange and flash heat exchange are as follows;

$927.213\times(86-32)=50.069\times10^3$ kcal/hr=$209.6\times10^3$ kJ/hr.

(3) The radiation losses of the hood are simply taken away from the total heat input;

$571.168-467.234-50.070-8.631-1.442=43.791\times10^3$ kcal/hr=$183.3\times10^3$ kJ/hr.

(4) The sensible heat of the bone dry paper stock is;

$8.631\times10^3$ kcal/hr=$36.1\times10^3$ kJ/hr.

(5) The sensible heat of the moisture content in the paper stock is;

$1.442\times10^3$ kcal/hr=$6.04\times10^3$ kJ/hr.

(3) Thermal efficiency and steam consumption rate (1) If the thermal efficiency is calculated from the amount of heat necessary for evaporating the water content, the thermal efficiency gives;

$(378.553\div571.168)\times100=66.277\%$ (Note)

If the thermal efficiency is calculated based on the boiler thermal efficiency as 90% compared to the impingement drying method (in the case of a heavy oil boiler, the S content compared to a gas boiler is high so that the exit temperature of the heat recovery gas unit is increased), then the heat amount of the boiler fuel as 634.631 kcal/hr=2657.1 kJ/r, the efficiency becomes 59.65%.

(2) The amount of steam used per paper stock bone dry weight is;

$927.213\div507.384=1.827$ kg/kg.

(4) The required heat per paper BD ton

When a comparison is made with an example 1 described in the first embodiment using a super-heated steam at 250° C. The required heat per paper BD ton using the conventional pressure vessel-type drying cylinder is $634.631\div0.507384=1250.79\times10^3$ kcal. When 250° C. superheated steam is blown, this is $158.5\times10^3$ kcal. Consequently, it is seen that the necessary amount of heat is 1/7.9.

EXAMPLE 2

In a manufacturing method for sheet material executing the present invention, a calculation of the heat balance at an absolute humidity $_\chi$=1 kg/kg'DA, is described with an example using heated moist air with a dry bulb temperature of at least 150° C. and dew-point temperature of at least 65° C., from the results in the test plant and thermal engineering calculations for heat balance of the super-heated steam restraining impingement drying apparatus (at a sheet production tonnage of 507.384 BDkg/hr, and 619.057 kg/hr evaporation water rate). Assuming that the high temperature high dew point air at an outlet of the impingement hood nozzle are at an temperature equal to the that of SHS and at the absolute humidity is 100%. That is;

t=250° C., $_\chi$=1.0 kg/kg' DA, $\nu=[0.4555\times(1+0.622)\times(273.16+250)]/100=3.865$ $m^3$/kg' DA, $i=(0.24\times250)+[(597.3+0.441\times250)]\times1=767.55$ kcal/kg' DA=3213.6 kJ/kg' DA.

The relative humidity is 1.54%, the wet-bulb temperature becomes 88.72° C., and the dew point temperature is 84.79° C. (that is, these numbers are within a range of claims of the invention).

An oxygen concentration is 8.05%, which is within a fire extinguishing range so that the danger of fire is minimal.

The temperature t° C. of the air, the specific volume $vm^3$/kg' DA, and the specific heat i kcal/kg' DA are calculated as follows:

$t=(i-597.3_\chi)\div(0.240+0.441_\chi)$, $\nu=0.4555(_\chi+0.622)T/100$, $i=0.240t+(597.3+0.441t)_\chi$.

The gas flow rate within a range between the impinging nozzle and the suction fabric belt is;

in total 2130.393 $m^3$/min, 551.201 kg' DA/min, the dry air amount is 33072.078 kg' DA/hr, and the water vapor amount is the same as 33072.078 kg DA/hr, so that the total moist air amount is 66144.156 kg/hr, $25384.473\times10^3$ kcal/hr.

The HA conditions at the air cap before discharging to the moist air to the atmosphere is as below (before mixing with supply air), which includes the evaporated vapor from the wet sheet, is subtracted the heat output as, $i=[(33072.078\times767.55)-(10073+25382+15,427)]\div33072.078=766.011$ kcal/kg'=3207.1 kJ/kg', $t=[766.011-(597.3\times1.019)]\div[0.24+(0.441\times1.019)]=228.267°$ C.

$\nu=0.4555(1.019+0.622)T/100=3.748$ $m^3$/kg' DA, $_\chi=[(2130.393/3.865)\times1.0+10.318]\div551.201=1.019$ kg/kg', and the HA conditions after discharging from the circulation heating exchanger and after mixing with air supply are:

$i=[(33072.078-(10073+25382+15427))\times753.575+(622.481\times22.6)]\div33072.078=766.011$, $t=[766.011-(597.3\times1.0)]\div[0.24+(0.441\times1.0)]=228.267$, $\nu=0.4555(1.0+0.622)T/100=3.748$ $m^3$/kg' DA Consequently, the required heat at the heat exchanger of the circulating high temperature high dew point air after completing a predetermined air supply and discharge cycle is;

$33,072.078\times(767.55-752.019)=513.642\times10^3$ kcal/hr= $2150.5\times10^3$ kJ/hr.

When considering per a bone dry weight (BD) kg, the above heat can be converted to 1012.334 kcal/kg=4238.4 kJ/kg (109.7% compared to the SHS of example 1).

Furthermore, the heat per evaporated water content kg is calculated as; 829.717 kcal/kg 3473.9 kJ/hr.

If the above calculation results are expressed as the thermal efficiency, the following values are obtained:

(1) Heat input

The calorific value of the boiler fuel is obtained by totalizing the following heat outputs:

$545.599\times10^3$ kcal/hr=2284.3 kJ/kg.

(2) Heat output (1) The sensible heat taken away by the hood discharge gas (based on an discharge temperature of 228.267° C. and an outside air temperature of 32° C.) is $622.481\times(766.011-22.6)=462.759\times10^3$ kcal/hr (=$1925.1\times10^3$ kJ/hr), and if a heat exchanger (Eco) is installed for heat exchanging the heat between the hood discharge and the supply air, the heat loss of the discharge gas can be reduced. However the absolute humidity of the air supply is low and the enthalpy value also is low, so that the recoverable heat is minimal. White water heating is advantageous, however the sheet forming conditions differ depending on the sheet types. Therefore these conditions are omitted in the following thermal engineering calculations.

(2) Sensible heat of the boiler discharge gas (based on an outside air temperature of 32° C.) is;

474.129 kcal/Nm$^3$×54.834 Nm$^3$/hr=25.998×10$^3$ kcal/hr=108.8×10$^3$ kJ/hr (3) Loss of heat in boiler by incomplete combustion is;

0.788 kcal/Nm$^3$×54.834 Nm$^3$/hr=0.043×10$^3$ kcal/hr=0.180×10$^3$ kJ/hr.

(4) Other loss by radiant heat transmission at the boiler itself are, 5.917×10$^3$ kcal/hr=24.8×10$^3$ kJ/hr (5) Other losses from the paper machine hood and duct are;

25.382×10$^3$ kcal/hr=106.3×10$^3$ kJ/hr (6) Sensible heat difference at the inlet and outlet of the paper machine hood is;

8.631×10$^3$ kcal/hr=36.1×10$^3$ kJ/hr.

(7) Sensible heat difference at the inlet and outlet of the paper machine is;

1.442×10$^3$ kcal/hr=6.04×10$^3$ kJ/hr.

(8) Other losses are;

15.427×10$^3$ kcal/hr=64.6×10$^3$ kJ/hr.

(3) Thermal efficiency, that is, consequently heat exchange efficiency is;

378.553÷545.599=69.38%

EXAMPLE 3

In a manufacturing method for sheet material where the method the present invention is executed, a heat balance calculation at a condition of the absolute humidity $\chi$=0.25 kg/kg'DA, is described with an example using heated moist air with a dry bulb temperature of at least 150° C. and dew-point temperature of at least 65° C., based on the test plant results and thermal engineering calculations for heat balance of the super-heated steam restraining impingement drying apparatus (at a paper production tonnage of 507.384 BDkg/hr, and 619.057 kg/hr evaporation water). It is assumed that the conditions of the high temperature high dew point air at the outlet of the impingement hood nozzle as that the temperature is equal that of SHS and the absolute humidity is 25%. That is; t=250° C., $\chi$=0.25 kg/kg' DA, v=[0.4555×(0.25+0.622)×(273.16+250)]/100=2.078 m$^3$/kg' DA, i=(0.24×250)+[(597.3+0.441×250)]×0.25=236.888 kcal/kg' DA=991.8 kJ/kg' DA. The relative humidity becomes 0.72%, the wet-bulb temperature becomes 74.16° C., the dew point temperature becomes 67.6° C. (that is, one example in the claims of the invention). An oxygen concentration at 14.98% has no fire extinguishing function.

The gas flow rate between the impingement nozzle and the suction fabric belt is; in total 2130.393 m$^3$/min, 1025.21 kg' DA/min, the dry air amount is 61512.79 kg' DA/hr, and the water vapor is 15378.198 kg DA/hr, so that the total moist air amount is 76890.989 kg/hr, 14571.642×10$^3$ kcal/hr.

The HA conditions at the air cap output before discharging the moist air to the atmosphere is as below (before mixing with supply air), which include the evaporated vapor from the wet sheet, is subtracted from the heat output as, i=[(61512.791×236.88)−(10073+25382+24052)]÷61512.791=235.921 kcal/kg' DA=987.75 kJ/kg' DA, t=[235.921−597.3×0.260064)]÷[0.24+(0.441×0.260064)]=227.199° C., v=0.4555(0.260064+0.622)T/100=2.010 m$^3$/kg' DA $\chi$=(1,025.213×0.25+10.31762)÷1,025.213=0.260064 kg/kg', and the HA conditions after discharging before the circulating heat exchanger, after mixed with supply air are:

i=[(61512.791−2627.978)×235.921+(2627.978×22.6)]÷61512.791=226.807 kcal/kg' DA=949.6 kJ/kg' DA, t=[226.807−(597.3×0.25)]÷(0.24+0.441×0.25)=221.219° C.

v=0.4555(0.25+0.622)T/100=1.964 m$^3$/kg' DA.

Consequently, the required heating amount for the circulating high temperature high dew point air heat exchange after completing a predetermined air supply and discharge is;

61512.791×(236.888−226.807)=620.110×10$^3$ kcal/hr=2596.3×10$^3$ kJ/hr

When converting the heat per bone dry weight (BD) kg of paper, the heat value is 1222.171 kcal/kg (132.4% compared to the SHS of example 1). Furthermore, the heat per evaporated water content kg is; 1001.701 kcal/kg=4193.9 kJ/hr.

If the above results are expressed as thermal efficiency, these become as follows:

(1) Heat input

The calorific value of the boiler fuel is obtained by totalizing the following heat outputs:

657.405 kcal/hr=2752.4 kJ/hr.

(2) Heat output (1) The sensible heat taken away by the hood discharge gas (based on an outside air temperature of 32° C.) is;

2,627.978×(235.921−22.6)=560.603×10$^3$ kcal/hr=2347.1×10$^3$ kJ/hr.

(2) Boiler discharge gas sensible heat (based on an outside air temperature of 32° C.) is; 474.129 kcal/Nm$^3$×66.071 Nm$^3$/hr=31.326×10$^3$ kcal/hr=131.2×10$^3$ kJ/hr (3) Boiler incomplete combustion loss is; 0.788 kcal/Nm$^3$×66.071 Nm$^3$/hr=0.052×10$^3$ kcal/hr=0.22×10$^3$ kJ/hr.

(4) Other losses of radiant heat transmission at the boiler itself are, 5.917×10$^3$ kcal/hr=24.8×10$^3$ kJ/hr.

(5) Other losses from the paper machine hood and duct are;

25.382×10$^3$ kcal/hr=106.3×10$^3$ kJ/hr.

(6) Paper stock sensible heat difference at the paper machine hood outlet and inlet is;

8.631×10$^3$ kcal/hr=36.1×10$^3$ kJ/hr.

(7) Water content sensible heat difference at the paper machine outlet and inlet is;

1.442×10$^3$ kcal/hr=6.04×10$^3$ kJ/hr.

(8) Other losses are;

24.052×10$^3$ kcal/hr=100.7×10$^3$ kJ/hr.

(3) Thermal efficiency, that is, conseqently heat exchange efficiency is;

378.553÷657.405=57.58%

EXAMPLE 4

In a manufacturing method for sheet material wherein the method of the present invention is executed, a heat balance calculation with absolute humidity $\chi$=0.05 kg/kg'DA, is described with an example using heated moist air with a dry bulb temperature of at least 150° C. and dew-point temperature of at least 65° C., from test plant substantiation results and thermal engineering calculations for heat balance of the super-heated steam restrained impingement drying apparatus (the sheet production tonnage of 507.384 kg/hr BDkg of paper, and 619.057 kg/hr evaporation water). Conditions of high temperature high dew point air at the outlet of the impingement hood nozzle showed that the temperature is equal that of SHS and the absolute humidity is 5.0%. That is;

t=250° C., $_{\chi}$=0.05 kg/kg' DA,

ν=[0.4555×(0.05+0.622)×(273.15+250)]/100=1.601 $m^3$/kg' DA, i=(0.24×250)+[(597.3+0.441×250)]×0.05=95.378 kcal/kg' DA=399.3 kJ/kg' DA.

The relative humidity becomes 0.19%, the wet-bulb temperature becomes 58.42° C., the dew point temperature becomes 40.49° C. (that is, these values are outside of a range of the claims of the present invention). An oxygen concentration at 19.44% has fire danger.

The gas flow rate between the impingement nozzle and the suction fabric belt is; in total 2130.393 $m^3$/min, 1330.664 kg' DA/min, the dry air amount is 79839.838 kg' DA/hr, and the water vapor is 3991.992 kg DA/hr, so that the total moist air amount is 83831.830 kg/hr, 7614.964×$10^3$ kcal/hr.

The HA conditions at the air cap outlet before discharging the moist air to the atmosphere is as below (before mixing with supply air), which include the evaporated vapor from the wet sheet, is subtracted from the heat output as, i=[(79839.838×95.378)−(10073+25382+33740)]÷79839.838=94.511 kcal/kg' DA=395.70 kJ/kg' DA, t=[94.511−(597.3×0.057754)]÷(0.24+0.441×0.057754)=226.069° C.

ν=0.4555(0.057754+0.622)T/100=1.546 $m^3$/kg' DA, $_{\chi}$=(1330.664×0.05+10.318)÷1330.664=0.057754 kg/kg' and the HA condition before the circulating heat exchanger, after discharge and after air supply mixing is:

i=[79839.838−18616.017]×94.511+(18616.017×22.6)]÷79839.838=77.744 kcal/kg' DA=325.5 kJ/kg' DA, t=[77.744−(597.3×0.05)]÷(0.24+0.441×0.05)=182.709° C.

ν=0.4555(0.05+0.622)T/100=1.395 m/kg' DA.

Consequently, the required heating amount for the circulating high temperature high dew point air heat exchange after completing a predetermined air supply and discharge is;

79839.838×(95.378−77.744)=1407.896×$10^3$ kcal/hr=5894.6×$10^3$ kJ/hr.

Per bone dry weight (BD) kg, this is 2774.814 kcal/kg (300.7% compared to the SHS of example 1). Furthermore, the heat per evaporated water content kg is; 2274.259 kcal/kg.

The above results can be expressed as thermal efficiency as follows:

(1) Heat input

The calorific value of the boiler fuel is obtained by totalizing the following heat outputs:

1484.673×$10^3$ kcal/hr=6216.03×$10^3$ kJ/hr.

(2) Heat output (1) The sensible heat taken away by the hood discharge gas (based on an outside air temperature of 32° C.) is;

18616.017×(94.511−22.6)=1338.696×$10^3$ kcal/hr=5604.8×100 kJ/hr.

(2) Boiler discharge gas sensible heat (based on an outside air temperature of 32° C.) is; 474.129 kcal/$Nm^3$×149.214 $Nm^3$/hr=70.747×$10^3$ kcal/hr=296.2×$10^3$ kJ/hr (3) Boiler incomplete combustion loss is;

0.788 kcal/$Nm^3$×149.214 $Nm^3$/hr=0.118×$10^3$ kcal/hr=0.49×$10^3$ kJ/hr.

(4) Other losses of radiant heat transmission at the boiler itself are, 5.917×$10^3$ kcal/hr=24.8×$10^3$ kJ/hr.

(5) Other losses from the paper machine hood and duct are;

25.382×$10^3$ kcal/hr=106.3×$10^3$ kJ/hr.

(6) Paper stock sensible heat difference at the paper machine hood outlet and inlet is;

8.631×$10^3$ kcal/hr=36.1×$10^3$ kJ/hr.

(7) Water content sensible heat difference at the paper machine outlet and inlet is;

1.442×$10^3$ kcal/hr=6.04×10 kJ/hr.

(8) Other losses are;

33.740×$10^3$ kcal/hr=141.3×$10^3$ kJ/hr.

(3) Thermal efficiency

Consequently heat exchange efficiency is;

378.553÷1,484.673=25.50%

EXAMPLE 5

In a manufacturing method for sheet material wherein the method of the present invention is executed, a heat balance is calculated at the absolute humidity $_{\chi}$=0.025 kg/kg' DA, is described with an example using heated moist air with a dry bulb temperature of at least 150° C. and dew-point temperature of at least 65° C., from test plant substantiation results and thermal engineering calculations for heat balance of the super-heated steam restrained impingement drying apparatus (at a bone dry BD kg of the sheet production tonnage of 507.384 kg/hr, and 619.057 kg/hr evaporation water). Conditions of the high temperature high dew point air at the outlet of the impingement hood nozzle, the temperature is equal that of SHS and the absolute humidity is 25.0%. That is;

t=250° C., $_{\chi}$=0.025 kg/kg' DA,

ν=[0.4555×(0.025+0.622)×(273.16+250)]/100=1.542 $m^3$/kg' DA, i=(0.24×250)+[(597.3+0.441×250)]×0.025=77.689 kcal/kg' DA=325.3 kJ/kg' DA.

The relative humidity becomes 0.097%, the wet-bulb temperature becomes 54.56° C., the dew point temperature becomes 28.65° C. (that is, an example outside the claims of the invention). An oxygen concentration at 20.19% has fire danger.

The gas flow rate between the impingement nozzle and the suction fabric belt is; in total 2130.393 $m^3$/min, 1381.578 kg' DA/min, the dry air amount is 82894.669 kg' DA/hr, and the water vapor is 2072.367 kg DA/hr, so that the total moist air amount is 84967.036 kg/hr, 6440.004×$10^3$ kcal/hr.

The HA conditions at the air cap outlet before discharging the moist air to the atmosphere is as below (before mixing with supply air), which include the evaporated vapor from the wet sheet, is subtracted from the heat output as, i=[(82967.036×77.689)−(10073+25382+38124)]÷82,967.036=76.801 kcal/kg' DA,=321.6 kj/kg' DA, t=[76.801−(597.3×0.032468)]÷(0.24+0.441×0.032468)=225.732° C.

$v=0.4555(0.032468+0.622)T/100=1.487\ m^3/kg'$ DA, $_{\chi}=(1381.578\times0.025+10.318)\div1381.578=0.032468$ kg/kg', and the HA conditions before circulating the heat exchanger after discharge and after mixed with the supply is:

$i=[(82948.462-77741.684)\times71.856+(77741.684\times22.6)]\div82894.669=26.001$ kcal/kg' DA=108.9 kJ/kg' DA, $t=[26.001-(597.3\times0.025)]\div(0.24+0.441\times0.025)=44.093°$ C.

$v=0.4555(0.025+0.622)T/100=0.935\ m^3/kg'$ DA.

Consequently, the required heating amount for the circulating high temperature high dew point air in the heat exchange after completing a predetermined air supply and discharge is;

$82894.669\times(77.689-26.001)=4284.660\times10^3$ kcal/hr= $17939.0\times10^3$ kJ/hr.

The heat value per bone dry weight (BD) of kg is 844.610 kcal/kg (915.1% compared to the SHS of example 1). Furthermore, the heat per evaporated water content kg is 6921.269 kcal/kg=28792.5 kcal/kg.

If the above computation results are expressed as thermal efficiency, these become as follows:

(1) Heat input

The calorific value of the boiler fuel is obtained by totalizing the following heat outputs:

$4505.584\times10^3$ kcal/hr=$18864.0\times10^3$ kJ/hr.

(2) Heat output (1) The sensible heat lost by the hood discharge gas (based on an outside air temperature of 32° C.) is;

$77692.901\times(76.801-22.6)=4211.033\times10^3$ kcal/hr= $17630.8\times10^3$ kJ/hr.

(2) Boiler discharge gas sensible heat (based on an outside air temperature of 32° C.) is; 474.129 kcal/$Nm^3\times452.827$ $Nm^3$/hr=$214.698\times10^3$ kcal/hr=$898.9\times10^3$ kJ/hr.

(3) Boiler incomplete combustion loss is;

0.788 kcal/$Nm^3\times452.827$ $Nm^3$/hr=$0.357\times10^3$ kcal/hr= $1.49\times10^3$ kJ/hr.

(4) Other losses of radiant heat transmission of the boiler itself are, $5.917\times10^3$ kcal/hr=$24.8\times10^3$ kJ/hr.

(5) Other losses from the paper machine hood and duct are;

$25.382\times10^3$ kcal/hr=$106.3\times10^3$ kJ/hr.

(6) Sensible heat difference for the paper stock at the paper machine hood outlet and inlet is;

$8.631\times10^3$ kcal/hr=$36.1\times10^3$ kJ/hr.

(7) Sensible heat difference of water content at the outlet and inlet of the paper machine is;

$1.442\times10^3$ kcal/hr=$6.04\times10^3$ kJ/hr.

(8) Other losses are;

$38.124\times10^3$ kcal/hr=$159.6\times10^3$ kJ/hr.

(3) Thermal efficiency—consequently heat exchange efficiency is;

378.553÷4,505.584=8.40%

Figure 18:
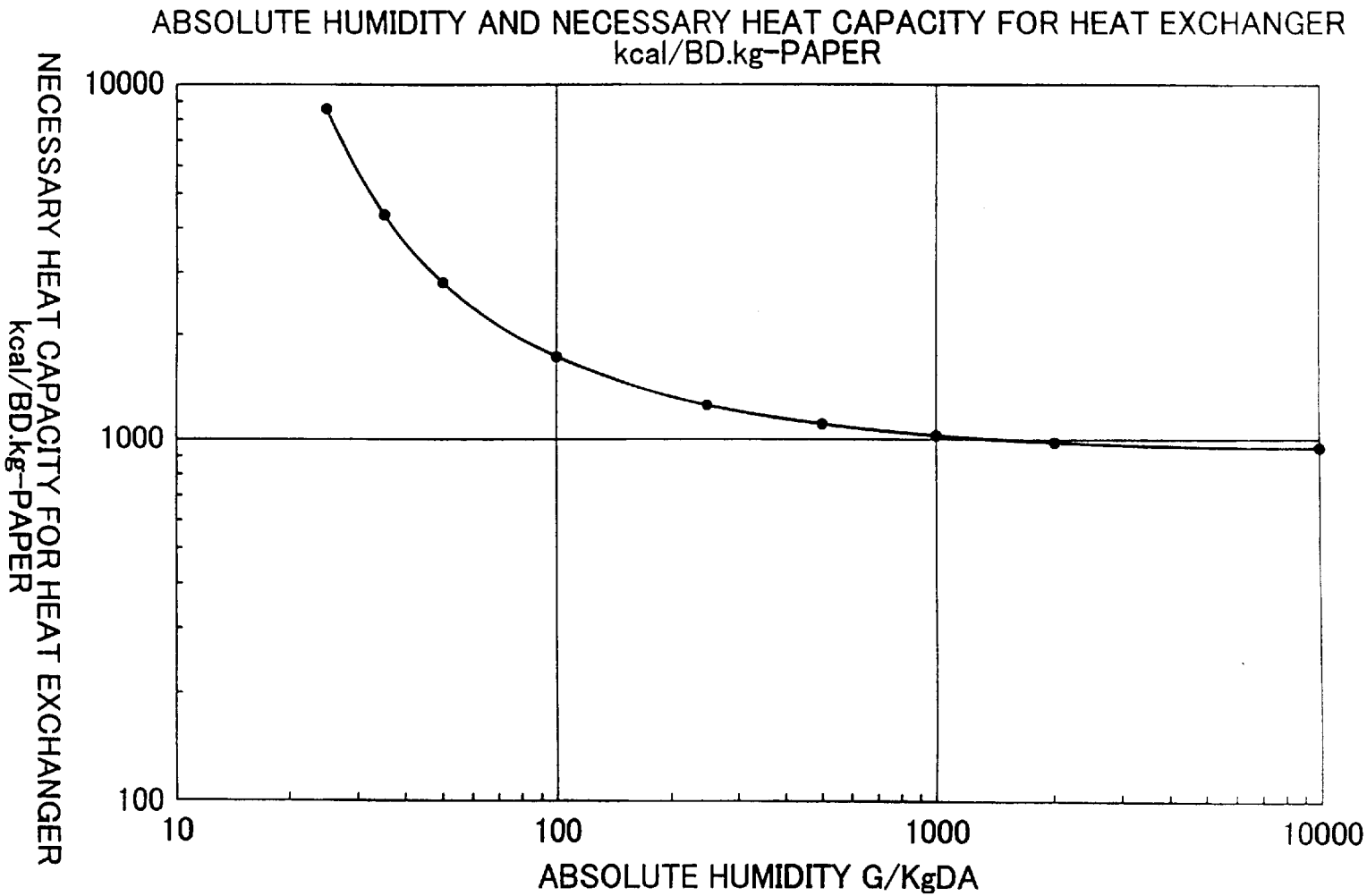
FIG. 18 is a graph showing a relationship between absolute humidity and required heat for heat exchange, in the case where the drying method of the present invention is executed.
Figure 29:
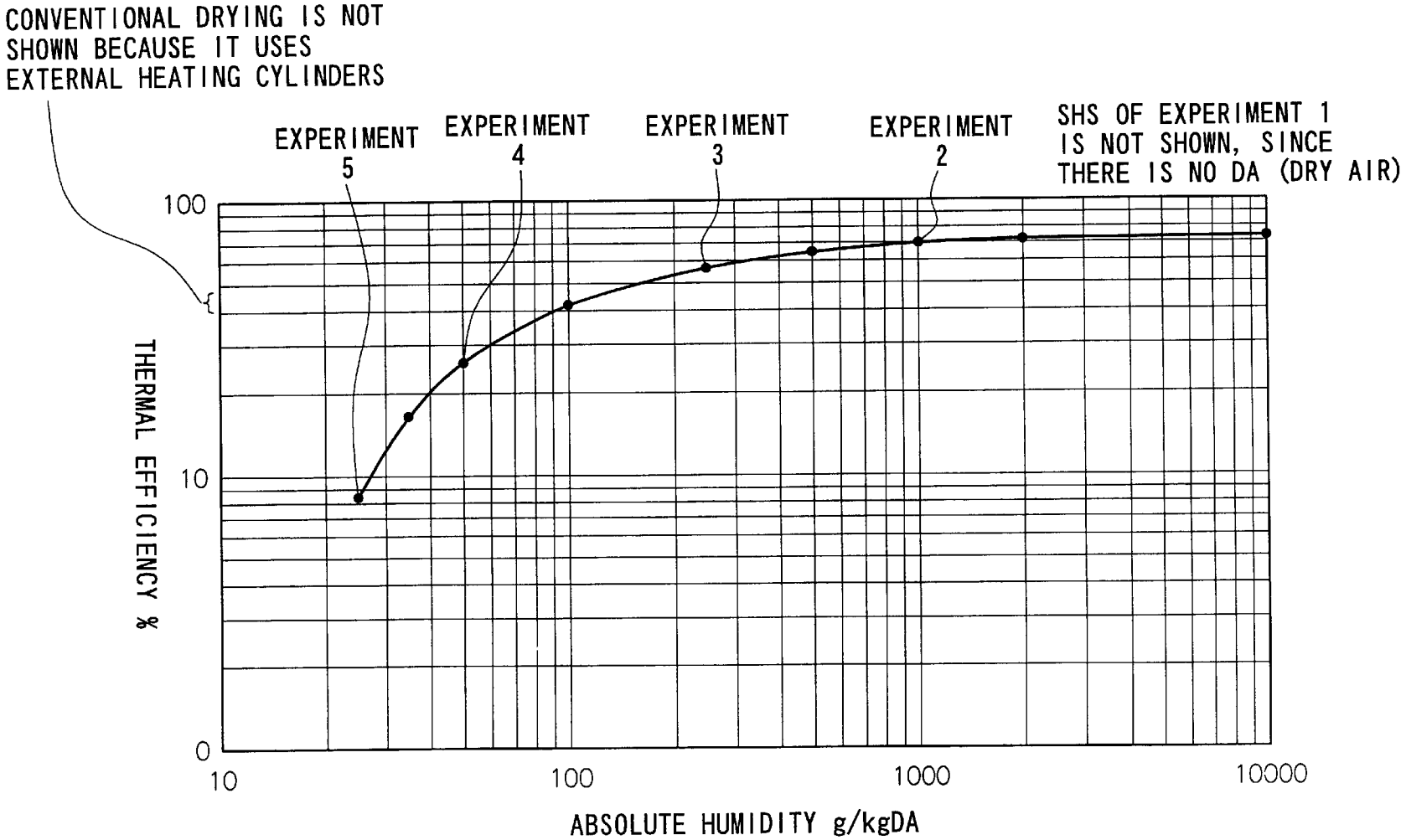
FIG. 29 is a graph showing a relation between absolute humidity and thermal efficiency, in the case where the drying method of the present invention is performed.

The results of example 2 through example 5 and other results are shown in FIG. 18 with the Y axis as the required heat kcal/BD kg paper for the heat exchanger, and the X axis as the absolute humidity $_{\chi}$.G/Kg' DA. Furthermore, in FIG. 29, these are shown with the Y axis as the thermal efficiency %, and the X axis as the absolute humidity $_{\chi}$.G/Kg' DA.

The heat calculation carried out for each paper company is normally based on the supply steam to the inside of the heating cylinder as the heat input. However, in the thermal calculation of the present invention, the boiler thermal efficiency is assumed to be 90%, and the fuel calorific value is compared as a reference. It is a matter of course that the super-heated steam requires a minimal heat and the thermal efficiency also is as high as 76.03%. However, when the high temperature high humidity moist air can be used effectively, if the absolute humidity is increased to, for example $_{\chi}$=100 kg/kg' DA (dew point temperature 96.1° C.), since the required heat for heat exchange with the circulating high temperature high dew point air becomes 944.98 kal/BD kg paper, 3956.4 kJ/BDkg paper (102.4% of the example 1) and the efficiency also can be increased to a high value of 73.86%.

In the conventional thermal efficiency calculation method for the dryer section of the existing paper machine, the latent heat of vaporization of the water content in the sheet, which is basically the heat loss, was made as the effective heat and added for calculating the heat efficiency. However, as described in the present invention, when the total vaporized steam from the wet sheet is recovered, when the recovered steam is used as super-heated steam, it is proposed that the dryer section must be considered as a steam generator, and the thermal efficiency of the dryer must be accounted as the thermal efficiency of the steam generator, that is, the thermal efficiency must be shown as the thermal efficiency of the steam generator by dividing the sensible heat of the recovered steam sensible heat by the total heat input or total heat output. The above concept will be present to the academic society of drying engineering in near future.

In the conventional technique, a paper machine which is operated at a high speed of a maximum of 1,800 m/min, a large amount of air accompanying the sheet and a porous endless fabric belt enter into a loosely sealed hood, so that severe temperature gradients and pressure gradients are generated in the height direction inside the hood. Moreover, depending on the position of the pocket air supply or the bottom air supply etc., and on the location of the discharge duct, the static pressure in the hood becomes unstable and dispersed. Accordingly, external air at low temperature is introduced into the hood through many spaces or openings between the plate metal panels, having built-in heat insulating materials, at a thickness of around 75 to 100 mm forming the hood, and the water vapor in the moist air is partially cooled and condensed, and the condensed and contaminated drops fall on the sheet material surface. Therefore, there are limitation for the dew point temperature at 60° C., for the oxygen concentration at 16.8%, for the absolute humidity at $_{\chi}$=0.1553 kg/kg' DA approximately, and the thermal efficiency is limited from 50 to 55 percent by the boiler fuel calorific value standard.

As described above, according to the present invention, the drying operation of the sheet material is performed inside the sealed hood held at a high temperature gas atmosphere of at least 130° C. while the outside air is completely blocked. In the drying operation, the sheet material is sandwiched between a permeable and heat insulating belt in an endless and a plurality of rotors, and heated by impingement heating, and the sheet material is quickly dried while the expansion and contraction thereof being completely restrained. The excess gas of at least 130° C. (super-heated steam, or heated moist air with a dew-point temperature of at least 65° C., or a mixture of nitrogen gas at above 80% and water vapor at around 5%, which contains oxygen and solvent in small quantities) mainly composed of water vapor newly generated by evaporation from the sheet material, is discharged to outside of the sealed hood and the discharge gas is again circulated and heated to at least 150°

Figure 20:
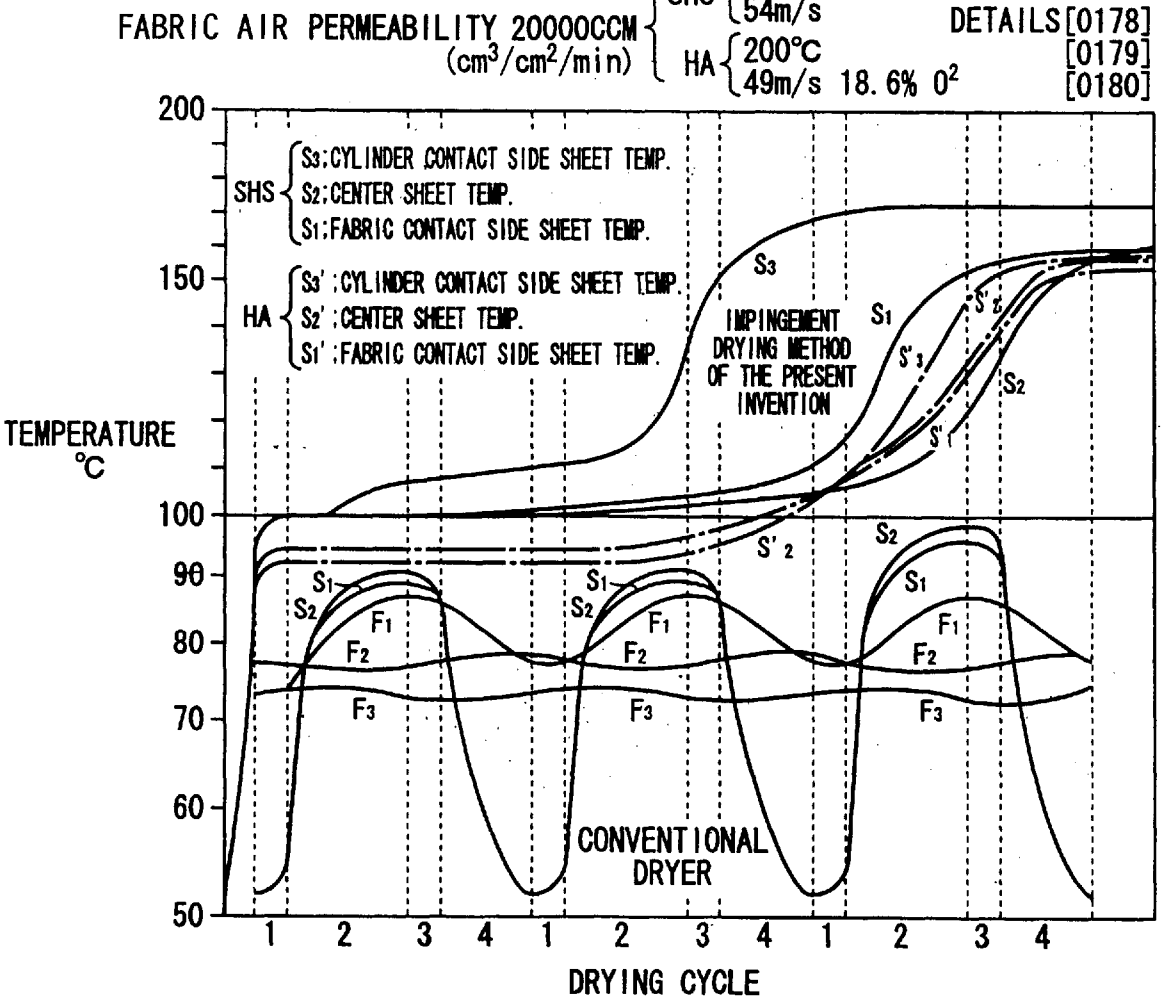
FIG. 20 is a temperature distribution diagram showing the temperature distribution in a sheet and in an endless gas-permeable belt-like body, in the case where the drying method of the present invention is performed with respect to a multi-cylinder type dryer cylinder of a paper-making machine.
Figure 21:
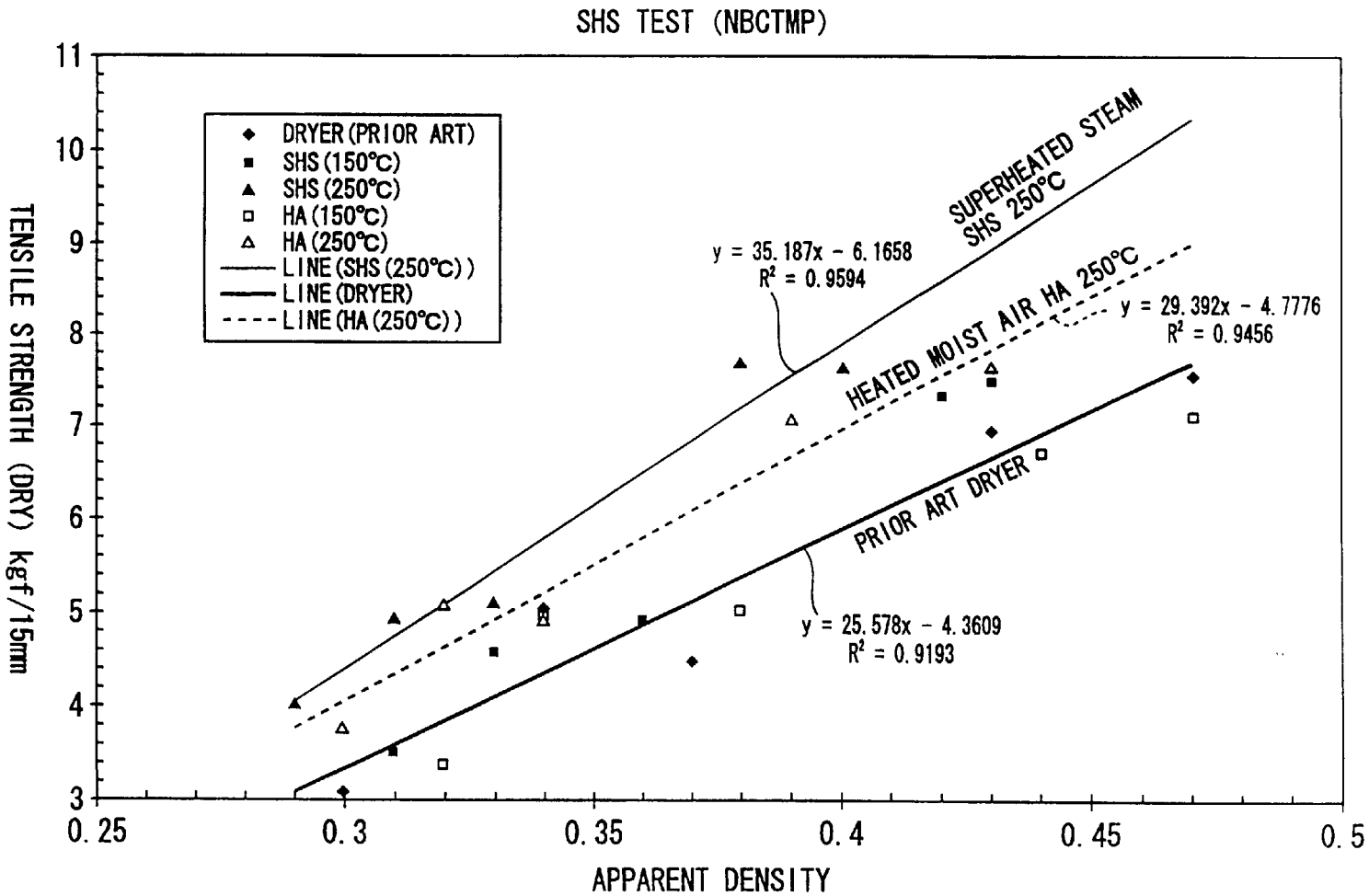
FIG. 21 is a graph showing a relation between tensile strength (DRY) of drying paper (NBCTMP) and apparent density, and gas condition and impingement temperature, in the case where the drying method of the present invention is performed.
Figure 22:
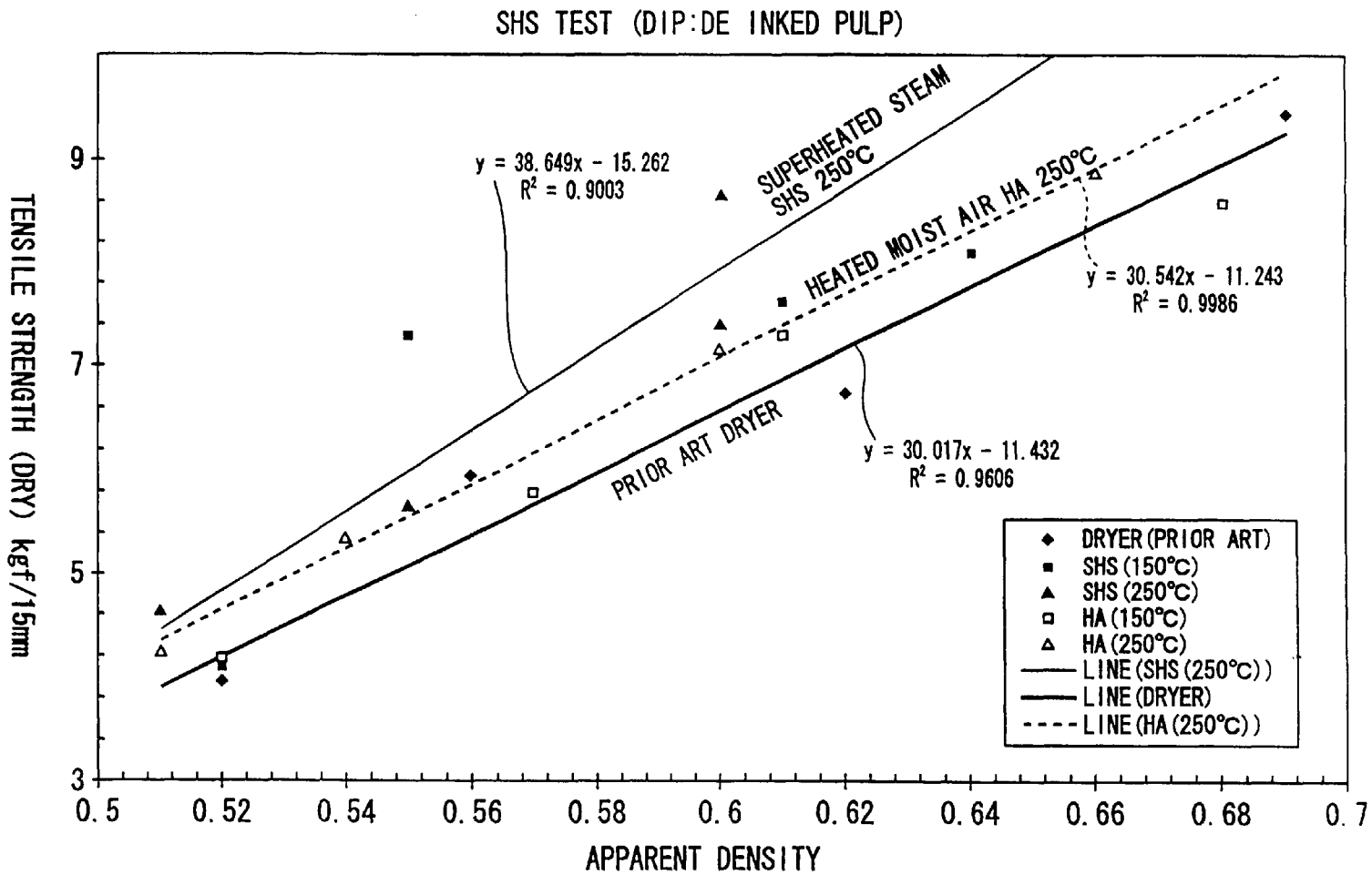
FIG. 22 is a graph showing a relation between tensile strength (DRY) of drying paper (DIP) and apparent density, and gas condition and impingement temperature, in the case where the drying method of the present invention is performed.
Figure 23:
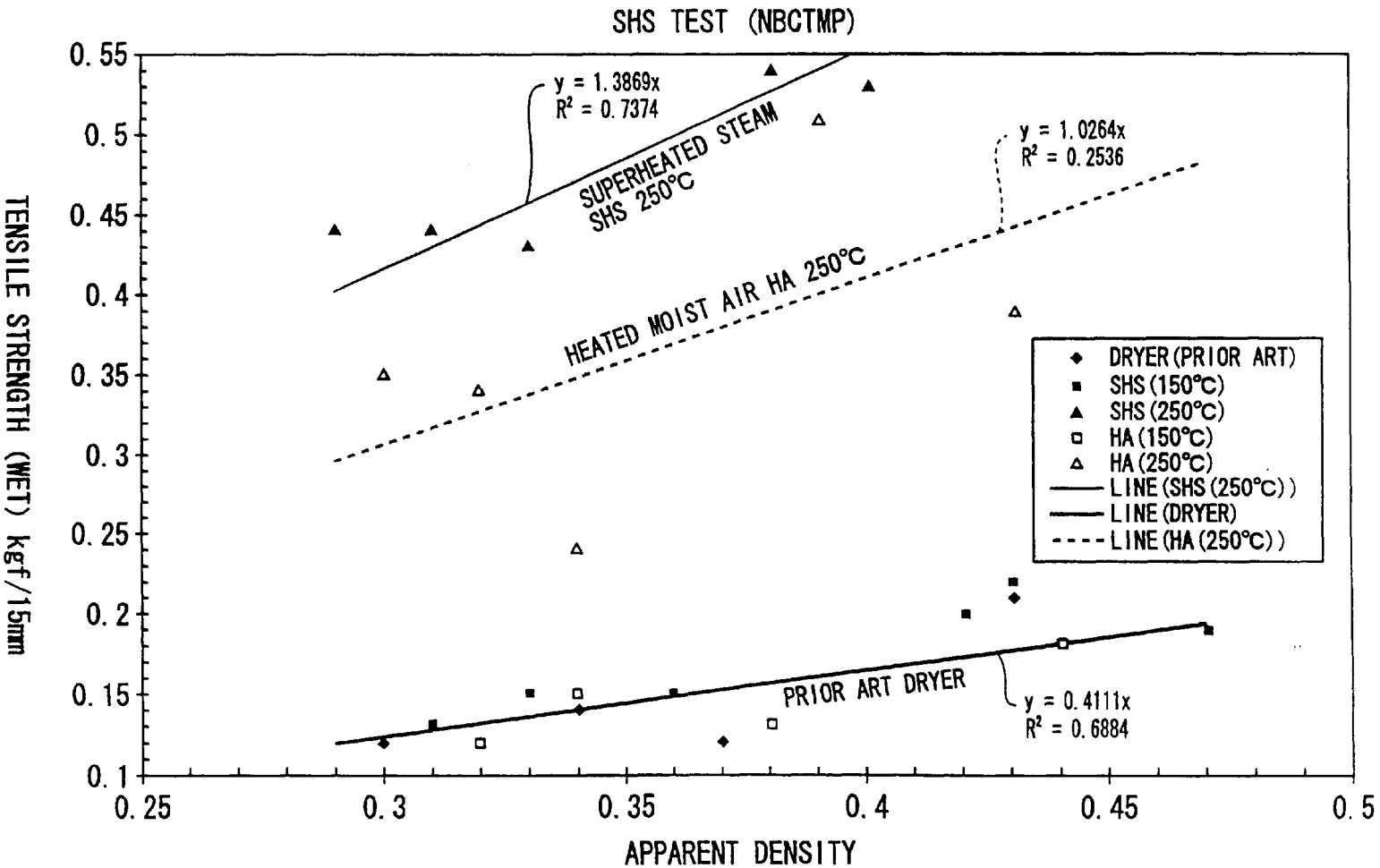
FIG. 23 is a graph showing a relation between tensile strength (WET) of drying paper (NBCTMP) and apparent density, and gas condition and impingement temperature, in the case where the drying method of the present invention is performed.
Figure 24:
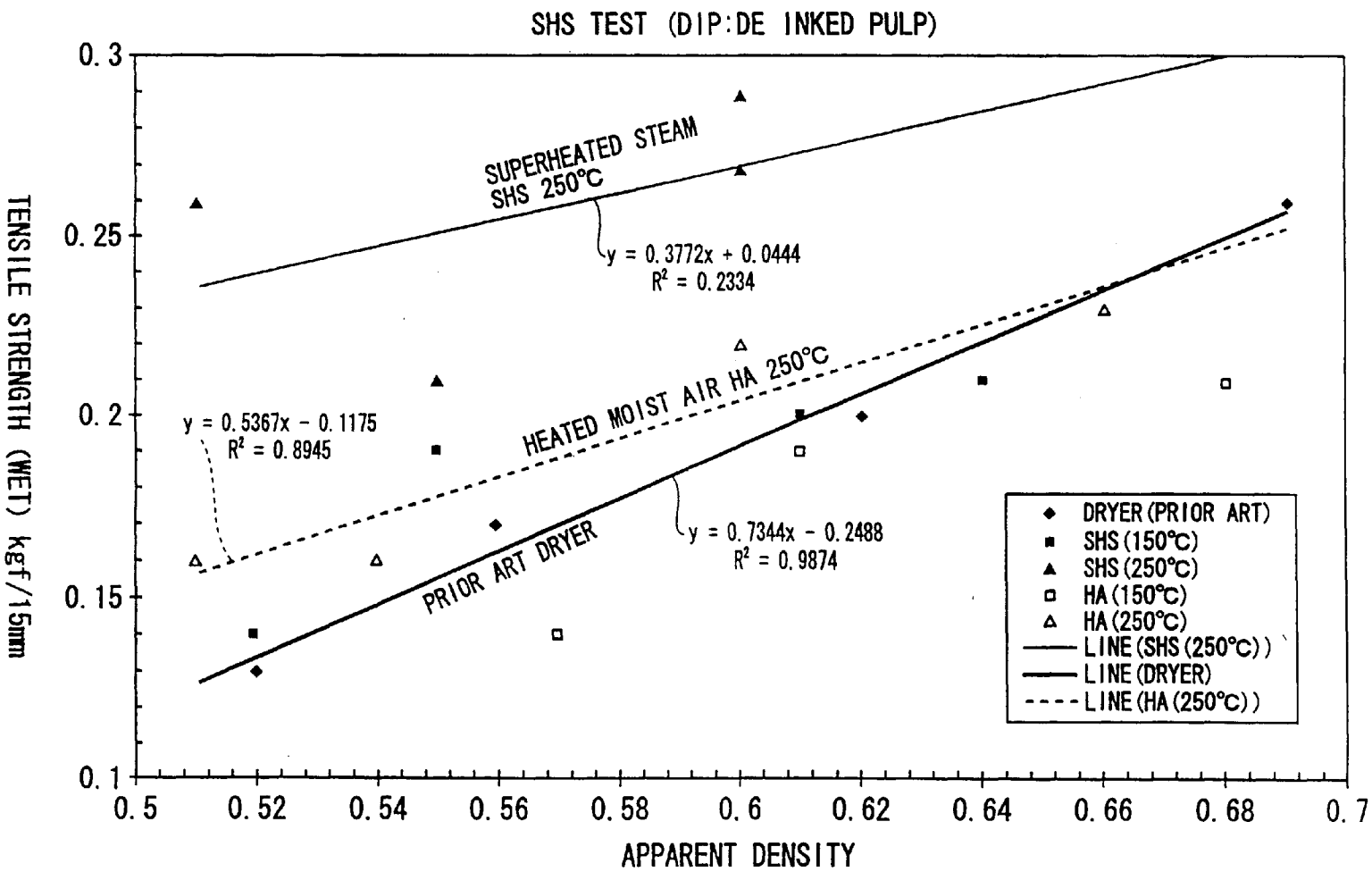
FIG. 24 is a graph showing a relation between tensile strength (WET) of drying paper (DIP) and apparent density, and gas condition and impingement temperature, in the case where the drying method of the present invention is performed.

C. and blown towards the rotors. The excess gas is reused as it is or is reused after adiabatic compression for another heat source. In FIG. 20, as is shown as an example, in which super-heated steam (SHS) at 200° C. is blown as a heated gas, is shown by the solid line, the surface temperature of the rotor 1 is raised immediately by the initial drying to 175° C. and the rotor surface and the contact side sheet temperature $S_3$ also immediately reach 100° C., and as the subsequent drying progresses, the temperature gradually rises, becoming 130° C. when a water content is at around 20%, and 170° C. at a water content of 9%. Moreover, the sheet temperature $S_1$ in contact with the fabric belt 36 reaches 155° C. at an water content of 9%, and the temperature $S_2$ at the center of the sheet also reaches 155° C. at a water content of 9%. Furthermore, the fabric belt temperature in contact with the sheet material 35, the fabric belt temperature at the central portion, and the fabric belt temperature on the outside have a temperature difference of approximately 5° C. between the inside and the outside of the belt ranging from around 110° C. to 105° C. The sheet material is exposed to a super-heated steam atmosphere of around 180° C., and since the sheet material 35 is pressed on the surface of the rotor 1 under a high tension by the fabric belt 36, the water content of the sheet material 35 is rapidly vaporized promoting drying, because the vaporizing surface reaches 1.47 atmosphere which is close to the saturation pressure at 110° C.

In FIG. 20, an example is shown by a chain line, wherein heated air (HA) having a dry-bulb temperature of 200° C. and an absolute humidity of 0.015 kg/kg' DA (oxygen concentration=18.6%, relative humidity=0.15%, enthalpy i=58.3 kcal/kg' DA, wet-bulb temperature t'=48.8° C., dew-point temperature t"=20.4° C., specific volume ν=1.37 $m^3$/kg' DA) is used for blowing as a heated gas. As shown by the chain line, the surface temperature rise of the rotor is slower than that when the super-heated steam is used, but gradually reaches 165° C., and the sheet temperature $S'_3$ in contact with the surface of the rotor rises also slightly slower, and gradually reaches 100° C. Thereafter, as drying process progresses, the sheet temperature gradually rises up to 110° C. when the water content is about 20%, and to 155° C. at a water content of 9%. The sheet temperature $S'_1$ in contact with the fabric belt 36 reaches 153° C. when the water content is 9%, and the temperature $S'_2$ at the center of the sheet also reaches 155° C. at a water content of 9%. When the heated air is used for drying, a large amount of heat for condensation is lost at the initial stage of drying, and hence the ambient temperature stagnates in the vicinity of the dew-point temperature thereof. As a result, rapid evaporation of the water content is difficult differing from the case using the super-heated steam.

The present inventor has paid attention, in the process of development, to the fact that when super-heated steam and heated moist air are used for heating, a different temperature gradient in the cross-sectional direction of the sheet is obtained. That is, when super-heated steam at 200° C. is used, having a heat radiation characteristic, the super-heated steam directly heats the rotor 1, through the fabric belt and the wet sheet and the surface temperature of the rotor rapidly rises up to 175° C., and at the same time, the temperature of the sheet material on the rotor $S_3$ increases rapidly to 170° C. The temperature of the sheet material in contact with the fabric belt $S_1$ slowly reaches 155° C., much later than the sheet temperature in contact with the rotor surface, and the temperature $S_2$ in the center of the sheet also reached 155° C. later than the sheet temperature in contact with the fabric belt $S_1$.

On the other hand, when the heated moist air at the same temperature of 200° C. is used, the surface temperature of the rotor 1 gradually rose to 165° C., and at the same time, the sheet temperature in contact with the rotor $S'_3$ reached 155° C., and the temperature $S'_2$ at the center of the sheet also reached 155° C. slightly later than the sheet temperature on the rotor surface. The sheet temperature on the fabric belt surface $S'_1$ reached 153° C. slightly behind. However, differing from the case of the super-heated steam, the difference of the temperature increasing speed at the sheet surface and at the center of the sheet was very small.

For a test purpose, several sets of humidity sensors and temperature sensors, which were made in the thin membrane shape, were inserted between respective thin sheets of papers having a thickness of as thin as 0.1 mm and after these thin sheets and sensors are laminated, a test sheet of paper is formed by pressing the laminate, and these sensors are connected to the automatic recorders, respectively.

The present inventor considered that the difference between the super-heated steam and the heated moist air is caused by the evaporation mechanism, and the following conclusions were obtained through experiments. At the initial stage of experiments, the rotor was heated by a low pressure steam of 3.8 kg/$cm^2$(=3724 Pa). However, since the discharged drain was extremely overheated and flushed, the inventor stopped supplying the low pressure steam to the rotor, and then it was found that on the contrary, the drying rate increased, and the consumed quantity of heat was decreased. Therefore, the inventor assumed that at the time of heating the rotor from the outside by super-heated steam, which is a heat radiation gas at 149.59° C. or higher, corresponding to the saturation temperature at 3.8 kg/$cm^2$ (=3724 Pa), or by heating by heated air having a high dew-point temperature such as a dew-point temperature of 65° C. or higher, the outside of the rotor is rapidly heated by the radiant heat to cause a temperature rise, moisture within the sheet rapidly evaporates to become steam by the conduction heat due to a difference between the temperature of the outside of the rotor and the temperature of the sheet material in contact with the rotor, and the steam evaporated at the rotor surface passes through the sheet to reach the fabric belt side of the sheet material, and a part of the evaporated steam is condensed due to the temperature difference with that of the fabric belt, thereby increasing the temperature of the sheet material in contact with the fabric belt by the condensation heat transfer. It has been considered that the reason why the temperature in the center portion of the sheet material rises last is due to the heat conduction from both surfaces of the sheet material.

At the time of heating the rotor from the outside by heated moist air having a low dew-point temperature, not having radiative heat transfer characteristic, the outer surface of the rotor is gradually heated mainly by heat convection and thereby gradually increase the temperature of the rotor surface and the water content in the sheet gradually rises through capillary of the sheet material (Note: the capillary flow) by heat conduction due to a temperature difference between the outer surface of the rotor and the wet sheet material in contact with the outer surface of the rotor, to reach the fabric belt side of the sheet material, and on this surface, the water content evaporates to be steam and the steam passes through the fabric belt repeating condensation and re-evaporation, finally reaches the surface of the sheet material, and evaporates to become steam. Therefore, the temperature distribution within the sheet is formed such that the temperature of the sheet material gradually increases in an order from the rotor side surface, through the central part, to the fabric belt surface.

On the other hand, in the conventional drying process using the internal heated dryer cylinders in an atmosphere of moist air, the temperature of the sheet material fluctuates in a large extent, as shown in the lower half of FIG. 20, during progress of the drying cycle from Phase 1 to Phase 4, the temperature of the sheet material changes from the sheet temperature $S_2$ in contact with the cylinder 1, to the sheet temperature $S_1$ in contact with the fabric belt 36, the temperatures of the fabric belt changes as shown by the fabric belt temperature $F_1$ in contact with the sheet 35, the fabric belt temperature $F_2$ at the central part, and the outside temperature of the fabric belt $F_3$, and the temperature of the sheet material changes from 50° C. to 100° C. The water content in the sheet material 35 is only preheated and evaporation does not occur in Phase 1 until the cylinder and the sheet start to adhere to each other, and evaporation of the water content gradually progresses in Phase 2. However, in Phase 2 where the pocket portion in the sealed hood has a dew-point temperature of about 60 to 70° C., the water content evaporated from the sheet material is condensed in the sheet material and even when the water content of the sheet reaches the surface of the fabric belt, the water content evaporated at the contact surface with the fabric belt is condensed in the fabric belt and after repeating the cycles of evaporation and condensation in the fabric belt, the water content is condensed in the fabric belt to thereby obstructing the evaporation from the sheet. The sheet material 35 then reaches Phase 4, wherein the sheet material travels free and the water content in the sheet material evaporates into the surrounding moist air. Owing to the evaporation latent heat, the sheet temperature rapidly decreases to about 50° C., and the conditions return to the above described Phase 1 wherein the sheet is preheated again. As a result, the cycle becomes an interrupted drying cycle, which requires a long period of time for drying, thereby causing a loss in thermal energy.

Moreover, in Phase 4 where the sheet material travels in a free manner, the sheet material 35 freely shrinks in the cross direction due to drying, thereby the physical strength of the paper in the longitudinal direction (machine drawing direction MD) and in the cross direction (cross direction CD) changes. As a result, dimensional stability is deteriorated, and curling and cockling occur, thereby causing a degradation of printability. Also, since paper differs from plastic films, many fibrillated fibers are laminated forming a multilayer structure, causing three-dimensional crosslinking of fibers during drying. In drying process using moist air as a medium, as drying progresses, there is a difference in the drying process between a portion where the fibrillated fiber structure is dense and a portion where the fiber structure is coarse. In the coarse portion, since the absolute water content approaches zero, thereby cockling or curling such as CD curling or MD curling may occur in the paper.

Furthermore, the drying process of the present invention does not includes the Phase 1 and Phase 3 in the conventional drying process, and the drying process of the present invention mainly includes Phase 2 where the sheet material is sandwiched between the rotor 1 and the fabric belt 36 and Phase 4 wherein, while reaching to the next rotor, although the sheet material 35 is separated from the rotor 1, the sheet material travels by being sucked and restrained by the suction fabric belt roll 8 or both sides of the sheet material 35 being sandwiched between two fabric belt 36 and restrained. Both of these phases are in a heated gas atmosphere of at least 130° C. Therefore, drying is promoted through the whole period, and is completed within a short period of time, thereby contributing to energy saving. Moreover, since the sheet material 35 is always dried while being restrained, the dimensional stability is excellent (extensibility in water and elongation in air is small), curling and cockling do not occur, and hence printability is quite excellent. According to the method of the present invention, there is no free traveling zone as in the conventional method, and the sheet material is always restrained. Therefore, even if the sheet is torn, the sheet material can be carried outside from the drying hood exit.

The inventor has realized a rapid heating of the sheet material 35 at the entry section 60 of the sealed hood 17 by giving a large amount heat to the sheet material 35 by partially condensing by giving latent heat of heated gas to the sheet material 35 while clamping thereof, by providing a steam box 43 and a suction box 40 above and below at the entry section 60 of the sealed hood 17, particularly at the initial stage of drying where the sheet temperature is low, to thereby a large amount of heat is available by the condensing heat transfer instantaneously. Therefore, a forecast can be obtained to solve the problem associated with the speed-up the conventional paper machine, such as the frequently occurring wet paper break trouble because of the low temperature sheet adheres to the heating cylinder surface. Moreover, the present invention blows a circulated and heated gas of at least 150° C. to the sheet material 35 from the blower port 19 through the permeable fabric belt 36 to evaporate a large amount of water content in the sheet material 35 instantaneously. In particular, while the water content in the sheet is wet, that is, from the time before the sheet temperature has risen rapidly and reached about 100° C. until the time when the water content in the sheet reaches 26% from 32% at a critical point thereof, the water content in the sheet evaporates at the spot to become steam, and the steam passes through the sheet material through the pressure flow. The sheet becomes porous since voids in the sheet increase rapidly due to the rapid volume expansion, and becomes bulky. In the conventional machine where drying is performed in a heated moist air having a dew-point temperature of not higher than 60° C., even if the cylinders are heated up to 250° C., only the sensible heat of steam can be used, and the quantity of thermal transfer per volume in the low humidity heated air is only a level of one tenth compared to that of super-heated steam or high dew point temperature heated moist air. As a result, it becomes necessary to increase the temperature considerably, and since the oxygen concentration is as high as about 20%, when the sheet material is dried, there is a risk of combustion or a risk that the fiber is partially burnt and deteriorates. However, when the super-heated steam or high dew point temperature heated moist air having a dew-point temperature of 65° C. or higher are used as in the present invention, those risks are eliminated.

Since a new drying method was developed and, under cooperation of the research laboratory of our company, a huge number of sheets were produced for trial purposes from pulp material of various kinds (BKP, BCTMP and DIP respectively using conifers and broad-leaved trees) and beating degrees, using the method of the present invention, and the sheet materials were dried by use of super-heated steam and heated moist air of from 250° C. to 150° C., to thereby execute various physical tests after adjusting the humidity. FIGS. 21, 22, 23, and 24 show a part of the test results together with a regression equation. The DRY and WET characteristic test results using printing papers using NBCTMP (Bleached Chemi Thermo Mechanical Pulp of conifers) and-de-inked waste paper DIP (De Inked Pulp) as a raw material, are shown in comparison with the results using the internal heating cylinders in the conventional technique, as a coordinate with X-axis denoting apparent density and the Y-axis denoting tensile strength. As described above, the paper sheet obtained by the present invention shows that although the apparent density decreases due to the porous and bulky sheet material, the tensile strength for both (DRY) and (WET) increase considerably. The difference between drying process of the present invention using the super-heated steam and the heated moist air and the conventional technique using the internally heating cylinders are clearly shown in the scatter diagram and the paper obtained according to the present invention showed a dramatic improvement as shown by the regression equations. In addition, extensibility in water and burst strength were also improved considerably. The results will be described below in detail. In a test using the NBCTMP pulp shown in FIG. 21, if calculation is performed by the regression equation for the case of SHS 250° C. and a conventional drying cylinder dryer, in the case of the apparent density of 0.4, y=7.909 in the SHS method and y=5.87 in the conventional method. As a result, it shows an increase of about 34.7% in the tensile strength (DRY). In the DIP pulp test shown in FIG. 22, in the case of the apparent density of 0.6, y=7.9274 in the SHS method and y=6.5782 in the conventional method. As a result, the above result indicates that the paper of the present method shows an increase of about 20.5% in the tensile strength (DRY). In the NBCTMP pulp test shown in FIG. 23, in the case of the apparent density of 0.4, y=0.55476 in the SHS method and y=0.16444 in the conventional method. As a result, the present paper shows an increase of about 337.4% in the tensile strength (WET). In the DIP pulp test shown in FIG. 24, in the case of the apparent density of 0.5, y=0.233 in the SHS method and y=0.1184 in the conventional method. As a result, the present paper shows an increase of about 196.8% in the tensile strength (WET).

Figure 19:
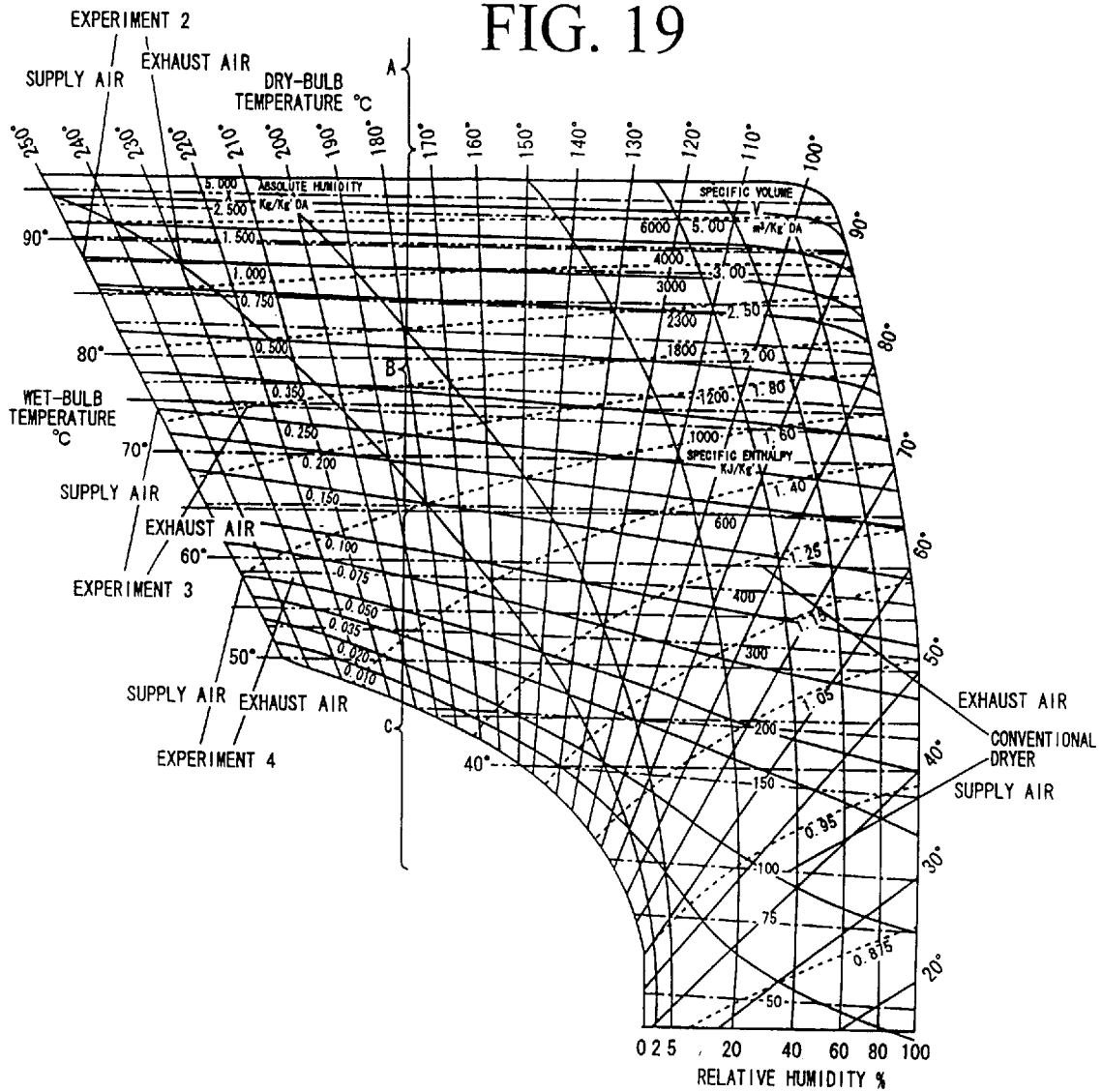
FIG. 19 is a Mollier chart showing a relation between high temperature, high humidity air and super-heated steam, in the case where the drying method of the present invention is executed. The range of the present invention is zone A indicating an area of super-heated steam and zone B of high temperature high humidity air, and the range of the related art is C. The intersection of the extension line of the absolute humidity and the line of the relative humidity 100% indicates the dew-point temperature.

As shown in Examples 1, 2, 3, 4 and 5 and FIG. 18 and FIG. 19, using super-heated steam of at least 150° C. in area A (an area implying an area of super-heated steam) shown in the Mollier chart in FIG. 19, where the method of the present invention was performed, and likewise in Example 2 and Example 3 using high temperature high humidity moist air having a dry-bulb temperature of at least 150° C. and a dew-point temperature of at least 65° C. in area B (an area of high temperature high humidity moist air) where the method of the present invention was performed, the required heat and thermal efficiency of a heat exchanger for circulating gas heating was considerably improved compared to Example 4 and Example 5 using high temperature, low humidity moist air in area C (conventional area). That is, as shown in the required heat per paper BD ton in item (4) described in the earlier section, at the time of blowing the super-heated steam of 250° C., the moisture carried in from the wire part was recovered and used as super-heated steam, thereby enabling a considerable reduction of the amount of fuel consumed by about one eighth (⅛), compared to the conventional dryer cylinder of the pressurized vessel. Moreover, discharge in Example 5 using a low dew-point temperature in the conventional technical range was such that t=225.7° C., $_{\chi}$=0.032 kg/kg' DA, a dew-point temperature was 33.07° C., i=76.8 kcal/kg' DA, oxygen concentration was 17.9% in the above described conditions, and heat transfer in condensation could not be recovered, and only the sensible heat could be recovered. Therefore, discharge gas is escaped uselessly as being condensed in the air and being generated and escaping as white smoke. In FIG. 19, an intersection of the extension line of the absolute humidity and the line of the relative humidity 100% indicates the dew-point temperature.

Figure 25:
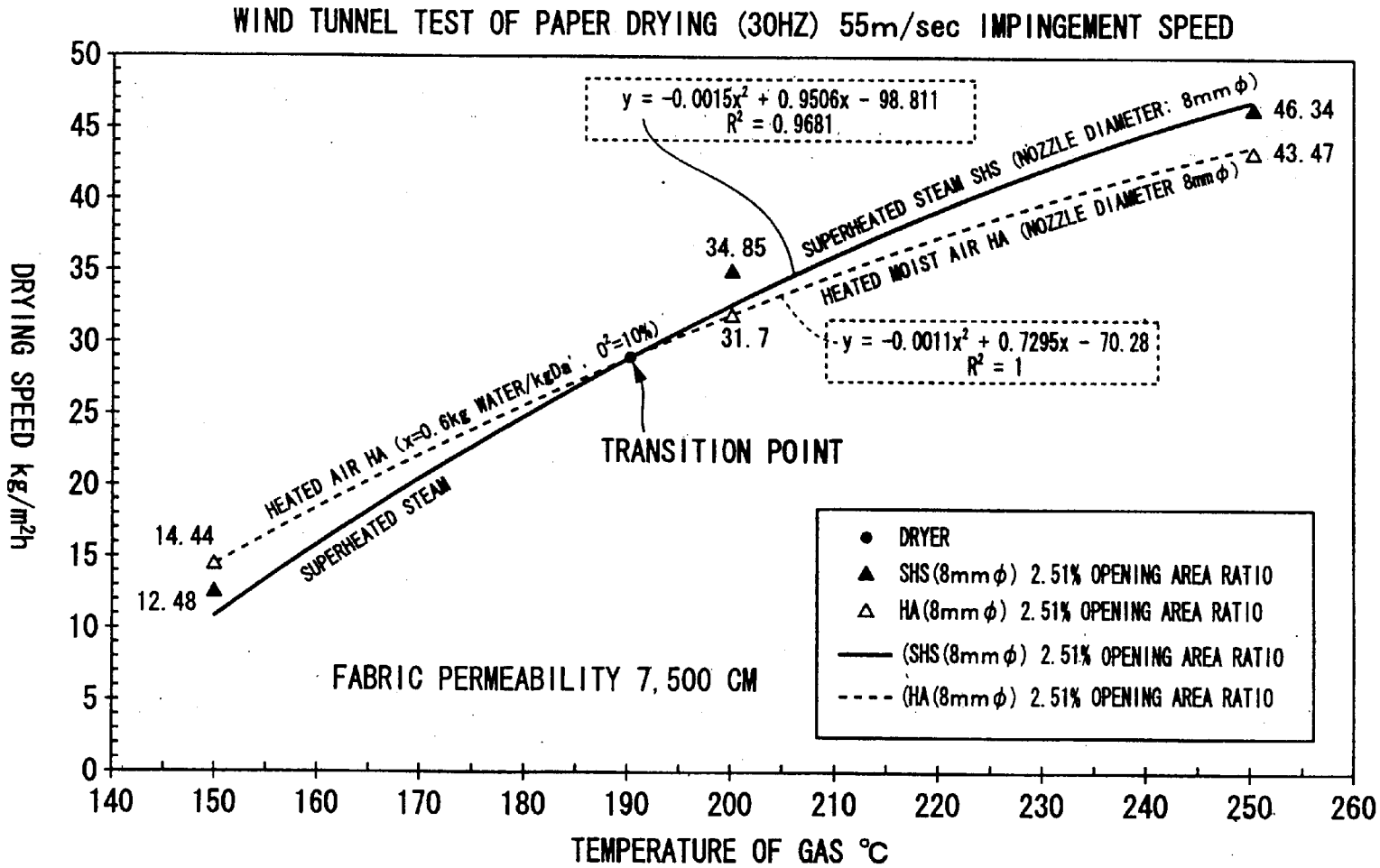
FIG. 25 is a graph showing a relation between drying rate and gas condition and impingement temperature, in the case where the drying method of the present invention is performed.

As shown in FIG. 25, as the impingement temperature of the heated gas increases exceeding 150° C., the drying rate increases, but the cost of the heat-resistant belt-like body becomes expensive. Therefore, in the current situation, about 250° C. is advantageous. As shown in this figure, though differing depending on the absolute humidity of the air, crossing the transition point from 170° C. to 220° C., there is a reversed relation between the super-heated steam (SHS) and the heated moist air (HA), such that in the low temperature zone, the drying rate of the air having no thermal radiation property increases, but in the high temperature zone, the drying rate of steam, being a thermal radiation gas, increases. An impingement gas speed of the heated gas is above 50 m per sec., preferably, is higher than 100 m per sec., and a numerical aperture of the nozzle for sucking the impingement gas is preferably in a range of 2% to at least 3%, for contributing to the increase of the drying rate. However, an increase of gas flow rate is accompanied by a rapid increase of power consumption, and hence there is a limit in economy. This figure shows a case where a numerical aperture is 2.51%, with a nozzle diameter being 8 mm. Moreover, if the impingement gas impinges upon one line of the sheet continuously, a mark line is easily formed on the surface of the sheet. Therefore, as the arrangement of the nozzle opening, an arrangement in a rhombic shape or forced rolling is preferable, in order to avoide a lattice pattern, with an exception of a special paper application with marks. The numerical aperture of the nozzle stands for a ratio % of the total projected area of the blower ports 19 on the opposing rotating cylinder with respect to the total cross-section of the nozzle opening. Actually, vena contracta occurs due to the nozzle or orifice shape, and hence the cross-section of gas impingement decreases, thereby increasing the velocity. The fabric belt used for the test shown in FIG. 25 is one manufactured by Diwabo, having a gas permeability of 7555 CCM, made of PPS.

Figure 26:
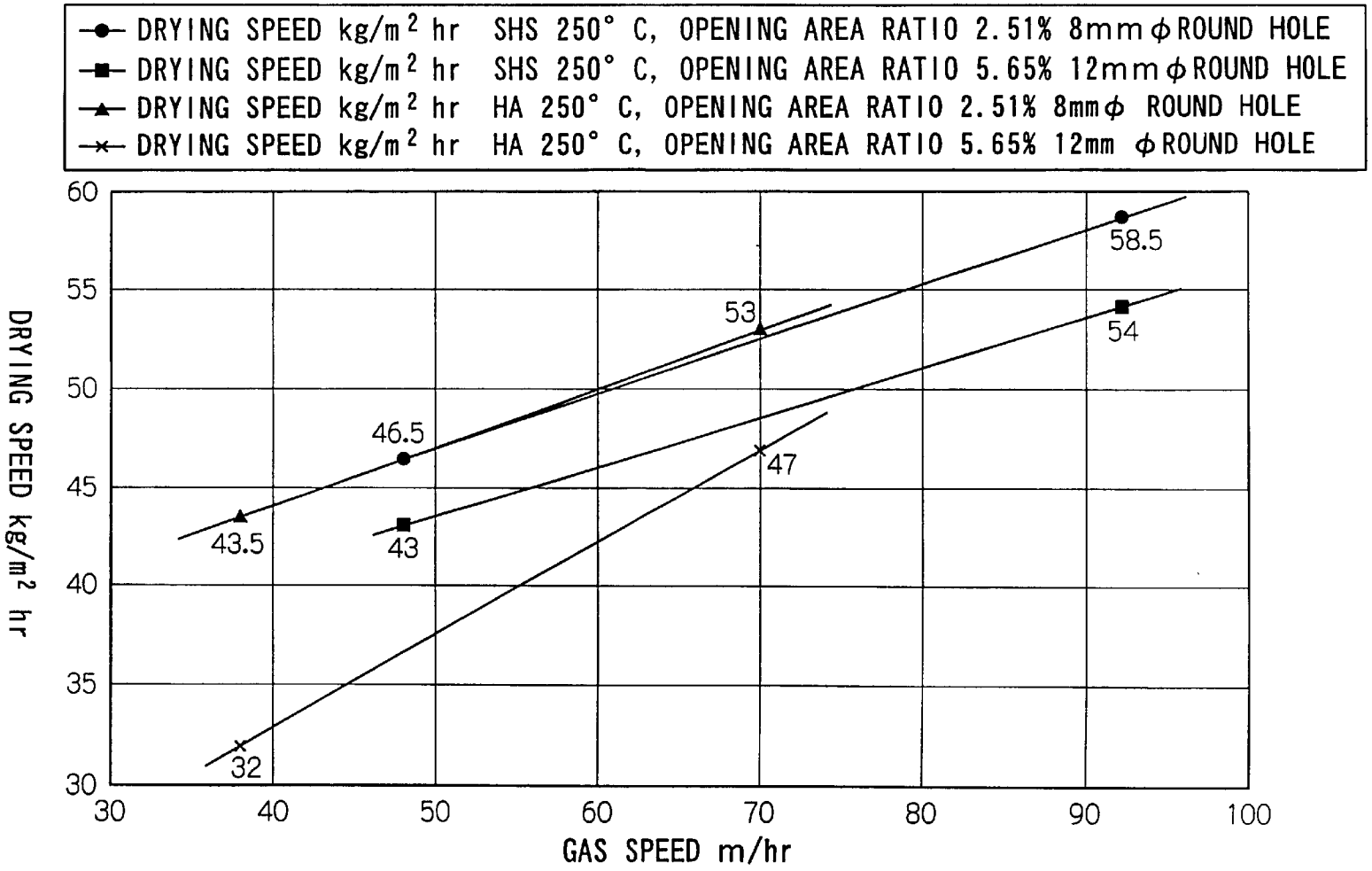
FIG. 26 is a graph showing a relation between drying rate and gas condition and impingement speed, in the case where the drying method of the present invention is performed.
Figure 27:
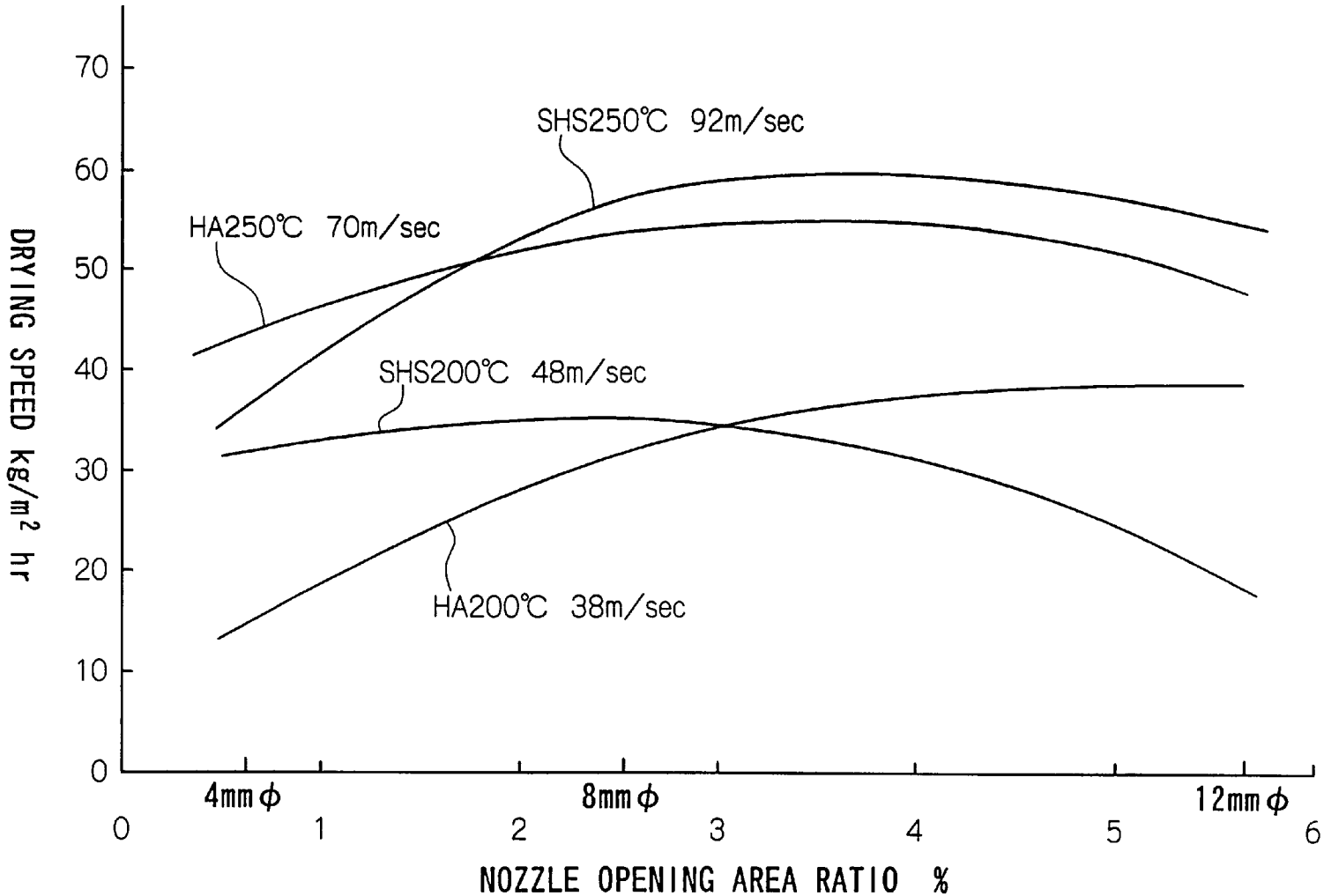
FIG. 27 is a graph showing a relation between drying rate and gas condition and numerical aperture of the nozzle, in the case where the drying method of the present invention is performed.
Figure 28:
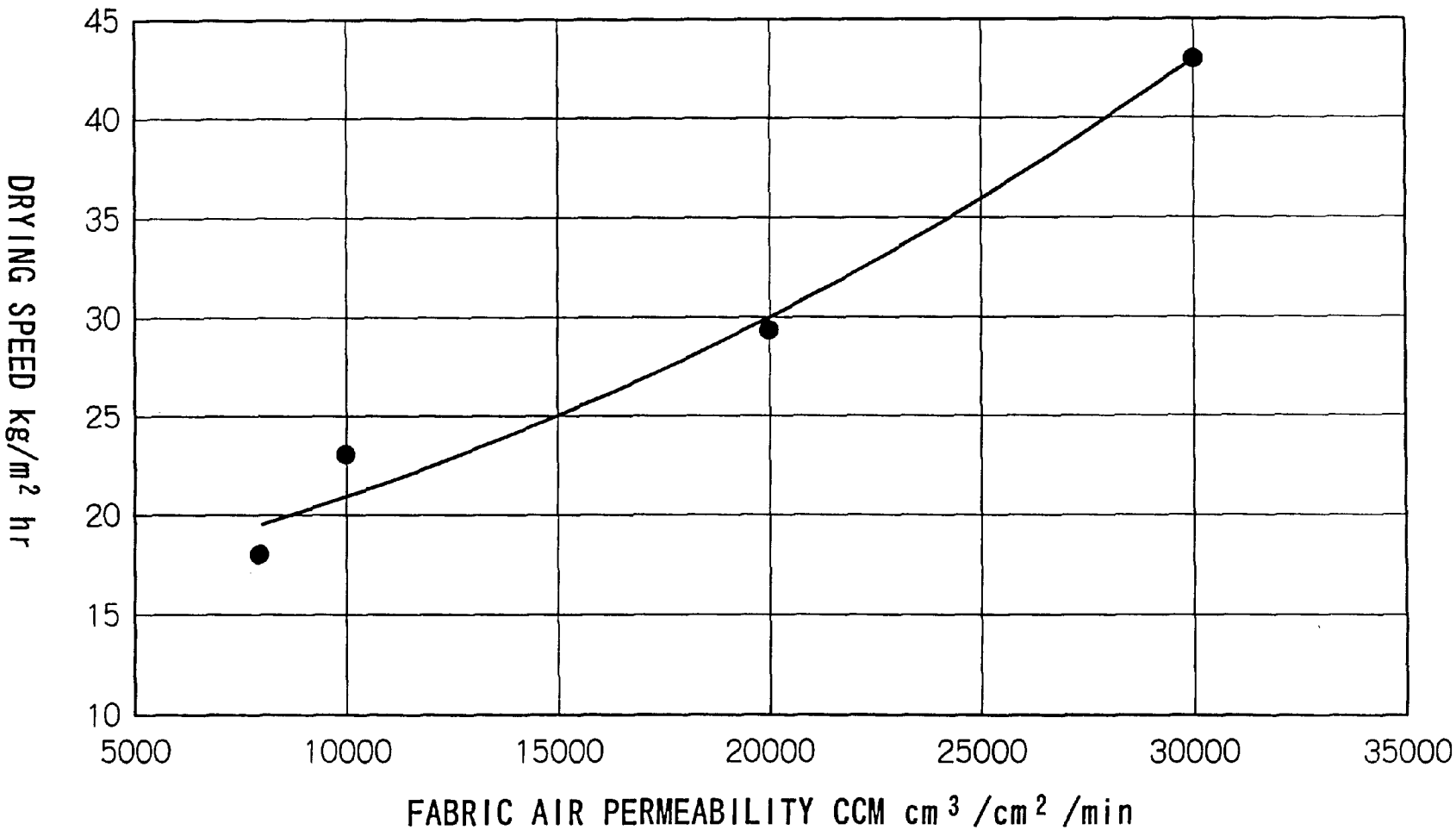
FIG. 28 is a graph showing a relation between drying rate and gas condition and gas permeability of the fabric belt, in the case where the drying method of the present invention is performed.

FIG. 26 shows a relation between the drying rate and the impingement speed of the heated gas, in the case of using heated air and super-heated steam of 250° C., respectively, with the numerical aperture of the nozzle being 5.65% (nozzle diameter: 12 mm) and 2.51% (nozzle diameter: 8 mm). FIG. 27 shows a relation between the drying rate and the numerical aperture of the nozzle (12 mm, 8 mm, 4 mm–0.63%), in the case of using heated air and super-heated steam of 250° C. and 200° C., respectively, at the time of the impingement speed being 70, 38, and 92 and 48 m/sec. Those graphs show a case where a cap hood having a nozzle diameters of 12 mm, 8 mm and 4 mm was sequentially replaced, and the number of revolution of the circulating fan for heated gas was respectively changed to 30 Hz and 60 Hz by an inverter motor, and the impingement speed was measured at the nozzle exit. FIG. 28 shows a relation between the drying rate and the gas permeability in CCM ($cm^3/cm^2/min$, back pressure: 1.27 cm) (the 1 $m^3/m^2/hr$ is 1.667 CCM) of the endless fabric belt.

Figure 30:
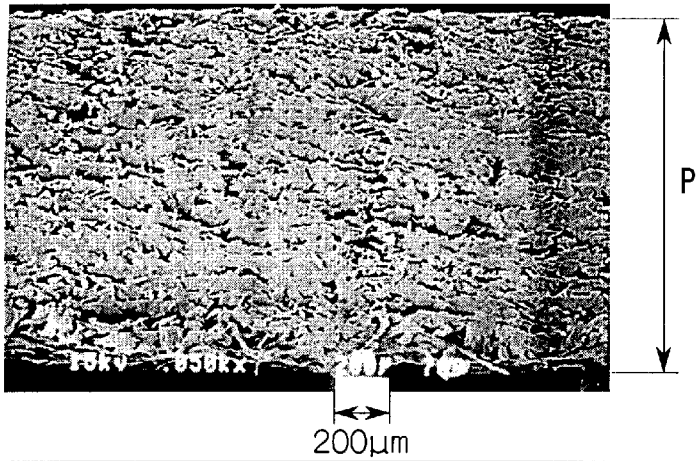
FIG. 30 is an electron micrograph showing a cross-section of a sheet dried by cylinder drying in the related art.
Figure 30:
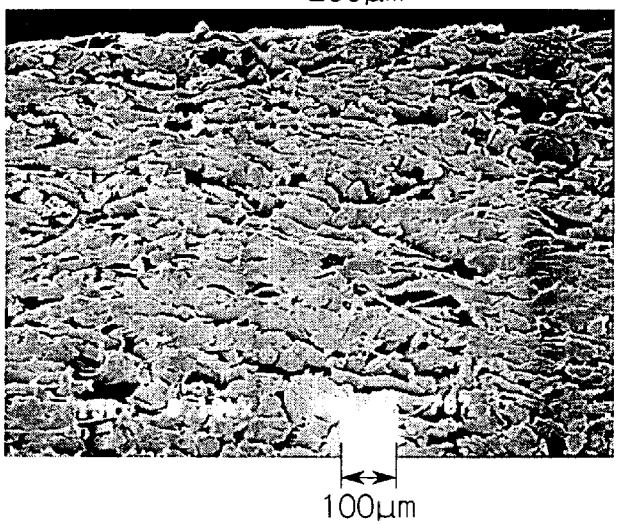
Figure 30:
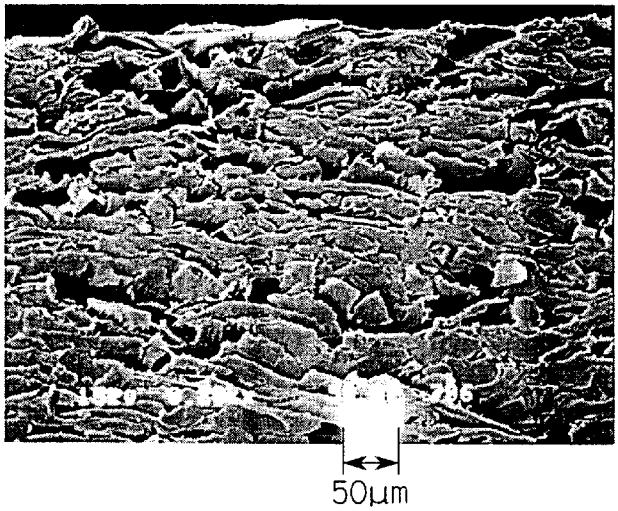
Figure 31:
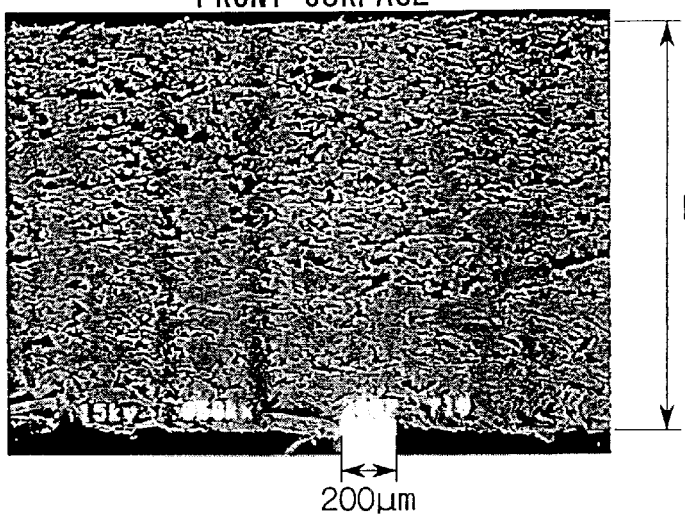
FIG. 31 is an electron micrograph showing a cross-section of a sheet having many porous portions, dried by super-heated steam, in the case where the drying method of the present invention is performed.
Figure 31:
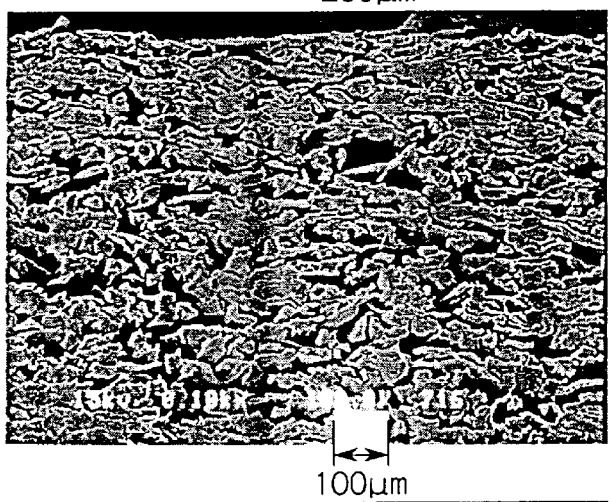
Figure 31:
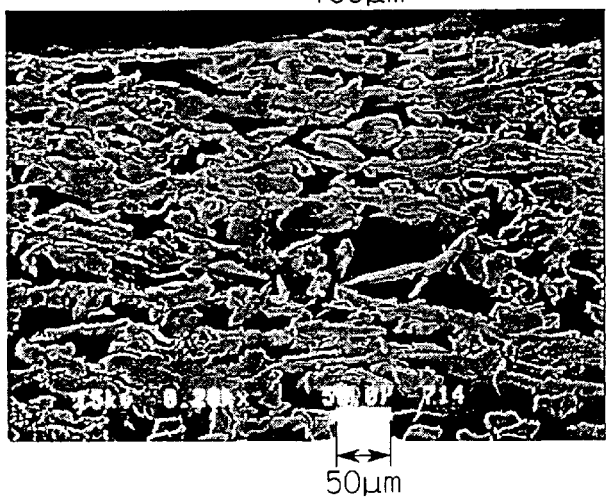
Figure 32:
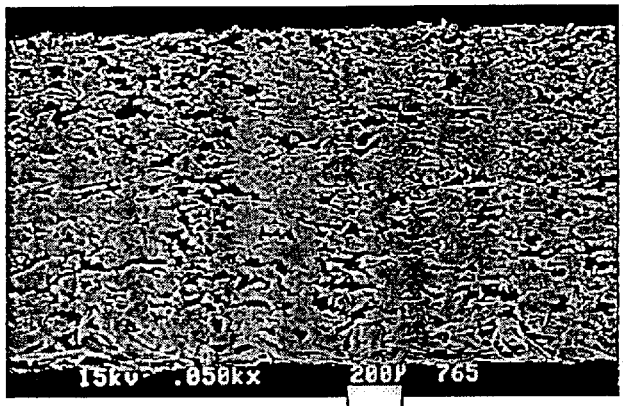
FIG. 32 is an electron micrograph showing a cross-section of a sheet dried by heated air, in the case where the drying method of the present invention is performed.
Figure 32:
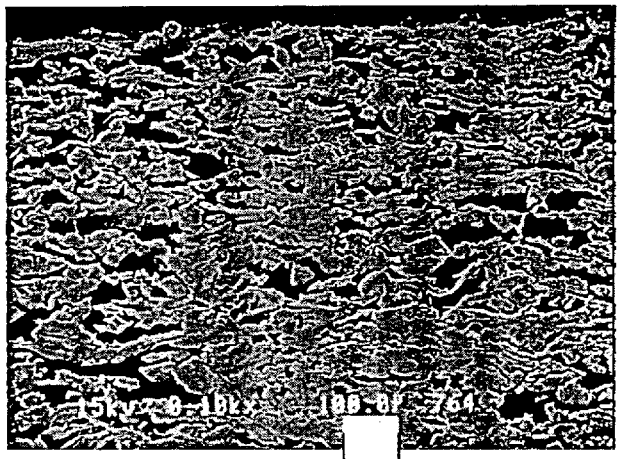
Figure 32:
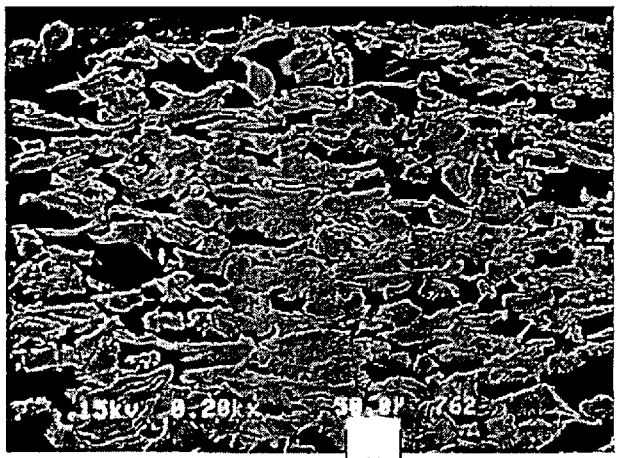

The method of the present invention has been tested using various kinds of paper. In order to demonstrate that the present invention has an effect not only for thin paper but also thick boards, electron micrographs of a cross-section of a board made of BKP (bleached Kraft pulp) are shown in FIG. 30 to FIG. 32. FIG. 30 shows a board dried by a conventional internal heating cylinder, FIG. 31 shows a board dried by the impingement drying method using super-heated steam of 250° C. according to the method of the present invention, and FIG. 32 shows a board dried by the impingement drying method using heated air having an absolute humidity $_{\chi}$=0.672 kg/kg' Da at 244.2° C. according to the method of the present invention. The upper figure is shown with a magnification of 50, the middle figure is shown with a magnification of 100, and the lower figure is shown with a magnification of 200. It is obvious that in only the drying method using super-heated steam, voids in the sheet are rapidly increased. As is obvious from the upper figure, the board thickness in the related art is 1.25 mm, whereas the board thickness is 1.65 mm in the case of the super-heated steam in the method of the present invention (in the case of heated air, it is 1.23 mm), which indicates that the sheet becomes bulky by about 32%. This difference is due to the fact that the sheet temperature in the wet zone of the sheet is between 110° C. and 100° C. in the case of SHS, while on the other hand, it is in the vicinity of 90° C. in the case of HA, due to the relation of the dew-point temperature.

As a result of pore test by means of the method of mercury penetration, the bulk density of the boards dried by the conventional internal heating cylinder is 0.4116 g/cc, but on the other hand, that of the boards dried by the impingement drying method using super-heated steam of 250° C. according to the method of the present invention is 0.3142 g/cc, showing a reduction of about 31%.

According to the present invention, by blowing heated gas under specific conditions from the outer peripheral direction of the external heating type rotor which supports the sheet material, water content in the sheet material in a wet condition is evaporated instantaneously (pressure flowed), to dry the sheet material at high speed to a porous condition, so that paper having a low apparent density and being bulkier by about 32% compared to the related art can be manufactured. At this time, heated gas is blown to the sheet material under specific conditions, while holding the sheet material between the gas-permeable belt and the cylinders, so that shrinkage of the sheet material is suppressed. As a result, paper having stable physical properties and high strength compared to that in the related art can be manufactured with heating requirement of about one eighth of that in the related art. Moreover, the drying rate of about six times as fast as that in the conventional art can be achieved in spite of Fabric through. (In the case of the conventional technology using Yankee dryer, a high temperature combustion gas or air having low humidity is directly blown).

What is claimed is:

1. A method of producing a sheet material by drying a wet sheet material web in a selected drying zone, which is enclosed by a sealed hood and which comprises a plurality of cylindrical rotors externally heated by super-heated steam used as heated gas, and a heat-resistant endless fabric belt, comprising the steps of:

supporting an inner surface of the sheet material in a wet condition by an externally heated cylindrical rotor having a rotatable arc-shaped smooth surface mounted in the sealed hood, inside of which is maintained at a predetermined pressure and temperature; and clamping the outer surface of said sheet material by the endless heat-resistant fabric belt movable in synchrony with the rotation of said rotor and having a gas permeability of at least 7,500 $cm^3/cm^2/min.$, while said fabric belt applies a tension so as to be capable of restraining dry shrinkage of the sheet material by pressing the sheet material on said rotor by the fabric belt; and blowing super-heated steam of at least 150° C. as the heated gas to the outer surface of said rotor through the fabric belt in a selected drying zone according to the paper grade to thereby dry said sheet material mainly by external heating;

wherein super-heated steam of at least 150° C. obtained by circulating and reheating super-heated steam from said sealed hood interior is used as heated gas for blowing to the outer surface of the rotor, and super-heated steam of at least 130° C. substantially corresponding to the steam content carried into said hood by the sheet material in a wet condition is discharged outside of said hood.

2. A method of producing sheet material according to claim 1, wherein heated moist sir having a dry-bulb temperature of at least 150° C. and a dew-point temperature of at least 65° C. obtained by circulating and reheating discharge gas from said hood interior is used as said heated gas which is blown to the wet sheet, and high temperature moist air having a dry-bulb temperature of at least 130° C. containing water vapor substantially corresponding to the sum of a weight of water vapor carried into said hood from the wet sheet material and a weight of water vapor carried in from other channels is discharged from said hood, and low moist air is supplied to said hood interior at a weight approximately equivalent to a dry air weight in said discharged volume, obtained by calculating the weight of the dry air contained in the discharge volume.

3. A method of producing sheet material according to claim 1, wherein a mixed gas of a nitrogen gas of not less than 80%, water vapor of about 5%, a solvent gas and oxygen, which is obtained by circulating and reheating the discharge gas from said hood interior, and set to a dry-bulb temperature of not lower than 150° C., is used as said heated gas which is blown to the wet sheet, and the mixed gas having a dry-bulb temperature of at least 130° C. containing water vapor substantially corresponding to the sum of a weight of water vapor carried into said hood from the wet sheet material in a wet condition and a weight of water vapor carried in from other channels is discharged outside of said hood.

4. A method of producing sheet material according to claim 1, wherein super-heated steam of at least 150° C. from a hydrogen-oxygen gas turbine which uses hydrogen gas fuel and oxygen is used as said heated gas which is blown, and the discharge of at least 130° C. is supplied to a condensing steam turbine, together with the steam component carried into said hood by the sheet material in a wet condition, to thereby generate power.

5. A method of producing sheet material according to claim t wherein said heated gas to be blown to the rotor is obtained by mixing high temperature and high humidity air discharged from the sealed hood having a dry-bulb temperature of at least 130° C. containing steam substantially corresponding to the sum of a weight of steam evaporated from said sheet material and steam carried in from other channels, with newly adding low humidity air substantially equivalent weight obtained by weight conversion of the discharged humid air, and by rehearing the mixed gas to a dry-bulb temperature of at least 150° C. and a dew-point temperature of at least 65° C.

6. A method of producing sheet material according to claim 1, wherein a balance of an amount of gas to be supplied and discharged with respect to said hood interior is controlled to thereby set the pressure inside of said hood to be higher than the outside pressure.

7. A method of producing sheet material according to claim wherein an excess gas of at least 130° C., containing steam evaporated from said sheet material is recycled as a heat source for another apparatus.

8. A method of producing sheet material according to claim 1, wherein a blow speed of said heated gas which is blown to the rotor through the wet sheet material and the fabric belt is set to at least 50 m/sec.

* * * * *